US012741771B2

(12) United States Patent
Bowden et al.

(10) Patent No.: US 12,741,771 B2
(45) Date of Patent: Sep. 22, 2026

(54) METHODS FOR CREATING AN ENCLOSURE, A REGULATED ATMOSPHERE, AND FUNCTIONAL TREATMENTS FOR PERISHABLE PRODUCTS

(71) Applicant: RLMB Group, LLC, Honolulu, HI (US)

(72) Inventors: R. Craig Bowden, Honolulu, HI (US); Dung Doan, Morgan Hill, CA (US); John Williams, Hollister, CA (US); Robert Herdeman, Loveland, OH (US)

(73) Assignee: RLMB Group, LLC, Honolulu, HI (US)

( * ) Notice: Subject to any disclaimer, the term of this patent is extended or adjusted under 35 U.S.C. 154(b) by 0 days.

(21) Appl. No.: 19/204,318

(22) Filed: May 9, 2025

(65) Prior Publication Data

US 2026/0048884 A1 Feb. 19, 2026

Related U.S. Application Data

(62) Division of application No. 17/790,098, filed as application No. PCT/US2020/067731 on Dec. 31, 2020, now Pat. No. 12,330,825.

(Continued)

(51) Int. Cl.

| | |
|---|---|
| ***B65B 31/00*** | (2006.01) |
| ***B65B 11/04*** | (2006.01) |
| ***B65B 31/04*** | (2006.01) |

(52) U.S. Cl.

CPC ..... *B65B 31/04* (2013.01); *B65B 11/045* (2013.01)

(58) Field of Classification Search

CPC ... B65B 25/041; B65B 25/001; B65B 11/025; B65B 2210/20; B65B 31/00;

(Continued)

(56) References Cited

U.S. PATENT DOCUMENTS 2,198,094 A 4/1940 Swafford
3,855,756 A 12/1974 Sweeney et al.

(Continued)

FOREIGN PATENT DOCUMENTS

FR 2552731 A1 4/1985
WO 2015/130992 A1 9/2015

(Continued)

OTHER PUBLICATIONS

Non-Final Rejection dated Sep. 26, 2025, directed to U.S. Appl. No. 18/741,449; 34 pages.

(Continued)

*Primary Examiner* — Jacob A Smith
(74) *Attorney, Agent, or Firm* — Michele V. Frank; Venable LLP

(57) ABSTRACT

A method for creating a modified atmosphere in a sealed enclosure includes placing a bottom sheet on a bottom surface of a package, to be enclosed inside the sealed enclosure, on a pallet, placing a top sheet on a top surface of the package, placing a manifold on the top sheet, below the bottom sheet, or both on the top sheet and below the bottom sheet, and applying a side sheet such that the bottom sheet, the top sheet, and the side sheet form the sealed enclosure. The method further includes injecting at least one treatment, gas, or substance into the sealed enclosure through the manifold, and removing the manifold.

31 Claims, 44 Drawing Sheets

Related U.S. Application Data

(60) Provisional application No. 62/955,969, filed on Dec. 31, 2019.

(58) Field of Classification Search
CPC ..... B65B 31/06; B65B 31/08; B65B 11/048; B65D 81/20; B65D 81/2084
USPC ..... 53/432, 386.1, 434, 449, 510
See application file for complete search history.

(56) References Cited

U.S. PATENT DOCUMENTS

| | | | | |
|---|---|---|---|---|
| 3,867,806 | A | 2/1975 | Lancaster, III et al. | |
| 3,893,279 | A | 7/1975 | Bostrom | |
| 3,986,611 | A | 10/1976 | Dreher | |
| 4,515,266 | A | 5/1985 | Myers | |
| 4,912,913 | A | 4/1990 | Rundle | |
| 5,028,443 | A | 7/1991 | Wade | |
| 5,195,297 | A | 3/1993 | Lancaster et al. | |
| 5,226,735 | A | 7/1993 | Beliveau | |
| 5,251,753 | A | 10/1993 | Pigott et al. | |
| 5,314,286 | A | 5/1994 | Bolejack et al. | |
| 5,354,569 | A | 10/1994 | Brown et al. | |
| 5,402,906 | A | 4/1995 | Brown et al. | |
| 5,463,843 | A | 11/1995 | Sharp | |
| 5,505,950 | A | 4/1996 | Floyd et al. | |
| 5,678,389 | A | 10/1997 | Henry | |
| 5,735,786 | A | 4/1998 | Krueger et al. | |
| 5,747,082 | A | 5/1998 | Floyd et al. | |
| 5,893,216 | A | 4/1999 | Smith et al. | |
| 5,896,995 | A | 4/1999 | Murray et al. | |
| 5,916,615 | A | 6/1999 | Brady et al. | |
| 5,945,147 | A * | 8/1999 | Borchard | B65B 25/041 426/396 |
| 6,047,523 | A | 4/2000 | Eyre et al. | |
| 6,132,350 | A | 10/2000 | Krueger et al. | |
| 6,186,931 | B1 | 2/2001 | Calvert et al. | |
| 6,305,148 | B1 * | 10/2001 | Bowden | B65B 31/047 206/524.8 |
| 6,854,246 | B2 | 2/2005 | Savage et al. | |
| 6,920,740 | B2 | 7/2005 | Blake et al. | |
| 7,958,696 | B2 | 6/2011 | McLaughlin et al. | |
| 8,256,190 | B2 | 9/2012 | Bowden et al. | |
| 8,337,752 | B2 | 12/2012 | Yamamoto et al. | |
| 8,507,020 | B2 | 8/2013 | Deslauriers et al. | |
| 8,662,334 | B2 | 3/2014 | Turvey et al. | |
| 10,759,588 | B1 | 9/2020 | Lobisser et al. | |
| 11,110,645 | B2 | 9/2021 | Bowden | |
| 12,116,195 | B2 | 10/2024 | Spadavecchia et al. | |
| 2001/0029722 | A1 | 10/2001 | Ours et al. | |
| 2002/0078661 | A1 | 6/2002 | Bowden et al. | |
| 2002/0084202 | A1 | 7/2002 | Nist | |
| 2003/0046900 | A1 | 3/2003 | Zitella et al. | |
| 2003/0182900 | A1 | 10/2003 | Bowden et al. | |
| 2004/0045259 | A1 | 3/2004 | Solis et al. | |
| 2005/0044812 | A1 * | 3/2005 | Lancaster, III | B65B 41/16 53/399 |
| 2005/0092637 | A1 | 5/2005 | Baechle et al. | |
| 2006/0048482 | A1 | 3/2006 | Borchard | |
| 2006/0147588 | A1 | 7/2006 | Garwood | |
| 2007/0017843 | A1 | 1/2007 | Keel et al. | |
| 2008/0134640 | A1 | 6/2008 | Bowden et al. | |
| 2008/0216450 | A1 | 9/2008 | MacLeod et al. | |
| 2012/0279180 | A1 | 11/2012 | Crawford et al. | |
| 2013/0205717 | A1 * | 8/2013 | Bowden | A23B 2/708 53/403 |
| 2014/0209607 | A1 | 7/2014 | Fosse | |
| 2015/0203222 | A1 | 7/2015 | Zonato | |
| 2015/0239639 | A1 * | 8/2015 | Wenner | B65B 11/585 206/386 |
| 2016/0355283 | A1 | 12/2016 | Capitani | |
| 2018/0141738 | A1 | 5/2018 | Armano et al. | |
| 2019/0143580 | A1 | 5/2019 | Bowden | |
| 2020/0207491 | A1 | 7/2020 | Koet et al. | |
| 2021/0070482 | A1 | 3/2021 | Karau | |
| 2022/0048651 | A1 | 2/2022 | de Jong et al. | |
| 2022/0380075 | A1 | 12/2022 | Bowden | |
| 2023/0059420 | A1 | 2/2023 | Bowden et al. | |
| 2024/0206485 | A1 | 6/2024 | Bowden et al. | |

FOREIGN PATENT DOCUMENTS

| | | | |
|---|---|---|---|
| WO | 2021/138602 | A1 | 7/2021 |
| WO | 2022/246205 | A1 | 11/2022 |

OTHER PUBLICATIONS

Non-Final Rejection dated Aug. 11, 2025, directed to U.S. Appl. No. 18/563,208; 14 pages.

Office Action dated Aug. 23, 2023, directed to Canadian Patent Application No. 3,161,518; 4 pages [Cited in Parent Application].

Extended European Search Report dated May 3, 2024, directed to EP Application No. 20908565.3; 5 pages [Cited in Parent Application].

Non-Final Rejection dated May 7, 2024, directed to U.S. Appl. No. 17/827,465; 17 pages [Cited in Parent Application].

International Search Report and Written Opinion mailed Oct. 17, 2022, directed to International Application No. PCT/US2022/030263; 17 pages [Cited in Parent Application].

International Search Report and Written Opinion mailed May 4, 2021, directed to International Patent Application No. PCT/US2020/067731; 20 pages [Cited in Parent Application].

"ARPAC's ARBOT Robotic Palletizper and Automatic Stretch Wrapper Palletizing Magazines", (ARPAC a Duravant Company) Jun. 16, 2014; located at <https://www.youtube.com/watch?v=yeKbXxbNZnA> [Cited in Parent Application].

International Search Report and Written Opinion mailed Oct. 31, 2024, directed to International Application No. PCT/US2024/033598; 16 pages [Cited in Parent Application].

Notice of Allowance mailed Nov. 22, 2024, directed to U.S. Appl. No. 17/827,465; 11 pages [Cited in Parent Application].

Notice of Allowance dated Mar. 10, 2026, directed to U.S. Appl. No. 18/741,449; 18 pages.

* cited by examiner

800a

800b

800c

800d

800e

800f

800g

METHODS FOR CREATING AN ENCLOSURE, A REGULATED ATMOSPHERE, AND FUNCTIONAL TREATMENTS FOR PERISHABLE PRODUCTS

CROSS REFERENCE TO RELATED APPLICATIONS

This application is a divisional of U.S. patent application Ser. No. 17/790,098, filed Jun. 29, 2022, which is a National Stage Application under 35 U.S.C. § 371 of International Application No. PCT/US2020/067731, filed Dec. 31, 2020, which claims priority to U.S. Provisional Patent Application No. 62/955,969, filed Dec. 31, 2019. The entire contents of each of the aforementioned applications are incorporated herein by reference in their entirety.

TECHNICAL FIELD

This patent application relates generally to a system, method, and apparatus for wrapping a pallet of stacked goods or container to create a sealed enclosure. More specifically, the application relates to creating and maintaining a modified atmosphere within a sealed enclosure and use of specific substances to protect, preserve, or enhance a perishable product.

BACKGROUND

Goods risk damage from numerous sources such as wind, dirt, heat, insects, etc. during transportation. This risk is even greater for perishable or environmentally sensitive goods, which are also susceptible to decay. Various forms of packaging have been used to minimize damage or decay of such goods. For example, goods are often secured to a pallet to facilitate the transport of such goods and to protect the goods from damage caused by shifting during transport. In order to further protect and preserve the goods during transport, an enclosure may be formed around the goods. Known techniques to create an enclosure include heat shrinking plastic around the goods which have been placed on a pallet, or by placing a plastic bag around the goods on a pallet.

However, existing enclosure systems suffer from disadvantages. For example, providing a bag covering to form the closure is difficult to seal on the open bottom end of the cover. In another example, a plastic base cap may be placed over the pallet. The base cap is sized to cover the pallet, and the goods are stacked on top of the base cap. In this configuration, the bag covering is often larger than the base cap of the pallet, so sealing the bag covering to the base cap requires folding and creasing the bag covering. The folding and creasing prevents a smooth contact between the inside surface of the bag covering and outside edges of the base cap, leaving gaps. In order to form a more airtight seal, the bag must be adhered to the base cap with tape or other adhesive, increasing time and costs.

In another example, when wrapping plastic around palletized goods, completely sealing the enclosure is difficult, especially at the top and bottom of the pallet of stacked goods. The wrapping must curve around the corners and edges of goods, leading to potential gaps or creases or even tears in the wrapping. As previously discussed, the gaps, creases, and tears are undesirable as they provide channels for air to escape or enter the sealed enclosure.

In some examples, a modified atmosphere is introduced into the sealed enclosure by injecting a gas mixture through a needle-tipped hose that is taped to the covering and a desired gas mixture is injected through the hose into the sealed enclosure. The process ends by removal of the needle-tipped hose from the enclosure and re-sealing of the resulting hole in the covering with tape or other adhesives. The steps of manually piercing the enclosure to insert the needle hose and resealing the resulting hole are labor intensive, adding cost and delays to the shipping process. The seal is compromised by piercing and resealing creates an additional risk of leakage around the tape or if the hole is not taped properly, leading to a loss of the modified atmosphere and/or contamination. U.S. Pat. No. 8,256,190, the entire contents of which are hereby incorporated by reference, overcomes some of the above difficulties by coupling a valve to the base cap to allow for exchange of gases within the sealed enclosure.

Therefore, a need exits for a method, system, and apparatus of creating an airtight sealed enclosure. A need exits for a method, system, and apparatus for introducing a modified atmosphere is needed.

BRIEF SUMMARY

According to an embodiment, an apparatus for creating a modified atmosphere in a sealed enclosure may include a stabilizing support bar; and at least one nozzle attached to the stabilizing support bar at an angle, the at least one nozzle being configured to connect to a gas source, wherein the stabilizing support bar is configured for being placed on a package to be enclosed in the sealed enclosure, and the at least one nozzle is configured to inject gas into the sealed enclosure through the nozzle.

According to an embodiment, the package comprises stacked goods on a pallet, a slip-sheet, in a bin, or other container.

According to an embodiment, a top sheet is placed directly on top of the package and the stabilizing support bar is placed on top of the top sheet.

According to an embodiment, the nozzle is connected to a vacuum source.

According to an embodiment, the angle formed between the nozzle and the stabilizing support bar is a right angle.

According to an embodiment, the stabilizing support bar has a package facing side for positioning adjacent a first package side, and the nozzle, the at least one nozzle having a nozzle package facing side for positioning adjacent a second package side, different from the first package side, wherein the angle formed between the nozzle and stabilizing support bar angle corresponds with a package angle, whereby the stabilizer bar is adjacent the first package side and the at least one nozzle is adjacent the second package side, the at least one nozzle is positioned to be a fluid conduit between the gas source and an interior of the sealed enclosure.

According to an embodiment, apparatus for creating a modified atmosphere in a sealed enclosure may include a base, wherein a package to be enclosed in the sealed enclosure is placed on the base; and a nozzle formed at a right angle to the base, the nozzle connected to a gas source, wherein the modified atmosphere is injected into the sealed enclosure through the nozzle.

According to an embodiment, the base is a pallet or slip-sheet, and the package comprises stacked goods on the pallet or the slip-sheet or bottom cap.

According to an embodiment, a bottom sheet is placed directly on the base and the package is placed on top of the bottom sheet or a bottom cap.

According to an embodiment, the nozzle is connected to a vacuum source.

According to an embodiment, the base rests on the floor, a platform, a conveyor, a rotatable turntable or any predetermined location that allows the apparatus to function as designed.

According to an embodiment, a vacuum is piped through an arm to the nozzle, the nozzle configured as a multipurpose nozzle to evacuate air and to inject the modified atmosphere or compressed air, and wherein one or more substances are injected through one or more channels, tubes, ports, turbos in the nozzle to direct, speed, or improve disbursement into the sealed enclosure enabling improved regulated substance treatments throughout the sealed enclosure.

According to an embodiment, the apparatus may further include applying a top sheet, a bottom sheet, and a wrap sheet to the package, wherein the top sheet, the bottom sheet, and the wrap sheet form the sealed enclosure, and wherein the vacuum and/or the modified atmosphere is performed simultaneously with wrapping of the wrap sheet.

According to an embodiment, a method for creating a modified atmosphere in a sealed enclosure may include placing a bottom sheet on a bottom surface of a package on a pallet, the package to be enclosed inside the sealed enclosure; placing a top sheet on a top surface of the package; placing a manifold on the top sheet, the manifold having a portion extending along a side surface of the package; applying a side sheet by rotating the package along a longitudinal axis of the package, the side sheet covering the portion of the manifold extending along the side surface of the package, the bottom sheet, the top sheet, and the side sheet forming the sealed enclosure; injecting at least one gas into the sealed enclosure through the manifold; and removing the manifold.

According to an embodiment, a functional sheet is applied to the side surface of the package before the side sheet, the top sheet, or the bottom sheet are applied.

According to an embodiment, the functional sheet comprises ingredients that i) neutralize, absorb, or blocks ethylene, ii) neutralize or absorb malodors, iii) neutralize or absorb a specific gas component such as carbon dioxide or oxygen, iv) absorb moisture, v) sanitize, vi) add aroma, or vii) any combination thereof.

According to an embodiment, the top sheet, the bottom sheet, the functional sheet, or the side sheet are formed of natural, compostable, biodegradable, recyclable, or reusable materials.

According to an embodiment, the top sheet, the bottom sheet, the side sheet, a functional sheet, or other materials contained within the sealed enclosure are made of pulp-based materials, paper materials, woven materials, non-woven materials, foils, substrates, or combinations thereof, and wherein, the top sheet, the bottom sheet, the side sheet, the functional sheet, or other materials contained within the sealed enclosure are then sprayed, coated, impregnated, laminated, embossed, printed with, generally contain, or combinations thereof, with functional substances.

According to an embodiment, functional substances are incorporated into any of the top sheet, the bottom sheet, or the side sheet.

According to an embodiment, the method may further include placing, spraying, or otherwise applying one or more functional substances on top of the pallet and below the top sheet in a sachet, pad, cardboard tie-sheet, as a liquid mixture, as a material substrate, or combinations thereof.

According to an embodiment, the method may further include placing, spraying, or otherwise applying one or more functional substances on top of the bottom sheet in a sachet, pad, sheet, fiberboard, or as a liquid mixture.

According to an embodiment, any of the top sheet, the bottom sheet, or the side sheet is perforated or treated such that some controlled intrusion of outside air and release of gasses within the pallet is permitted to achieve target levels of oxygen, nitrogen, carbon dioxide and moisture.

According to an embodiment, the top sheet is constructed in a manner to easily permit connection of a nozzle configured to add or exchange gas mixture around the package during or after the enclosure is sealed.

According to an embodiment, the at least one gas includes compressed, filtered, dry, or humidified air, industrial gas (nitrogen, carbon dioxide, carbon monoxide), ozone, air or any combination thereof.

According to an embodiment, the industrial gas is nitrogen, carbon dioxide, oxygen, carbon monoxide, nitrous oxide, an industrial gas that has been ionized or treated by plasma or corona discharge, or any combination thereof.

According to an embodiment, the method may further include functional substances mixed into the at least one gas, the functional substances including one or more forms of: chlorine dioxide, nitrous oxide, hydrogen peroxide, peracetic acid, ozone, or any sanitizer, ionized water, limonene, lemon oil, orange oil, grapefruit oil, rosemary oil, thyme oil, sunflower oil, other fruit-derived oils, tea tree oil, cinnamon oil, eucalyptus oil, potassium oleate, sodium dodecyl sulfate (SDS), ascorbic acid, citric acid, sodium bicarbonate, potassium carbonate, calcium phosphate, linear terpenes, cyclic terpenes, alcohols, aldehydes, esters, ketones, lactones, thiols, lipase, rose oil, rose essence, and fruit essence, vitamins, minerals, flavonoids, flavor compounds, color compounds, essence, essential oil, sugar, THC or THC compounds, CBD or CBD compounds, probiotics, phages, enzymes, pharmaceutical compounds, biological compounds, or ripening agents such as ethylene.

According to an embodiment, incorporating functional substances into or on a functional sheet, the top sheet, the bottom sheet, and/or the side sheet, wherein the functional substances include one or more of: a sanitizer, a preservative, an antifungal, an essential oil, a reducing agent, an aroma, cyclodextrins, ethylene reducing compound, ethylene blocking compound, ethylene scavenging compound, and a ripening agent.

According to an embodiment, the step of injecting at least one gas into the sealed enclosure through the manifold comprises injecting the gas after the package has been scaled or during final stages of forming the sealed enclosure.

According to an embodiment, the method may further include forming a seal between the side sheet and the top sheet at an interface where the nozzle portion of the manifold extending along the side surface of the package and after removal of the nozzle portion of the manifold, the sheets adhere to one another forming the seal.

According to an embodiment, the method may further include forming a seal between the side sheet and the top sheet or forming a seal between the side sheet and the bottom sheet, wherein the seal is formed at an interface where the nozzle portion of the manifold had been inserted along the side surface of the package and after removal of the nozzle portion of the manifold, the sheets adhere to one another forming the seal.

According to an embodiment, the seal is formed by one or more devices to wipe, press, roll, or any combination thereof, over the area of interface between the sheets.

According to an embodiment, the method may further include applying a vacuum to the sealed enclosure through the manifold before injecting the at least one gas into the sealed enclosure.

According to an embodiment, the pallet is placed on a rotatable turntable during the step of applying the side sheet.

According to an embodiment, the package is rotated during the steps of applying the side sheet and injecting the at least one gas into the sealed enclosure.

According to an embodiment, the manifold comprises a nozzle, a hose, and a mounting framework.

According to an embodiment, the mounting framework is a stabilizing support bar or a mechanical-robotic controlled support mounting.

According to an embodiment, wherein the nozzle portion of the manifold extends inside the sealed enclosure between the package and the top sheet, side sheet, and bottom sheet, and wherein the at least one gas is injected through the portion of the manifold extending along the side surface of the package.

According to an embodiment, the at least one gas is blended with a substance in the hose, in the nozzle, in a blending chamber, or any combination thereof.

According to an embodiment, the substance is another gas, pressurized gas, pressurized air, a functional substance, or combinations thereof.

According to an embodiment, the at least one gas is blended with a substance prior to the sealed enclosure or within the sealed enclosure.

According to an embodiment, the top sheet, the bottom sheet, side sheet, or any combination thereof comprises a predetermined oxygen transmission rate or a predetermined carbon dioxide transmission rate.

According to an embodiment, the injecting of the at least one gas creates the modified atmosphere.

According to an embodiment, the modified atmosphere controls a moisture level within the sealed enclosure.

According to an embodiment, wherein the manifold extends inside the sealed enclosure between the package and the top sheet, side sheet, and bottom sheet, and a vacuum is applied through the portion of the manifold extending along the side surface of the package(s).

According to an embodiment, the top sheet, the bottom sheet, the side sheet, or any combination thereof are adhered to or cling to the package with one or more brushes or a wiping device such that the ends of the sheet are secured to the package.

According to an embodiment, a system for creating a modified atmosphere in a sealed enclosure may include a top sheet applicator, a bottom sheet applicator, a wrapper, and a nozzle configured to create the modified atmosphere in the sealed enclosure.

According to an embodiment, the system may include a functional sheet applicator.

According to an embodiment, the wrapper is a ring wrapper.

According to an embodiment, the sealed enclosure surrounds one or more packages placed on a pallet.

According to an embodiment, the wrapper is a pallet wrapper.

According to an embodiment, a system for creating a modified atmosphere in a sealed enclosure may include an injection system having one or more nozzles, the injection system configured to enable and facilitate mixing of air, industrial gasses, and/or substances from multiple sources, wherein the one or more nozzles include one or more internal channels, the one or more internal channels configured to channel the air, industrial gasses, and/or substances from multiple sources to a point near a tip of the nozzle to improve distribution or a desired pattern of distribution, wherein the one or more nozzles are configured for improved blending and distribution, and wherein the one or more nozzles include a pressure pump, mixing chamber, high pressure air, industrial gas or volatized liquid, a high pressure surge chamber, a turbo boost, a turbo charger, or any combination thereof.

According to an embodiment, the one or more nozzles are configured for injection of gaseous state, fine, or superfine materials and substances.

According to an embodiment, the injection system is programmed and controlled to inject one or more combinations of micro particles, powders, nano-particles, or fluidized substances under air or industrial gas pressure.

According to an embodiment, the injection system is programmed and controlled to deliver substances in the form of a vapor, mist, or gaseous (invisible or cloud like) state via the system and nozzle(s) into the sealed enclosure.

According to an embodiment, the system may include a device configured to convert or accelerate or blend a liquid or solid substance into a gaseous state, wherein the device is one or more of a nebulizer, ultrasonic device, a vaporizer and/or other such devices.

According to an embodiment, the sealed enclosure surrounds one or more packages placed on a pallet.

According to an embodiment, a system of preserving, protecting, and enhancing a perishable product with multiple sequential and/or simultaneous process steps may include a wrapping system for creating a wrapped and sealed enclosure around a package on a pallet, using environmentally friendly, specified functional wrapping material, a modified environment system for creating specified modified atmospheric gas levels, along with specified treatments and substances for sanitizing/reducing a level of undesirable microbes in a head space and on surfaces of the product and/or package and adding prescribed substance treatments to create desired outcomes/effects to the package.

According to an embodiment, the package comprises one or more perishable products or one or more packages of perishable products.

According to an embodiment, the modified environment system further includes regulation of the sealed enclosure, product surface (pH), product aroma, or other value-added treatments to enhance quality, lower cost, improve safety, reduce waste, increase efficiency via a prescribed combination of processes, methods, and apparatus.

According to an embodiment, the system may include one or more sensors, cameras, scanners, or devices configured to determine a product or a package type, a product or package quantity, the dimensions or volume of a product or the package enclosed (or to be enclosed), or any combination thereof.

According to an embodiment, the system may include one or more sensors, scanners, or devices are configured to collect and record data, the data configured to be employed by a system, a program, and a controller to create a prescribed wrapped and sealed enclosure around the package on the pallet, a specified functional wrapping material, a prescribed modified environment with specified modified atmospheric gas levels, specified treatments and substances for sanitizing or reducing a level of undesirable microbes in a head space and on surfaces of the perishable product, adding prescribed substance treatments, or any combination thereof.

According to an embodiment, the data is configured to be used immediately, or in the future, and may employ machine learning and AI, to create desired outcomes/effects to preserve, protect and/or enhance the perishable product.

The foregoing and other features and advantages will be apparent from the following, more particular, description of various exemplary embodiments, as illustrated in the accompanying drawings, wherein like reference numbers generally indicate identical, functionally similar, and/or structurally similar elements.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments of the invention are discussed in detail below. While specific embodiments are discussed, this is done for illustration purposes only. A person skilled in the relevant art will recognize that other components and configurations may be used without departing from the spirit and scope of the invention.

In accordance with the principles of the disclosure, a method, system, and apparatus for wrapping and sealing a pallet of stacked goods to create a sealed enclosure around the stacked goods on the pallet is described. The sealed enclosure may be provided around the stacked goods themselves, without the pallet or around the stacked goods in combination with the pallet. A method, system, and apparatus for improved vacuuming, injection of treatments, for sealing, and gassing to create and maintain a modified atmosphere within the sealed enclosure of the pallet of stacked goods is described. A pallet of stacked goods is wrapped with a wrap sheet. A sealed enclosure is created by the wrap sheet or side sheet between an interior of the wrap sheet and an exterior or perimeter of the stacked goods. Within the sealed enclosure, a passive or active modified environment may be provided. A passive modified atmosphere may form as a result of the respiration of the perishable product which causes consumption of oxygen and production of carbon dioxide. The preferred active modified environment may be provided by removing or vacuuming the air from the sealed enclosure or by injecting a gas and/or treatment into the sealed enclosure.

Figure 1:
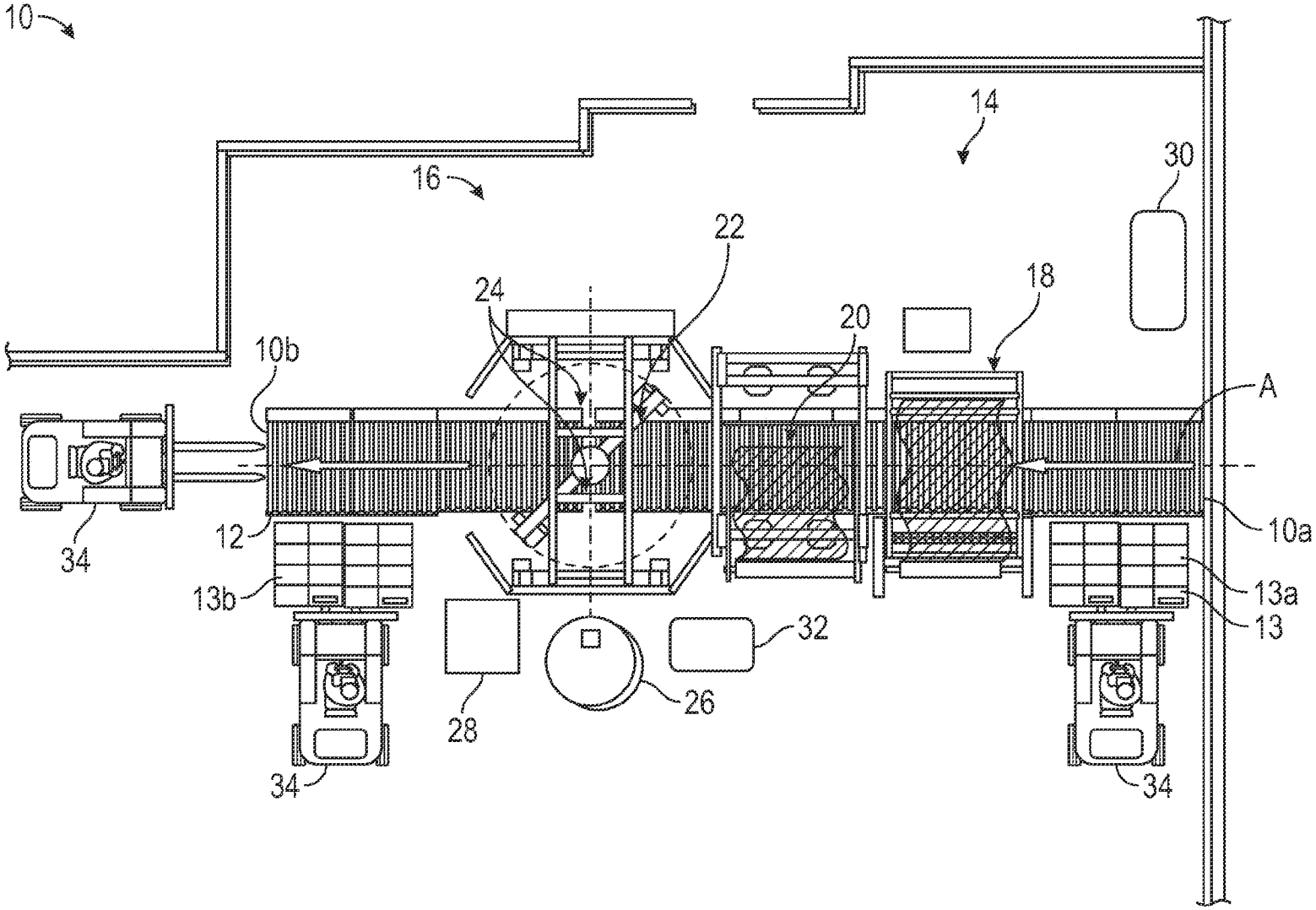
FIG. 1 is a schematic view of a system layout, according to an embodiment.

Referring to FIG. 1, a system 10 is illustrated. The system 10 may be for wrapping and sealing goods and for providing a modified atmosphere to the wrapped goods. In an exemplary embodiment, the system 10 may be only for wrapping and sealing the goods or only for providing a modified atmosphere or treatment to the goods. Although shown in combination, the subsystems may be separate and/or may or may not be used together. Although the goods described herein are described as a "pallet of stacked goods" or "package," any type of goods are contemplated. For example, the goods may be containers of goods stacked on a pallet, perishable goods on a pallet, a bin, a master container for holding perishable goods or other products, stacked boxes of product on a pallet, a single package or product on a pallet, stacked product on a pallet, or any other container configured to hold a product. The goods or products may or may not be provided on a pallet. The goods may be provided on a slip-sheet. A slip-sheet may be a cardboard or other protective material on which the goods or boxes of goods are stacked. The slip-sheet may be provided in lieu of a pallet. In an embodiment, the bottom sheet described herein may replace the slip-sheet and/or the pallet. That is, the goods may rest on the bottom sheet. The goods or products may be perishable or non-perishable. The goods or products may be wrapped as described herein to provide a sealed enclosure around the goods or products. The sealed enclosure may be provided around the goods, but not around the pallet or platform on which the goods rest. Accordingly, where features are referred to with the term "pallet," it may be understood the feature is compatible with other goods as well. For example, the term "pallet wrapper," may be understood to be operable to any goods, whether or not on a pallet, e.g., may wrap a bin or a stack of goods, or other container.

With continued reference to FIG. 1, the system 10 may include a conveyor 12. The conveyor 12 may be one or more conveyor belts, one or more roller conveyors, one or more gravity rollers, or combinations thereof, or other conveyor or shuttle systems for moving goods from one location to another location. The conveyor 12 may be a single conveyor or multiple conveyors located adjacently and/or coupled together. The conveyor 12 may move a pallet of stacked goods 13 from a first end 10*a* of the system 10 in a direction of arrow A to a second end 10*b* of the system 10. Although the system is shown arranged with flow from the right to the left, the components may be rearranged such that the flow is from left to right. The arrangement or layout of the system may be dependent on the room in which the system is constructed. The layout of FIG. 1 may be the layout of an automated system.

The system 10 may include a wrapping and sealing system 14 and a modified environment system 16. The wrapping and sealing system 14 may include a top sheet dispenser 18, a bottom sheet dispenser 20, and a pallet wrapper 22. The modified environment system 16 may include a gas injection system 24, a gas/substance treatment and sanitizer source 26, a MAP and sanitizer and treatment controller 28, and an air compressor 30. The wrapping and sealing system 14 and the modified environment system 16 may be one system or multiple systems functionally coupled together. The system 10 may include system controls 32 to control the wrapping and sealing system 14, the modified environment system 16, and/or both the wrapping and sealing system 14 and the modified environment system 16.

The system 10 may include a driven or autonomous vehicle, such as a forklift 34, for moving one or more pallets 13 to the first end 10*a* of the system 10. The pallet 13*a* at the first end 10*a* may be placed on the conveyor 12 and moved in the direction of arrow A through the wrapping and sealing system 14 and the modified environment system 16 to the second end 10*b* where the pallet 13*b* may be retrieved by a vehicle, such as forklift 34.

Figure 2:
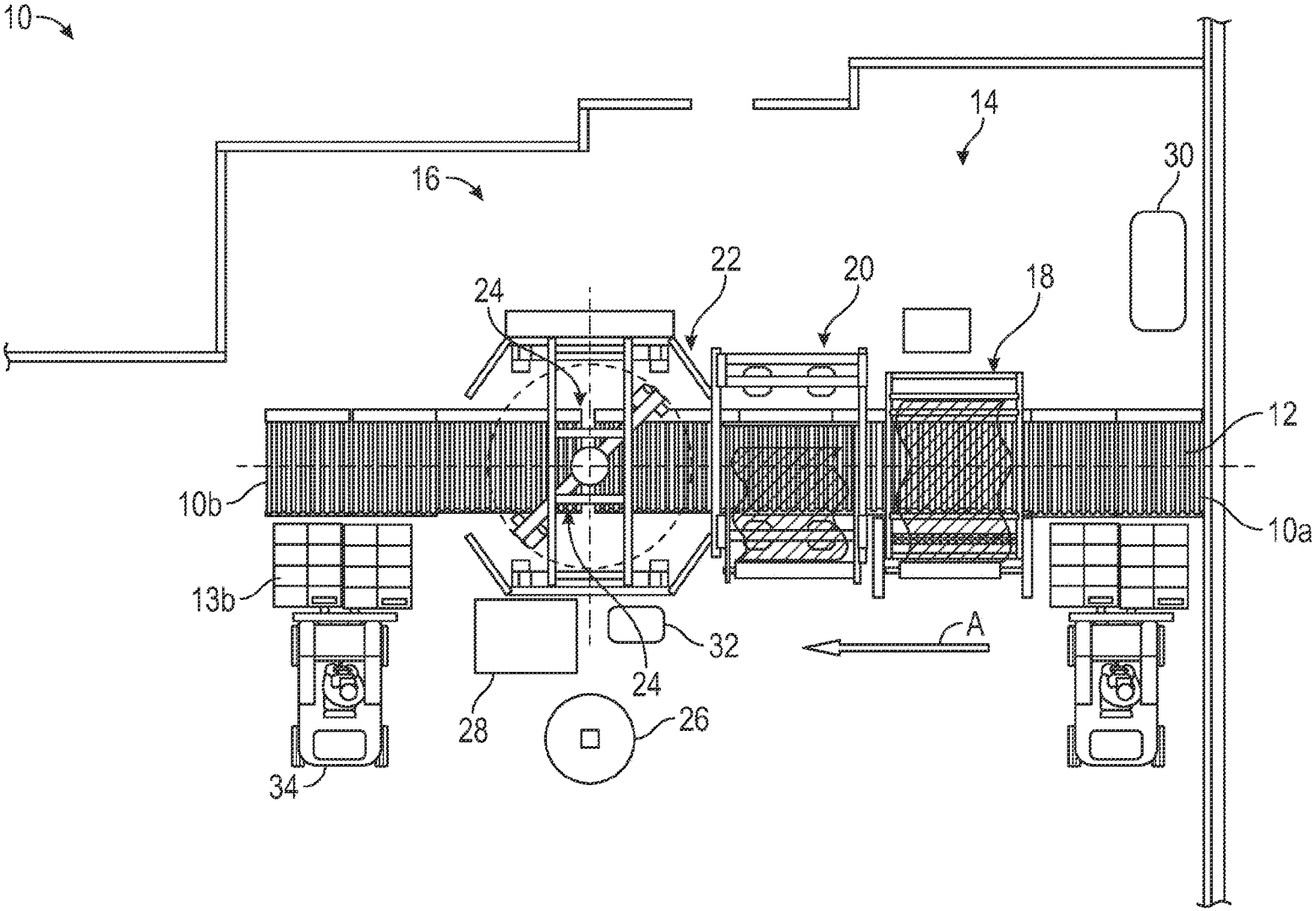
FIG. 2 is a schematic view of a system layout, according to an embodiment.
Figure 3:
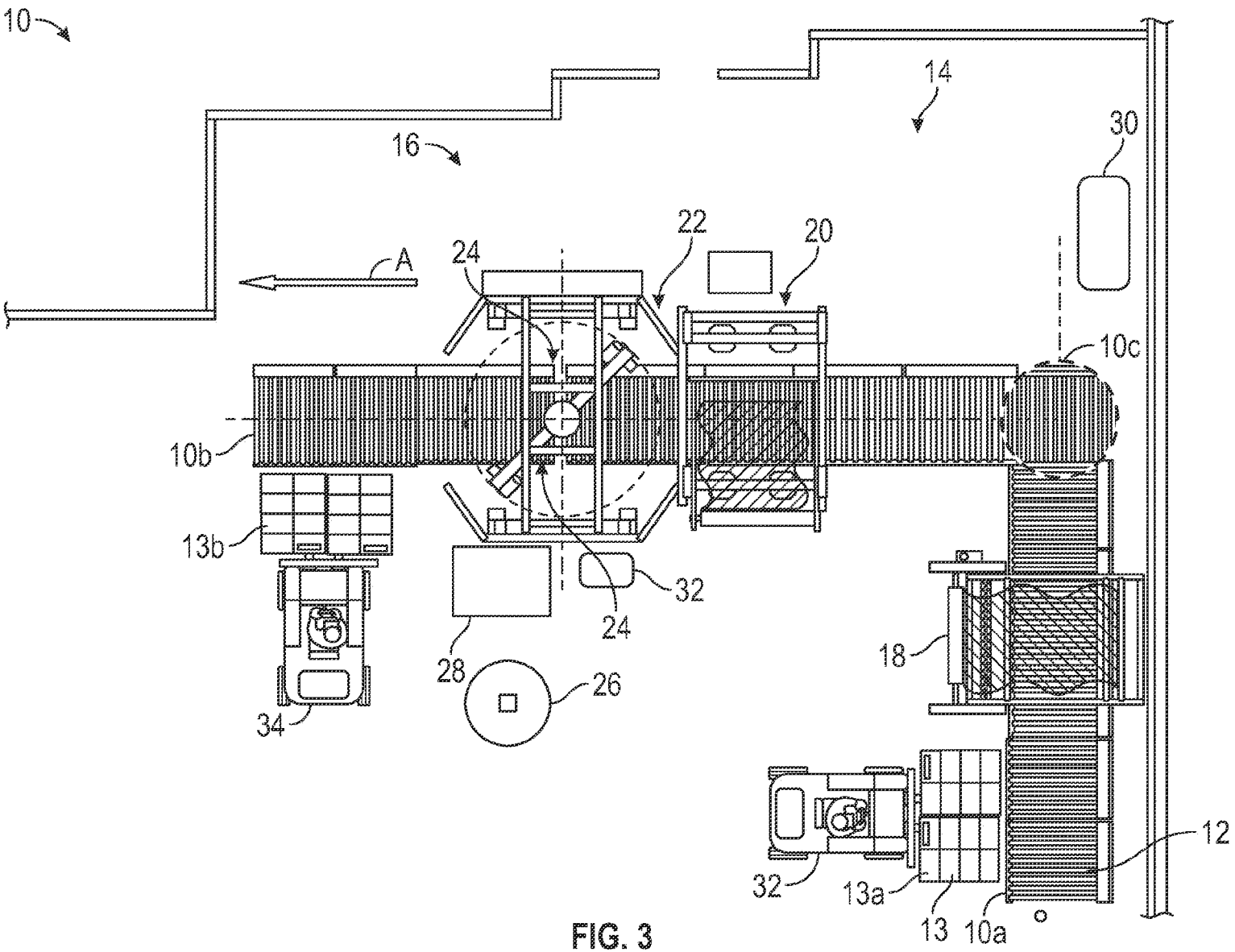
FIG. 3 is a schematic view of a system layout, according to an embodiment.

Referring to FIGS. 2 and 3, other exemplary layouts of the system 10 are illustrated. As illustrated in FIGS. 1 and 2, the system 10 may be a linear system that moves in a single, lateral direction. As illustrated in FIG. 3, the system 10 may include turns or changes in direction. That is, the pallet 13 may move from the first end 10*a* to a turn or an intermediate location 10*c*. At the intermediate location 10*c*, the pallet 13 may turn (e.g., may turn 90 degrees) and continue moving toward second end 10*b*. Although a single turn is depicted in a 90-degree fashion, more turns may be provided in any number of directions, not limited to a 90 degree turn. The system 10 may be arranged in any manner within a warehouse to allow for the pallet 13 to traverse the conveyor 12 from a first end 10*a* to a second end 10*b* in a manner that allows for the pallet 13 to be wrapped, injected with a modified environment, or both. Although the embodiments of FIGS. 1-3 are depicted stationary in a warehouse, the system of the present disclosure may be mobile. That is, one or more of the top sheet dispensers, bottom sheet dispenser, pallet wrapper, modified environment system, or combinations thereof may be portable, such as, for example, by being provided on a trailer bed or other mobile chassis. The system may be modular and may include one or more modular components that may be easily disconnected, moved, and reconnected. The system may be both modular and mobile.

Although the top sheet dispenser 18 is illustrated as preceding the bottom sheet dispenser 20, the arrangement may be reversed such that the bottom sheet dispenser precedes the top sheet dispenser, in an example, the top sheet dispenser 18 and the bottom sheet dispenser 20 may be arranged such that the top sheet and bottom sheet are dispensed simultaneously. In an example, the top sheet dispenser 18 and the bottom sheet dispenser 20 may be a single component such that the top sheet and bottom sheet are dispensed simultaneously.

The top sheet dispenser 18 may dispense a top sheet that may be a flat piece of material that completely covers the top of the stacked goods on the pallet, and the ends of top sheet may overhang the sides of the stacked goods. The bottom sheet dispenser 20 may dispense a bottom sheet that may be a flat piece of material that completely covers the bottom of stacked goods and/or pallet and the ends of bottom sheet may slightly cover the sides of the stacked goods. The shape of top sheet and bottom sheet is not limited. Top sheet and bottom sheet may be shaped to create a top and bottom cap and/or folded to contour the shape of stacked goods to minimize gaps. Top sheet and bottom sheet may be taped or adhered to stacked goods. Alternatively, top sheet and bottom sheet may be self-adhered to the stacked goods and/or adhered to the pallet wrap.

The system 10 may include loading conveyors with backstop guide, pallet loading alignment, and forklift floor stops. A windshield blocker may be provided to prevent air draft from cooling tunnels lifting the top sheet during dispensing of the top sheet by the top sheet dispenser. The conveyors may include adjustable deflector guides to help straighten misaligned pallets during operation. The system may include turntable conveyors. The conveyors may include 90-degree transfer conveyors with pop-up table chain driven capabilities. The system may include electrical quick disconnects at main electrical panels and junction boxes to allow for easy deconstruction, moving, and installation of the system.

The top sheet dispenser 18 may include a tape roll dispenser to secure plastic sheets on top of a pallet load. The top sheet dispenser may include brushes and a wiper assembly (with or without rollers) and additional side brushes at the ends to wipe corners of the sheet. The top sheet dispenser may include safety sensors in the frame to reduce damage to pallet load and obstructions in the pathway during lowering sequences.

The bottom sheet dispenser 20 may include removable scissor lift conveyors assembly. The bottom sheet dispenser may include scissor lift pallet height options for CHEP or Wood pallets (manual and automated). The bottom sheet dispenser may include hydraulic operated squeeze plates for all sides. The bottom sheet dispenser may include interlocking squeeze plates. The bottom sheet dispenser may include plates with plunger trigger to sense load has been squeezed. The bottom sheet dispenser may include squeeze plates with rubber textured mats and spikes threaded into bottom of plates. The bottom sheet dispenser may include brushes and a wiper assembly mounted to side entrance & exit paddle squeeze plates. The bottom sheet dispenser may include squeeze paddles with adjustable plate angle. The bottom sheet dispenser may include accumulators (to keep squeeze plates pressurized when hydraulic pump is off). The bottom sheet dispenser may include air curtains with nozzles. The bottom sheet dispenser may include gripper safety laser sensors added to reduce damages to drop boxes & any other obstructions. The bottom sheet dispenser may include gripper chain adjuster assembly upgraded to make it easier to service.

The pallet wrapper 22 may include upper and upper side nozzles air curtains blows top sheet flaps down for inclusion during wrap cycle. The pallet wrapper may include lower nozzle(s) air curtains that blows the bottom sheet flaps up for inclusion during the wrap cycle. The pallet wrapper may include film tail air knife blows stretch wrap film tails towards pallet load when released from film clamps. The pallet wrapper may include film clamps assembly with 180 degree & 90-degree cylinders. The pallet wrapper may include an upper film clamp that has a manual air release valve with a knob to open the clamp during film replacement. The pallet wrapper may include heat cutters and brushes or wipers combined to one assembly. The pallet wrapper may include carriage heads improvements: safety door latches and switches, dancer bar torsion spring, & film holder. The pallet wrapper may include pre-stretch rollers: fabricated in different size diameter molds to re-cast rubber on pre-stretch rollers that may be tested to specifications, may use a durometer, casting methods, vulcanization, and textures for the rubber. The pallet wrapper may include pre-stretch rollers with replaceable shaft when a shaft wears or bends. The pallet wrapper may include a manifold with nozzles or snorkels for gas injection and vacuum with sensing lines. The pallet wrapper may include a commutator upgraded and with electrical quick disconnects. The pallet wrapper may include settings updated to analog voltage outputs for film force-to-load and wrapper up/down speed (initial system designs used potentiometers with adjustment knobs). The pallet wrapper may include electrostatic bars or film warming devices for enhancing the stretch film characteristics during the wrapper cycle. The pallet wrapper may include side pressure roller assembly to better seal film to bottom sheet as pallet load advances out of wrapper section.

The modified environment system 16 may include industrial gas (ex. $CO_2$ & $N_2$) regulators stands assembly for industrial gas (ex. $CO_2$) racks with cylinders & other industrial gas storage vessels or tanks (ex. $N_2$ Dewar). The modified environment system may include a bulk $CO_2$ tank installed at the machine sites or $CO_2$ racks with cylinders. The modified environment system may include industrial gas, treatment and substance modules or Consoles: a custom programmed auto machine gas, treatment, and substance controller. The modified environment system may include Single Hose Gas Consoles (SHGC): custom programmed manual gas, substance, & treatment setup. The modified environment system may include a rotary screw air compressor upgraded to keep up with system usage and quieter to be next to auto machine as compared to a reciprocating air compressor.

The system 10 may include a labeler to apply or wipe-on labels. The system may include continuous PLC & touch-screen programs updated improvements to logics, interface, safeties, alarms, indicators, & status. The system may include communication and access to Systems with Ethernet or Wi-Fi options. The system may be a modular system design for portability and quick setup/movement as well as upgrades of systems. The modular system may allow for re-arrangement of the components therein. The system may include pressure foam roller systems for enhanced sealing of pallet wrap enclosures (single roller or multi-roller turn table design and/or a dual or multi-roller pass through design). The system may include mechanical and robotic pressure pad(s) for improved gas & nozzle containment during injection of modified atmosphere gasses and functional treatments into the seal enclosures. The system may include color sensor, or other appropriate sensors, cameras, or devices for pallet height adjustment on the top or bottom sheet dispenser. The system may include the combination of, or separation of, various equipment components and devices to accommodate specific design requirements such as combining the top sheet dispenser and bottom sheet dispenser to reduce the space required within a cold room facility.

Figure 4:
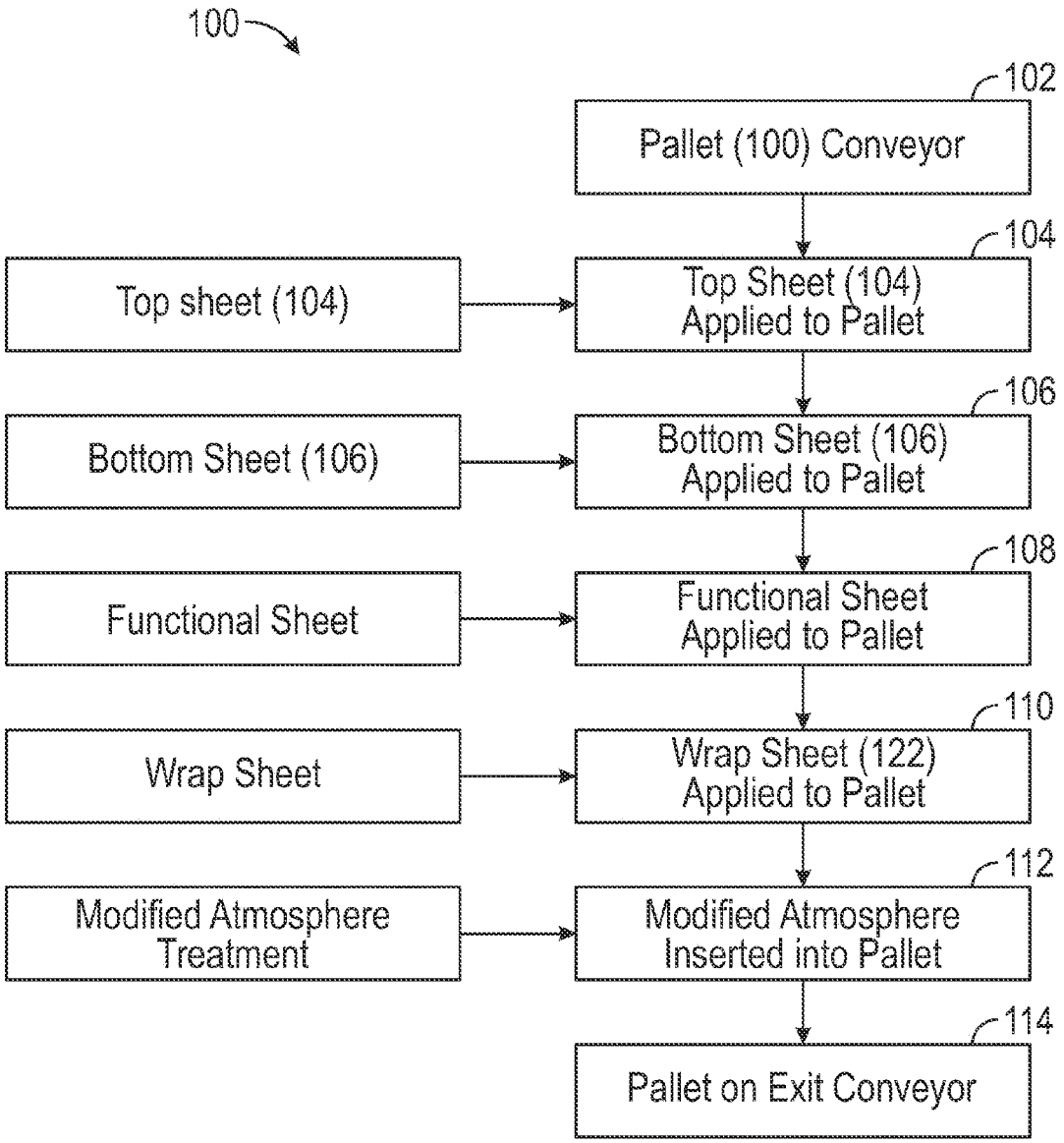
FIG. 4 is a method of creating a modified atmosphere, according to an embodiment.

FIG. 4 illustrates an exemplary method 100 for wrapping and sealing a pallet creating a sealed enclosure and creating a modified atmosphere within the sealed enclosure. The method 100 may be performed manual, semi-automatically, or automatically. FIG. 4 illustrates an embodiment related to the overall system to create a modified atmosphere in a sealed enclosure. This may include the combination of top sheet, bottom sheet, functional sheet, wrap sheet, and modified atmosphere treatment. The method 100 may employ a system 10. The system 10 may be in any of the aforementioned layouts. In the exemplary method 100, a pallet may be placed on a conveyor at step 102. At step 104, the conveyor may move the pallet to a top sheet dispenser and apply a top sheet to the pallet. At step 106, the conveyor may move the pallet from the top sheet dispenser to a bottom sheet dispenser and apply a bottom sheet to the pallet. At step 108, the conveyor may move the pallet from the bottom sheet dispenser to a functional sheet dispenser and apply a functional sheet. At step 110, the conveyor may move the pallet from the functional sheet dispenser to a pallet wrapper for applying a wrapper sheet to the pallet and wrapping the pallet. At step 112, the conveyor may move the pallet from the pallet wrapper to the modified atmosphere system for inserting a modified atmosphere into the now wrapped pallet. At step 114, the conveyor may move the pallet from the modified atmosphere system to an end of the conveyor where the pallet may be retrieved.

The functional sheet may be the top sheet, bottom sheet, wrap sheet, or any combination thereof treated with a functional substance or functional ingredient. The functional sheet may be an additional sheet placed within the sealed enclosure (e.g., captured within the enclosure), between packages stacked on the pallet, below packages stacked on the pallet, above packages stacked on the pallet, or any combination thereof, treated with a functional substance. One or more functional sheets may be provided. Where a plurality of functional sheets are provided, the functional sheets may be provided as any combination top sheet, bottom sheet, wrap sheet, or additional sheet, as described herein. An exemplary functional sheet may be a sheet treated with hydrated lime to absorb carbon dioxide. An exemplary functional sheet may be a sheet treated with potassium manganate to absorb ethylene. Any of the functional substances described herein may be applied to a sheet to result in a functional sheet.

Figure 5A:
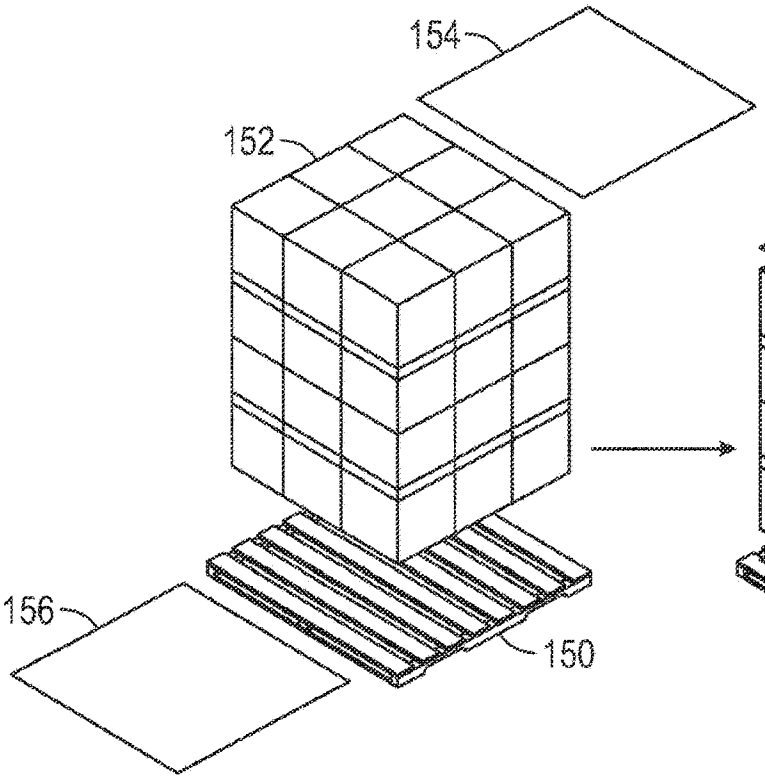
FIGS. 5A-5C are schematic views of a system for wrapping a pallet and creating a modified atmosphere, according to an embodiment.
Figure 5B:
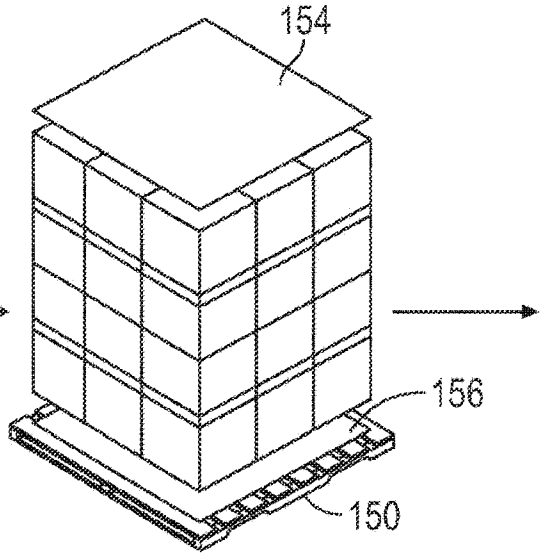
Figure 5C:
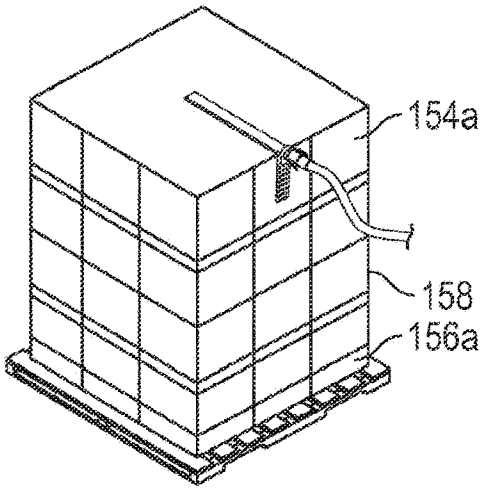

FIGS. 5A-5C illustrate an exemplary pallet 150 for use in the method 100 and/or system 10. The pallet 150 may be the same or similar as the pallet 13 or any of the pallets described herein. The pallet 150 may include stacked products 152. In FIG. 5A, a top sheet 154 may be provided over or on top of the pallet 150 and stacked products 152. The top sheet 154 may be provided by a top sheet dispenser, such as described herein. A bottom sheet 156 may be provided under or beneath the pallet 150 and/or under the stacked products 152. The bottom sheet 156 may be provided by a bottom sheet dispenser, such as described herein. The top sheet 154 and/or the bottom sheet 156 may be provided in a manual, hand manner, a semi-automatic manner, or a fully automatic manner, as is described herein. The automated or semi-automatic manner may include a lift of the stacked goods off the base/pallet or a hold of the goods and lowering of the base/pallet to separate, pull and cut method. The fully automatic manner may include a top and bottom sheet dispenser or a robotically placed top and bottom cap method.

In FIG. 5C, once the top sheet 154 and/or bottom sheet 156 are placed on the pallet 150 and/or stacked products 152, the sheets may be folded to provide a top cap 154*a* and bottom cap 156*a* or a fitted top and bottom cap may be added, respectively. In FIG. 5C, a wrap sheet 158 may encircle the stacked products 152 to provide a sealed and wrapped pallet 150. Once wrapped and sealed, or during the final stages of the wrapping and sealing steps, a modified environment may be provided to the sealed enclosure within the wrapped pallet 150. The modified environment may be provided with manual gas injection via one or more nozzles and hoses. A nozzle may sit or rest on top of the stacked goods, captured between the top sheet and the wrap sheet. In an embodiment, a partial opening may be provided in the scaled enclosure at the conclusion of wrapping to enable an initial normal atmosphere gas to vent or escape in a controlled manner. In an embodiment, a nozzle vent or other means to allow nozzle venting may be provided in the sealed enclosure at the conclusion of wrapping to enable an initial normal atmosphere gas to vent or escape or a vacuum may be used to accelerate the process in a controlled manner. This may facilitate forming of the modified environment within the sealed enclosure in an efficient and effective manner.

FIGS. 6A-6E illustrate an exemplary combined manual and semi-automatic process for wrapping, sealing, and providing a modified environment to a pallet 200 of stacked product. The pallet 200 may be the same or similar as the pallet 150, pallet 13, or any of the pallets described herein. First, in FIG. 6A, the pallet 200 may be manually provided with a top sheet 202 and a bottom sheet 204. Operators 206 may manually, by hand, place the top sheet 202 on top of the stacked product 208 on the pallet 200. After placing the top sheet 202, the operators 206 may locate an injection nozzle 210 on top of the top sheet 202. That is, the injection nozzle 210 may be resting on the top sheet 202. The injection nozzle 210 may be used to provide a modified atmosphere to an enclosed and sealed area provided between the wrapped sheets and the stacked product 208. The operators 206 may manually, by hand, place the bottom sheet 204 underneath the stacked product 208. The bottom sheet 204 may be placed between the pallet 200 and the stacked product 208. The operators 206 may have raised work platforms 212 to facilitate placement of the top sheet 202 and injection nozzle 210 on the stacked product 208.

Figures 6A, 6B, 6C, 6D, 6E:
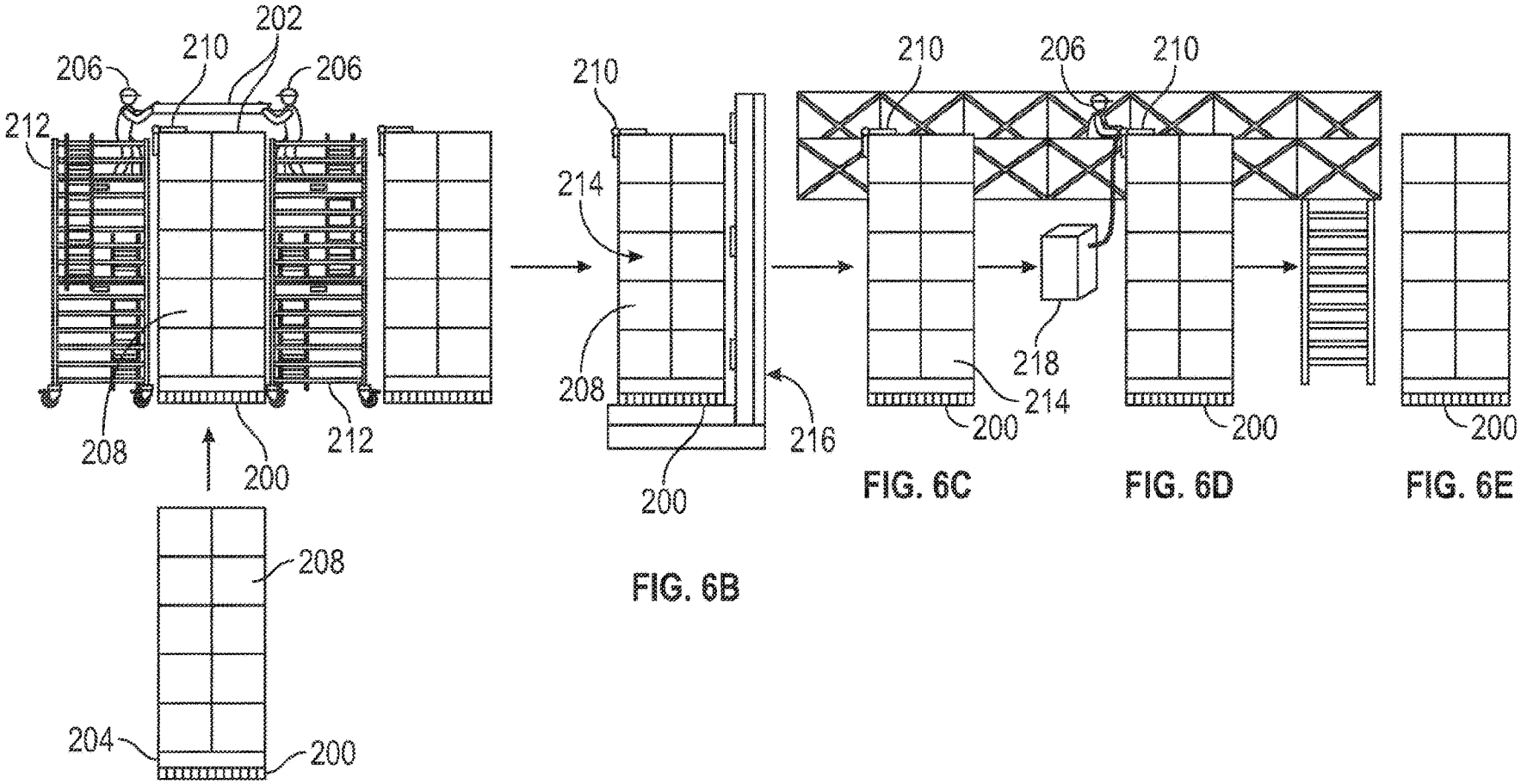
FIGS. 6A-6E are schematic views of a manual and semi-automated system for wrapping a pallet and creating a modified atmosphere, according to an embodiment.

In FIG. 6B, the pallet 200 may be provided with a wrapping sheet 214 to enclosure the stacked product 208 around a perimeter thereof. The wrapping sheet 214 may wrap the stacked product 208 and pallet 200 and enclose the stacked product 208. A dispensing device 216 may provide the wrapping sheet 214. The dispensing device 216 may be a single dispensing device or multiple dispensing devices.

Referring to FIG. 6C, the injection nozzle 210 may be enclosed within the wrapping sheet 214 on the pallet 200. In FIG. 6D, the stacked product 208 is treated with the modified environment (e.g., through injection with nozzle 210 of a gas from a gas injection control and source 218) as is described in more detail to follow. The treatment may be provided by an operator 206. After treatment, the pallet 200 may be ready for storage and/or shipment, as shown in FIG. 6E.

In the process of FIGS. 6A-6E, a top sheet may be pulled out over the top of the stacked goods and subsequently cut or separated at the pre-scored line as a tear-sheet. One or more brushes or wiping devices may be used to brush down the lateral sides of the top sheet to adhere the top sheet to the package or stacked goods. In an embodiment, two or more lateral sides of the top sheet may be applied with adhesive or tape such that when brushed down, the sides secure to the package or stacked goods. In an embodiment, all four lateral sides of the top sheet are applied with adhesive or tape. In an embodiment a pre-made fitted top cap is placed on the top of the stacked goods and encircled with and/or adhered to the side sheet.

Figures 7A, 7B, 7C, 7D, 7E:
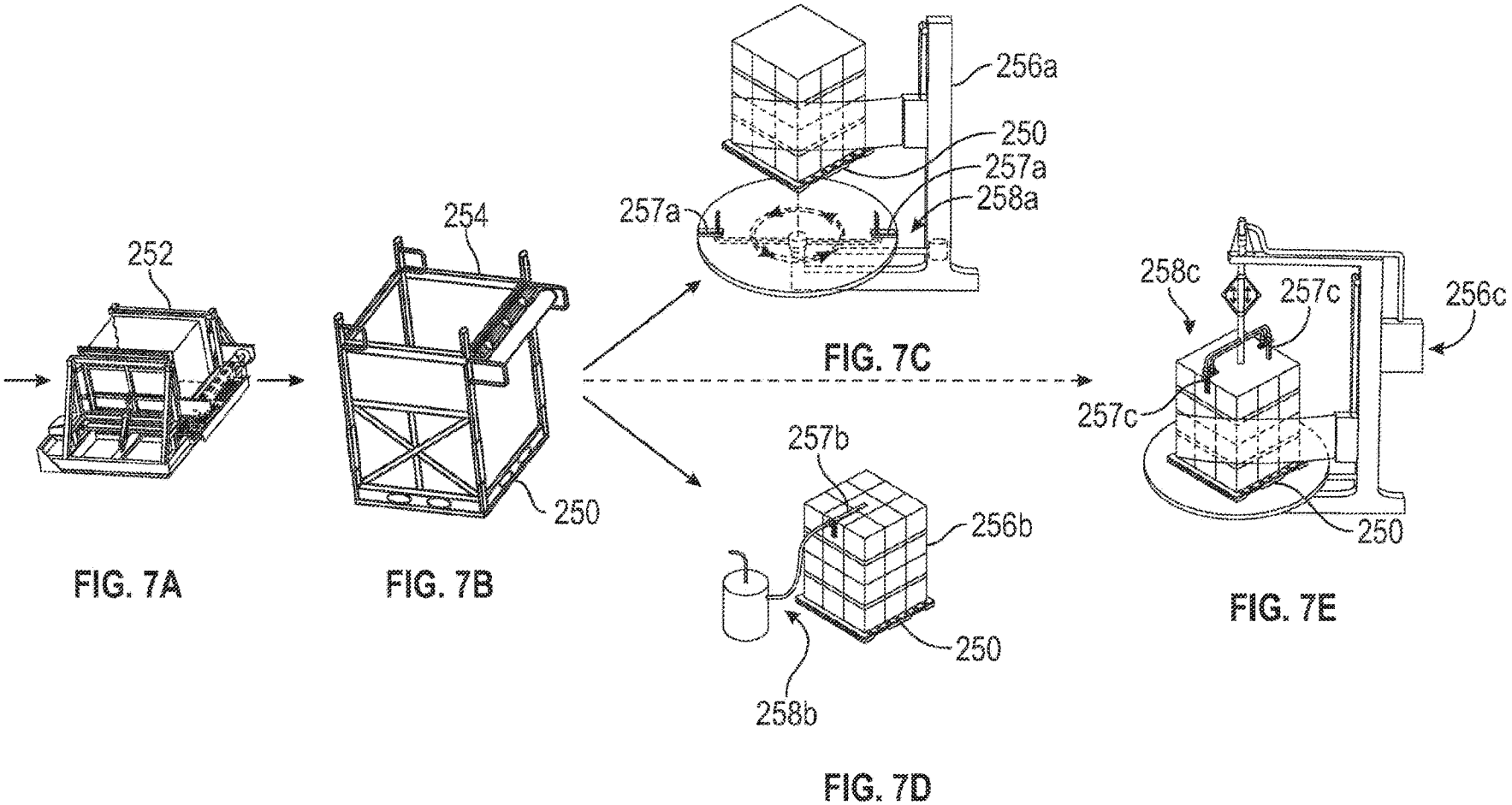
FIGS. 7A-7E are schematic views showing the system using semi-automated and manual methods for applying a top, a bottom and side sheets for wrapping a pallet creating a sealed enclosure and showing an apparatus for injecting a modified atmosphere into the sealed enclosure, according to an embodiment.

FIGS. 7A-7E illustrate an exemplary combined manual and semi-automatic process for wrapping, sealing, and providing a modified environment to a pallet 250 of stacked product. The pallet 250 may be the same or similar as the pallet 200, pallet 150, pallet 13, or any of the pallets described herein. First, in FIG. 7A, the pallet 250 may proceed through a bottom sheet dispenser 252 and in FIG. 7B may then proceed through a top sheet dispenser 254. In an exemplary embodiment, the pallet 250 may proceed first through the top sheet dispenser 254 and then through the bottom sheet dispenser 252 or may proceed simultaneously through a top and bottom sheet dispenser (not illustrated) or a manual or automated/robotic top and bottom cap dispenser (not illustrated). Once a top sheet and bottom sheet have been placed on the pallet 250, the pallet 250 may proceed to a pallet wrapper and modified environment system such as shown in FIGS. 7C, 7D, and 7E. In the FIG. 7C, the pallet wrapper 256*a* may be a turn table wrapper and may have auto gassing nozzles 257*a* of a modified environment system 258*a* below the pallet 250. In FIG. 7D, the pallet wrapper 256*b* may be manual pallet wrapping (such as described with respect to FIGS. 5A-5C) and may have a manual lay flat nozzle 257*b* and quick fill connection of a modified environment system 258*b*. In FIG. 7E, the pallet wrapper 256*c* may be a turn table wrapper and may have auto gassing nozzles 257*c* of a modified environment system 258*c* above the pallet 250. Any combination of the pallet wrappers and/or modified environment systems of FIGS. 7C, 7D, and 7E may be provided.

Thus, the exemplary processes of FIGS. 6 and 7 are semi-automatic. That is, for example, in the exemplary process of FIGS. 6A-6E, an operator may place the top and bottom sheet on the pallet and in FIGS. 7A-7E, a mechanical dispenser may place the top and bottom sheets on the pallet. In FIG. 6D and FIG. 7D, an operator may inject the modified environment into the enclosed pallet. In FIGS. 7C and 7E, the nozzle may be automatically placed, and the gas automatically injected. In an exemplary combined manual and semi-automatic process, the manual and automatic steps in the process may be selected from either the method of FIGS. 6A-6E, the method of FIGS. 7A-7E, or any combination of steps disclosed on the examples.

Figure 8:
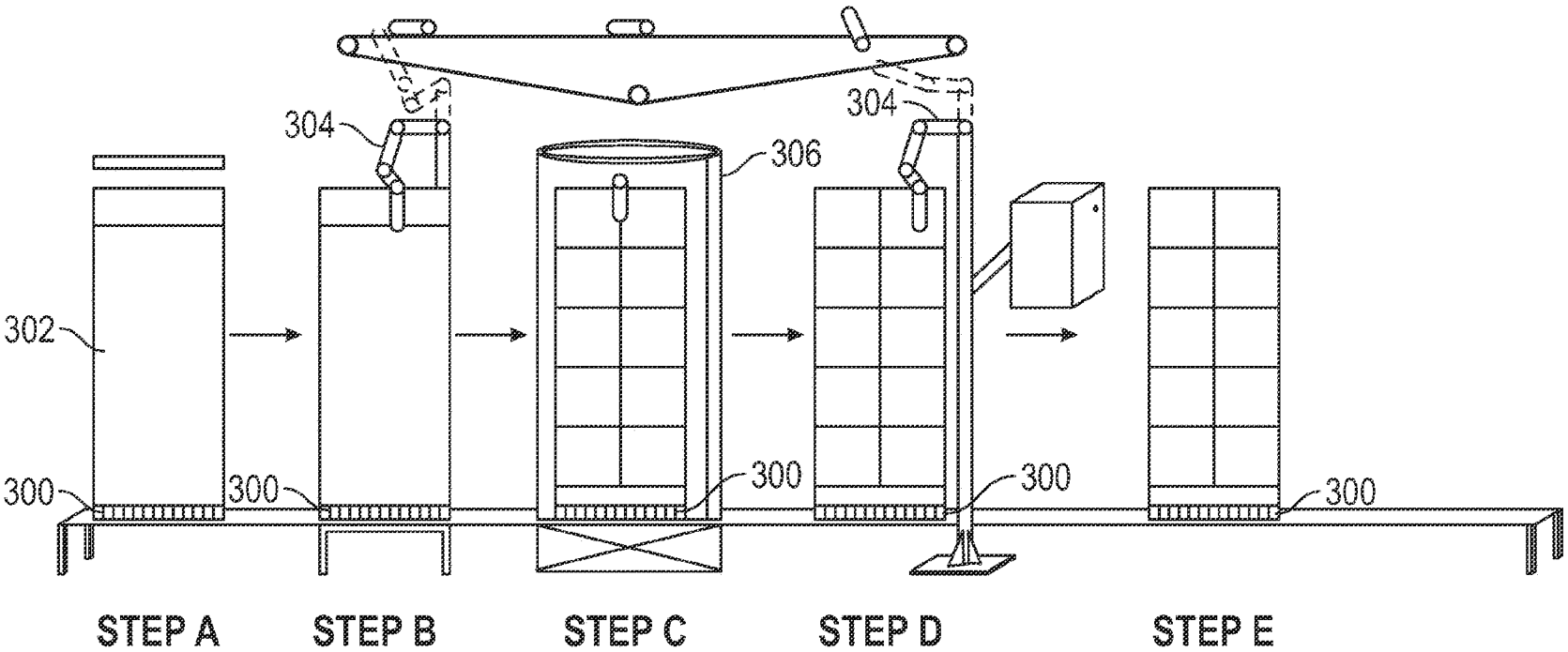
FIG. 8 is a schematic view of steps of an automated systems for wrapping a pallet and creating a modified atmosphere, according to an embodiment.

Referring to FIG. 8, a process of high speed, automated, operation for wrapping a pallet and injecting a treatment is shown. In a first step, Step A, a top sheet may be placed on a pallet 300 with stacked goods 302. The top sheet may be placed automatically with a top sheet dispenser. In Step B, a bottom sheet may be placed on the pallet 300. The bottom sheet may be placed automatically with a bottom sheet dispenser. Still in Step B, a robotic injection nozzle 304 may be placed on the stacked goods 302 on the pallet 300. Alternatively, the nozzle may be placed on the stacked goods 302 in another automated manner. In Step C, the wrap sheet 306 is added with a ring wrapper to the stacked goods 302 such that the stacked goods 302, top sheet, bottom sheet, and nozzle are enclosed within the wrap sheet. The nozzle 304 may be enclosed between the top sheet and the wrap sheet. The nozzle may inject the modified environment into the sealed enclosure between the wrap sheet, top sheet and bottom sheet and the stacked goods. In Step D, the nozzle may be removed from the sealed enclosure and recycled to be used for another pallet of stacked goods. Although depicted on the top, the nozzle may be provided on both the top and bottom or on the bottom. Although depicted in FIG. 8, Steps B, C and D with the nozzles put in place, enclosed, used for injection, removed and recycled, the robotic control of placement, enclosure, injection and removal of the nozzle portion of the manifold from above the ring wrapper (not illustrated) may be used without disconnecting or recycling the nozzles. The finished sealed and treated pallet may be produced in Step E and ready for shipment and/or storage.

Figure 9:
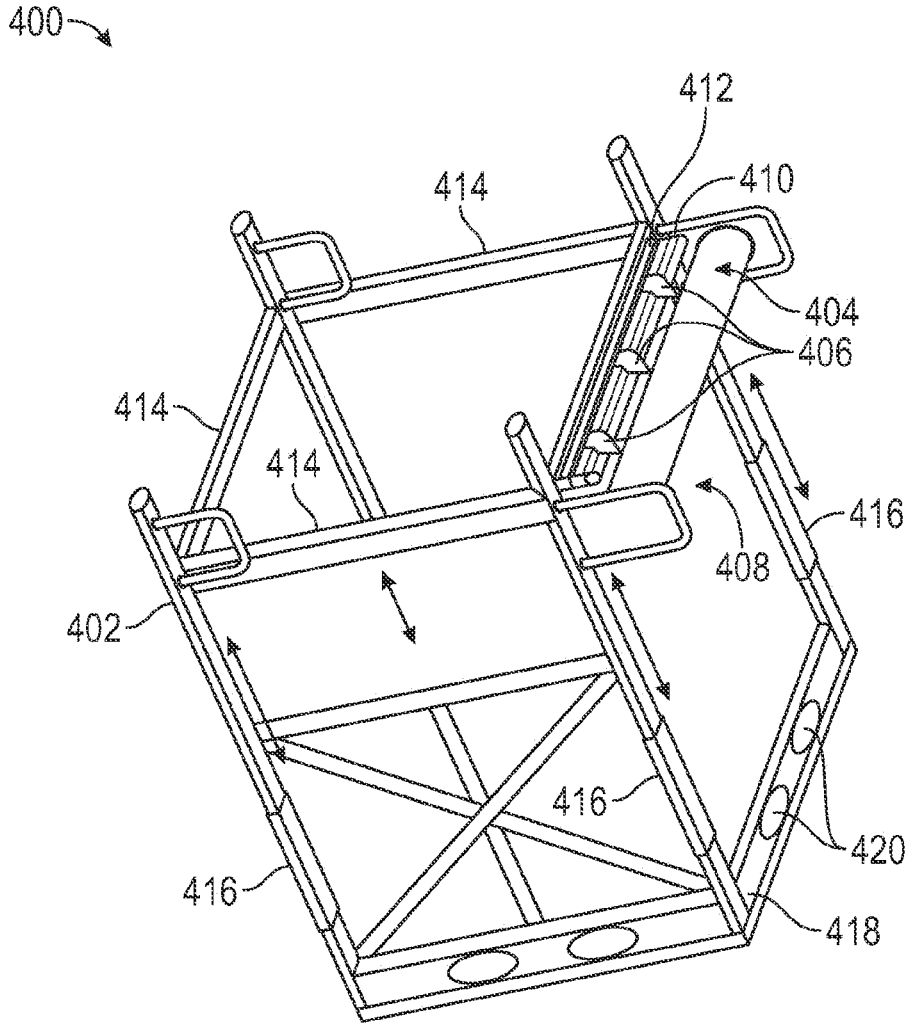
FIG. 9 is a perspective view of a semi-automated portable top sheet dispenser, according to an embodiment.

Referring to FIG. 9, a manual and semi-automatic top sheet dispenser 400 is shown. In FIG. 9, the pallet may be picked up with a forklift or other vehicle and moved throughout the process (e.g., moved between the top sheet dispenser, bottom sheet dispenser, and wrap dispenser). The top sheet dispenser 400 may be provided in any of the aforementioned systems for wrapping a pallet of stacked goods. The top sheet dispenser 400 may include a frame 402. The frame 402 may include a top sheet roll 404, film grippers 406, a pull bar 408, a film cutter 410, and a cross bar 412. The grippers 406 and cutter 410 may be automated. The frame 402 may include a film sheet pull and retract drive 414. The frame 402 may include one or more counterweights 416. The top sheet roll 404 may be provided with a sheet of wrapping material to provide the top sheet on the pallet 418 of stacked goods. The pallet 418 may include forklift pickup slots 420 to facilitate moving of the pallet 418 of stacked goods. In use, the frame 402 may be placed over the stacked goods and the pallet 418. The frame 402 may have an adjustable height to match the height of the stacked goods on the pallet 418. The film sheet pull and retract drive 414 may pull a sheet from the top sheet roll 404 over the top of the stacked goods on the pallet.

Figure 10A:
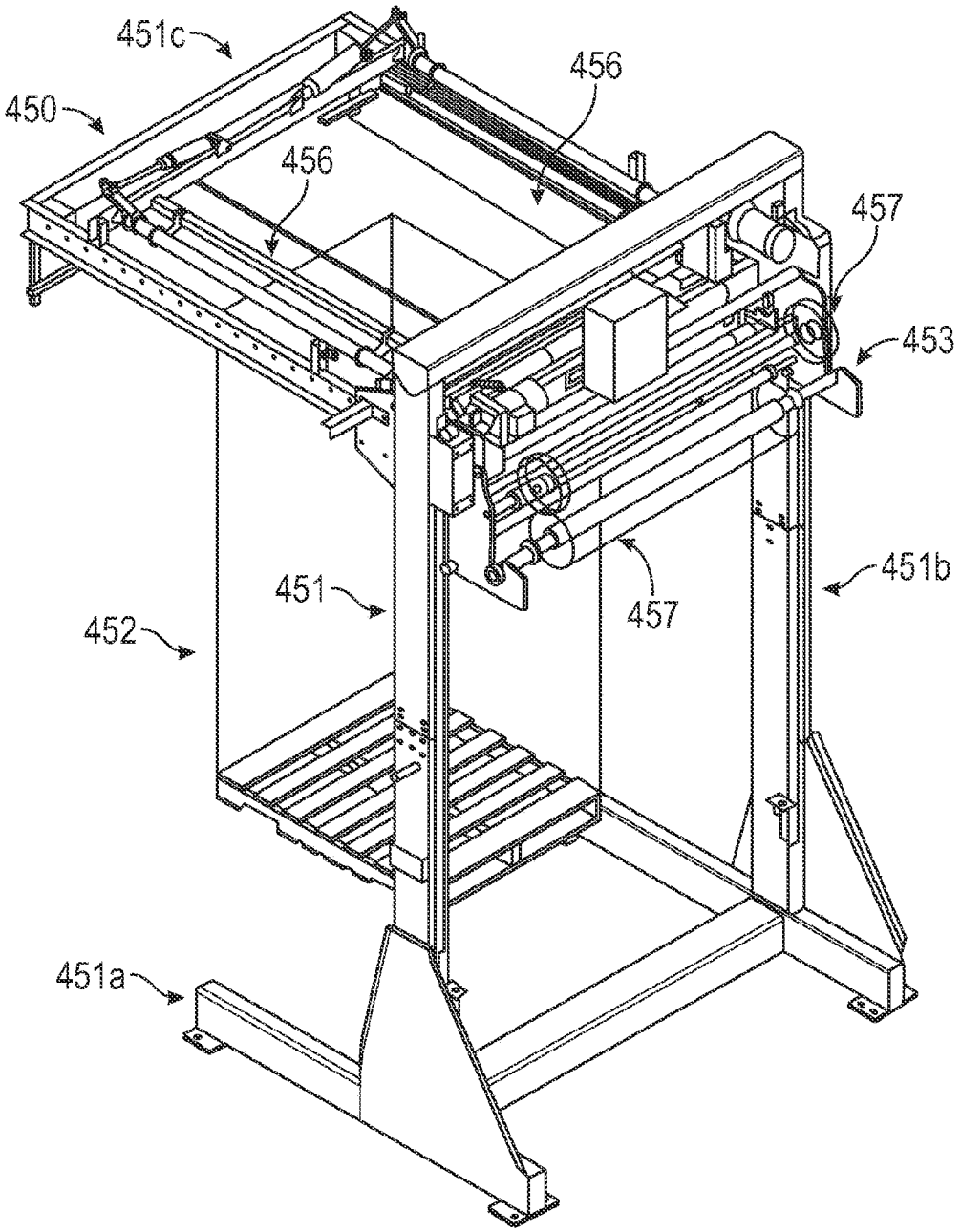
FIGS. 10A-10C are perspective views of an automated top sheet dispenser, according to an embodiment.
Figure 10B:
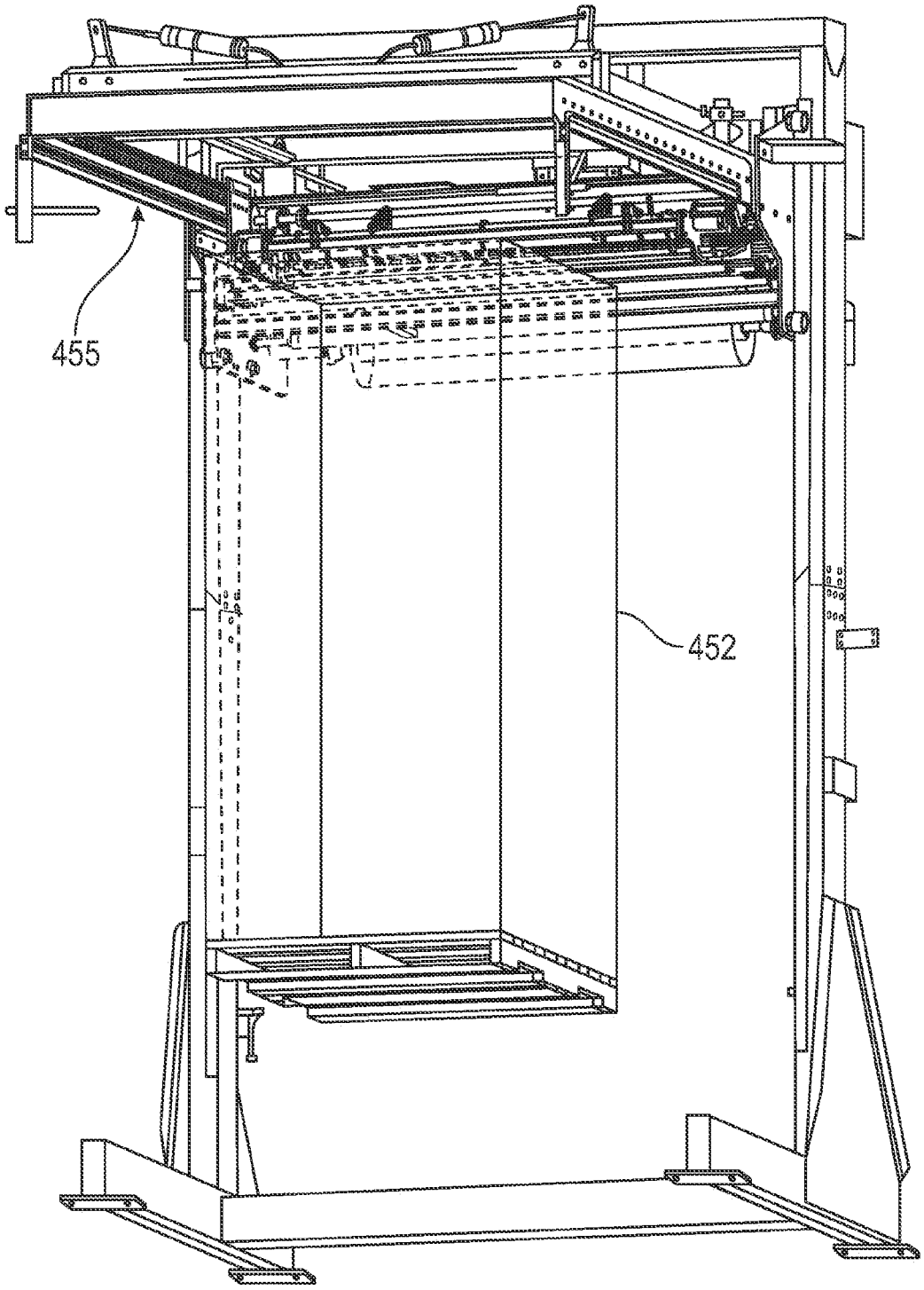
Figure 10C:
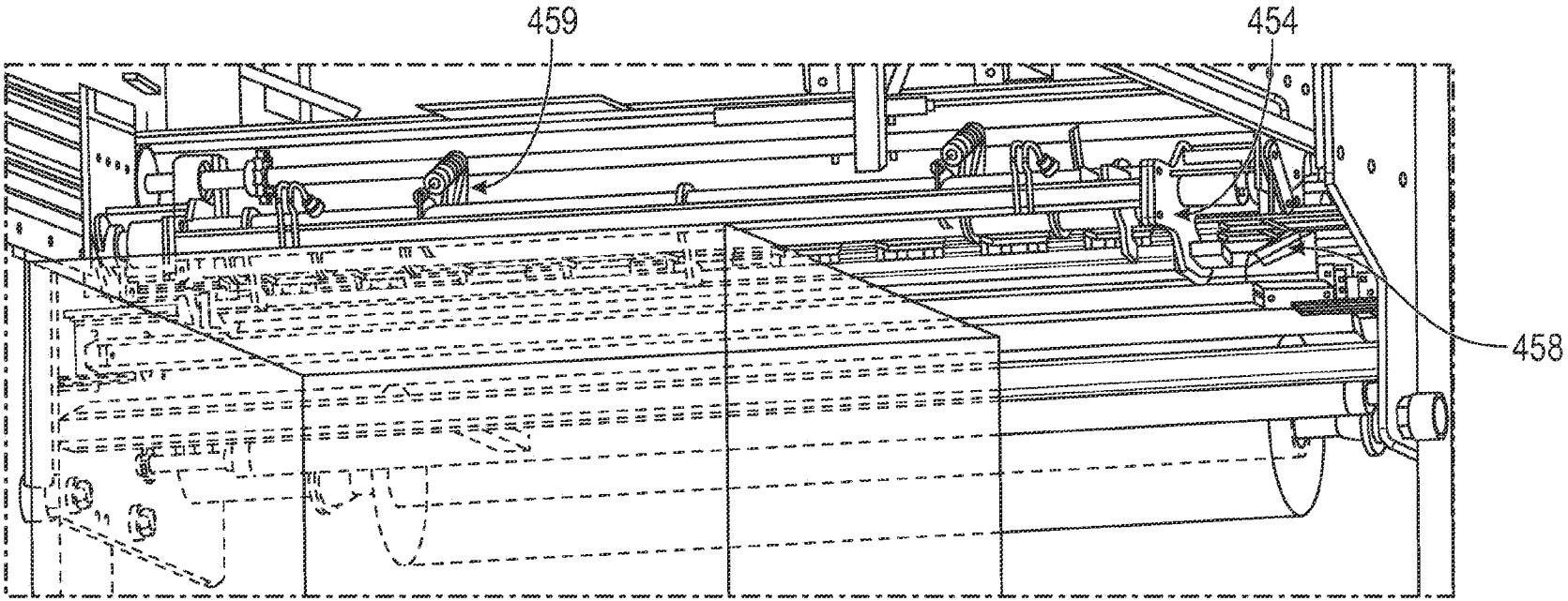

Referring to FIGS. 10A-C, an automated top sheet dispenser 450 is shown. The top sheet dispenser 450 may comprise a frame 451. The frame 451 may include a base 451*a*, a vertical or upstanding portion 451*b*, and a top or lateral portion 451*c*. The top sheet dispenser 450 may include one or more sensors to detect a position of the pallet of stacked goods (e.g., pallet of stacked goods 452). The top sheet dispenser 450 may include one or more sheet rolls 453, one or more grippers 454 (FIG. 10C), one or more carriages 455 (FIG. 10B), and one or more brushes 456. The top sheet dispenser 450 may include one or more tape rolls 457, one or more cutters 458, and one or more plastic sheet holders 459. More or fewer of the features may be provided and/or omitted.

Figure 10D:
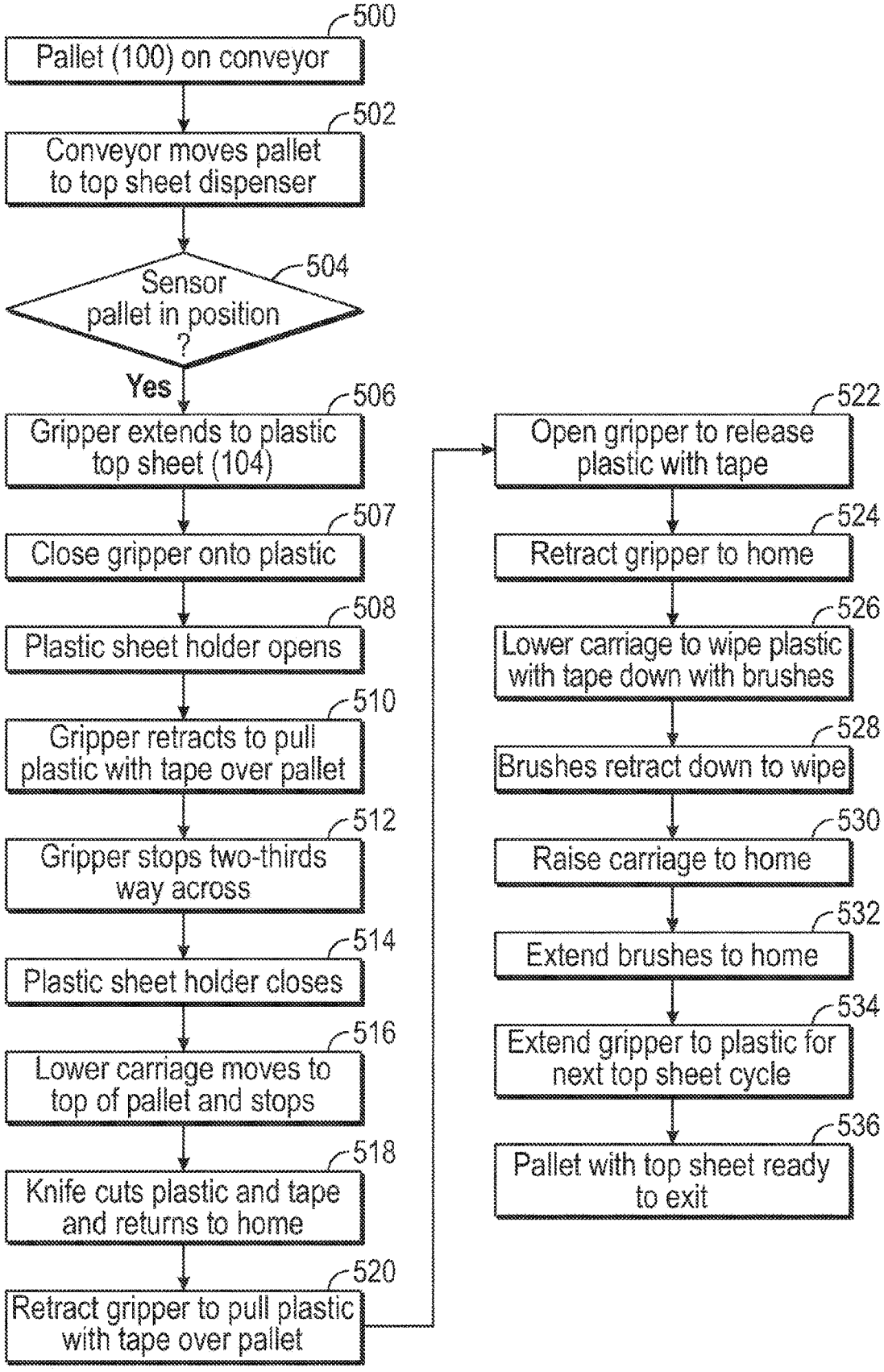
FIG. 10D is a method of operating an automated top sheet dispenser, according to an embodiment.
Figure 11:
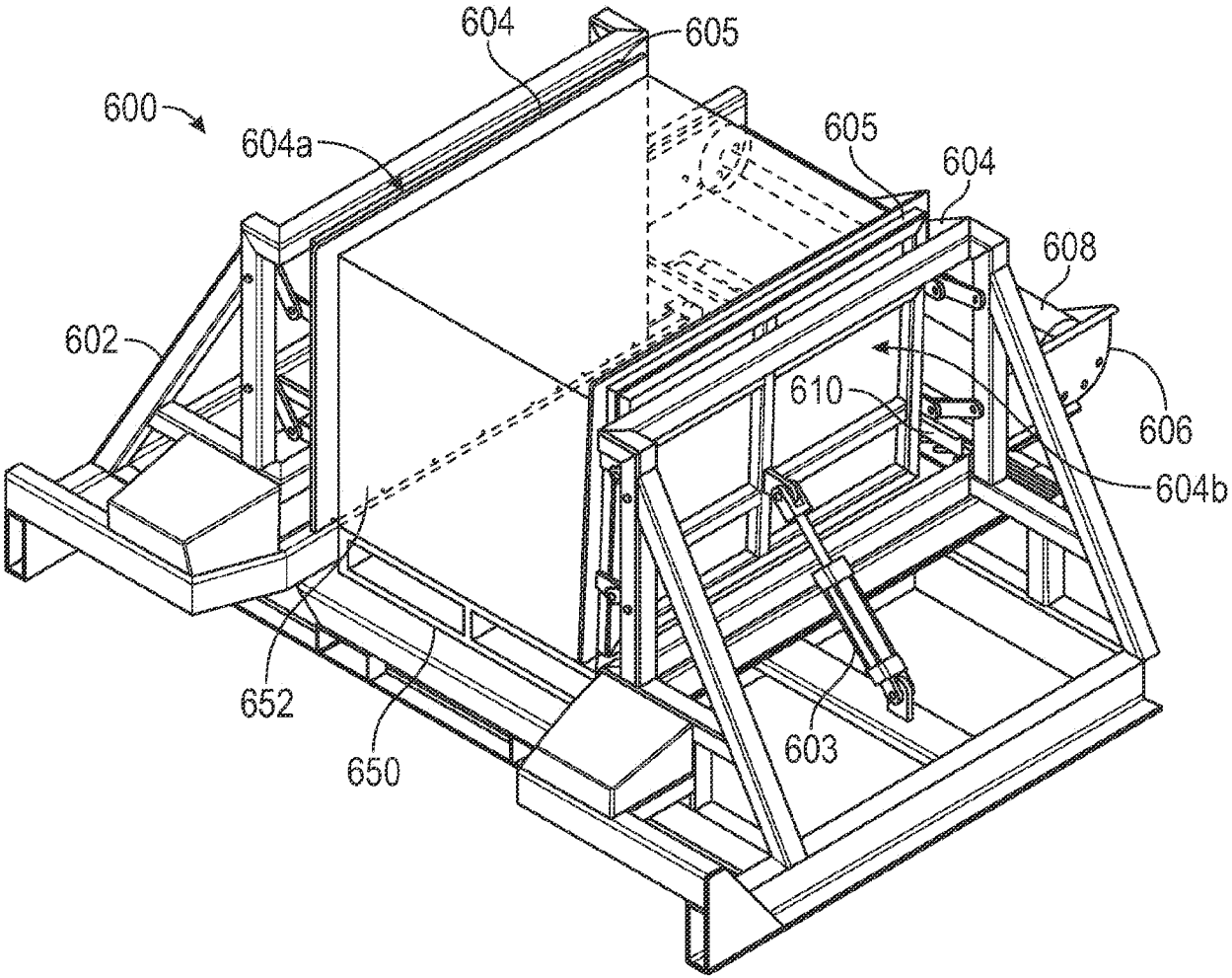
FIG. 11 is a perspective view of a manual bottom sheet dispenser, according to an embodiment.
Figure 12:
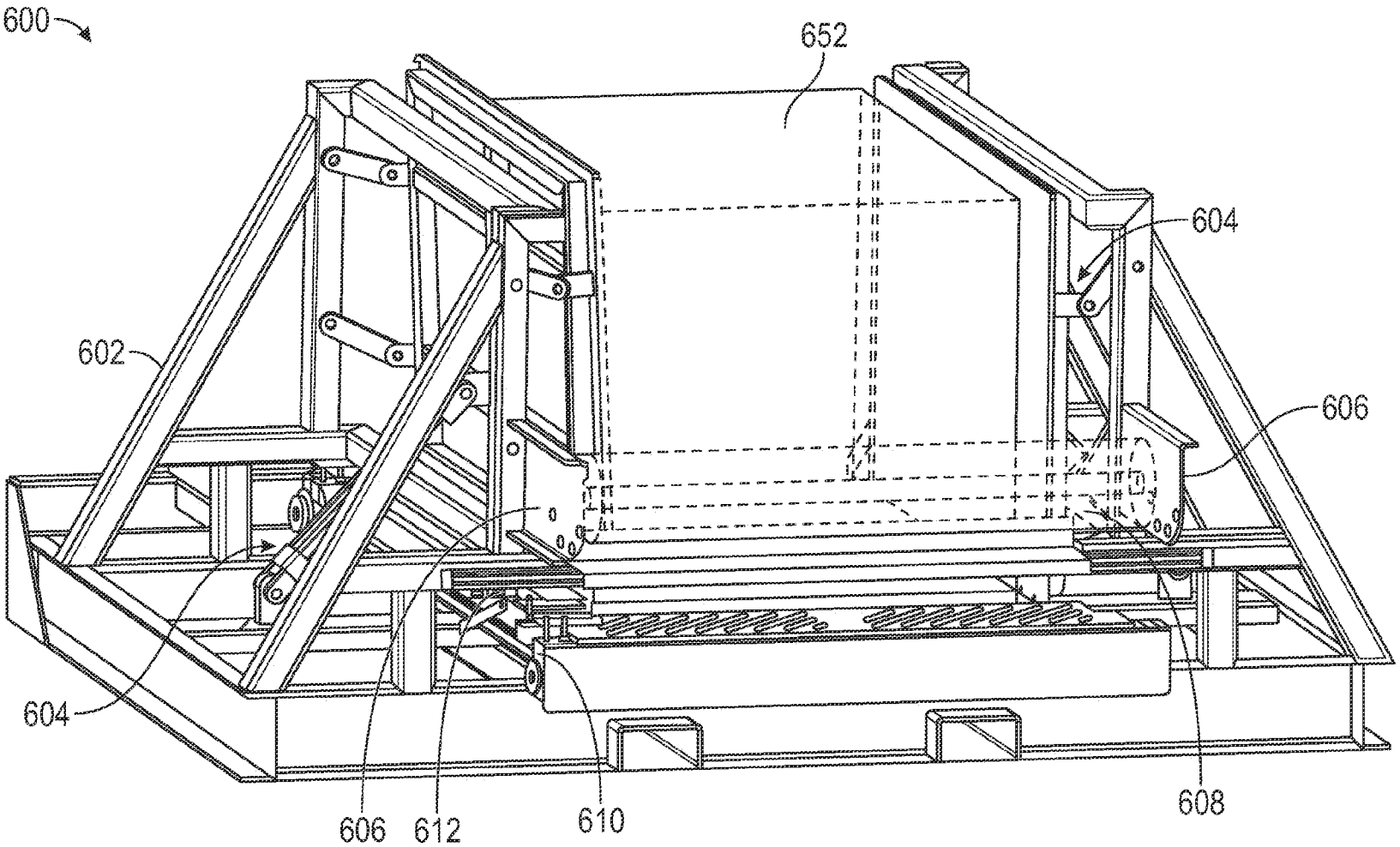
FIG. 12 is a perspective view of a manual bottom sheet dispenser, according to an embodiment.
Figure 13:
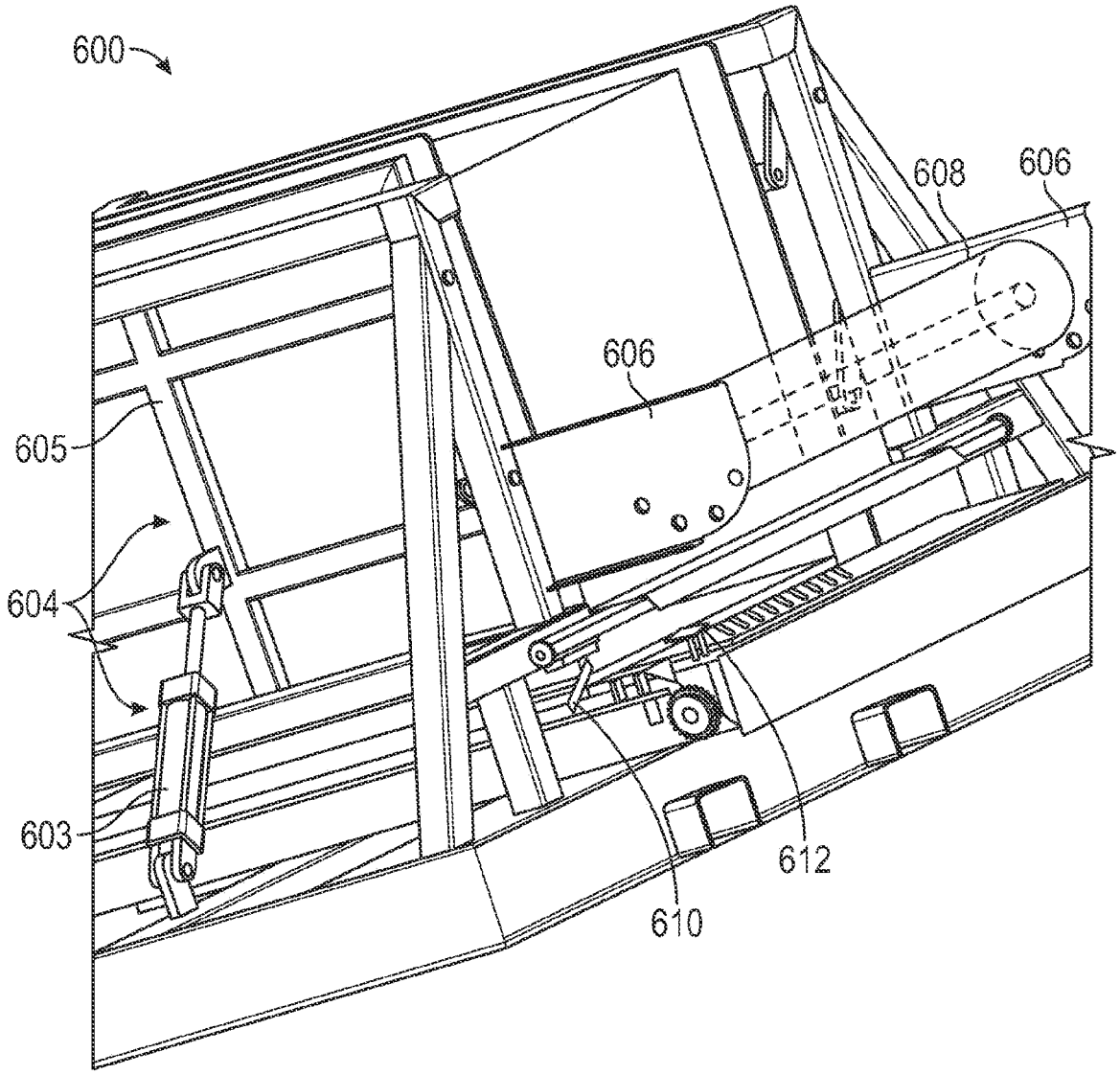
FIG. 13 is a partial perspective view of a manual bottom sheet dispenser, according to an embodiment.
Figure 14:
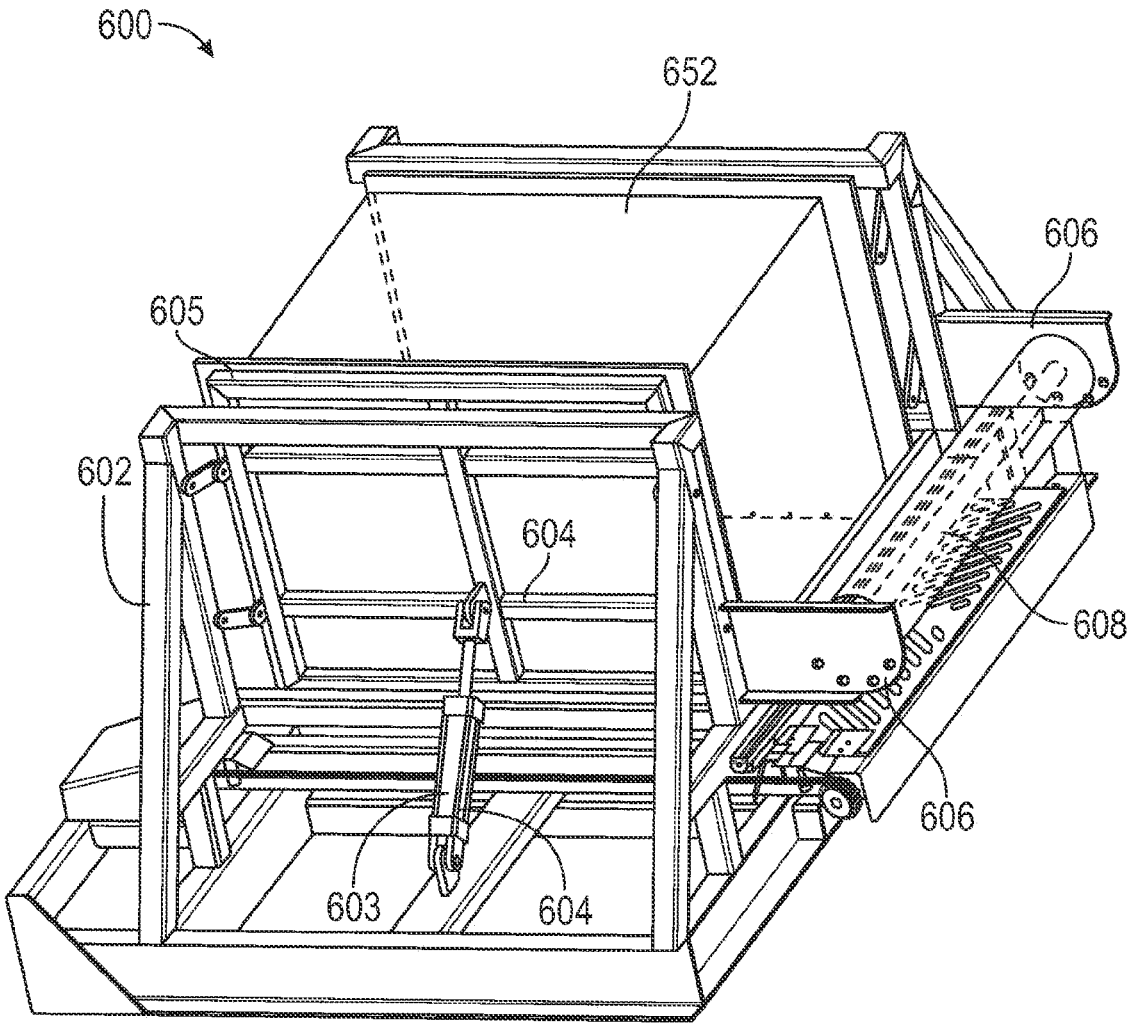
FIG. 14 is a perspective view of a manual bottom sheet dispenser, according to an embodiment.

Referring to FIG. 10D, operation of an automated top sheet dispenser, such as, for example, the top sheet dispenser 450, is described. In steps 500-536, a pallet located in the top sheet dispenser receives a top sheet on top of the stacked goods on the pallet. FIG. 10D shows an embodiment related to application of the top sheet. In this process, the conveyor moves the pallet to the top sheet dispenser. After verifying the presence of the pallet, the gripper extends to the top sheet where the gripper closes onto the plastic, the holder opens up, and the gripper retracts the top sheet and pulls it over the pallet. Then the material is cut, the gripper opens to release the plastic (which may include tape), and the gripper returns to home. One or more brushes wipe the top sheet (which may include tape) down as the carriage lowers, and then returns to home for the next cycle.

In step 500, a pallet may be placed on a conveyor. The pallet may be placed on the conveyor by a forklift or other moving means within a warehouse. In step 502, the conveyor may move the pallet to a top sheet dispenser. A sensor, in step 504, may detect whether the pallet is in the proper position with respect to the top sheet dispenser. If the sensor detects the pallet is in the proper position, the top sheet dispenser may commence with placing a top sheet on the stacked goods on the pallet. In step 506, a gripper may extend to the top sheet. At step 507, the gripper may close onto the plastic and in step 508, the sheet holder may open. The gripper may retract to pull the sheet with tape over the pallet (step 510). In step 512, the gripper may stop two-thirds of the way across the top of the pallet and in step 514, the sheet holder may close. The lower carriage may move to the top of the pallet and stop (step 516) and a knife may cut the sheet and tape and return to a home location (step 518). In step 520, the gripper may retract to pull the sheet with tape over the top of the pallet. In step 522, the gripper may open to release the sheet with the tape. In step 524, the gripper may retract to a home location. In step 526, the lower carriage may wipe the sheet with tape down with brushes. In step 528, the brushes may retract down to wipe the sheet. In step 530, the carriage may rise to a home location and in step 532, the brushes may extend to a home location. In step 534 the gripper may extend to the sheet for a next top sheet cycle and in step 536, the pallet with top sheet in place on the top of the stacked goods may be ready to exit the top sheet dispenser.

Referring to FIGS. 11-14, a bottom sheet dispenser 600 is shown. The bottom sheet dispenser 600 may be a semi-automatic bottom sheet dispenser. The bottom sheet dispenser 600 may be provided in any of the aforementioned systems for wrapping a pallet of stacked goods. The bottom sheet dispenser 600 may include a frame 602. The bottom sheet dispenser 600 may include a pallet squeeze and lift mechanism 604. The pallet squeeze and lift mechanism may include a hydraulic piston 603 and a plate 605. The plate 605 may be a planar sheet with a back frame. The pallet squeeze and lift mechanism may include a first mechanism 604*a* on a first side of a pallet 650 and a second mechanisms 604*b* on an opposing, second side of the pallet 650. The pallet squeeze and lift mechanism 604 may squeeze the stacked goods 652 and lift the stacked goods 652 off of the pallet 650 to allow for a bottom sheet to be placed between the stacked goods 652 and the pallet 650.

With continued reference to FIGS. 11-14, the bottom sheet dispenser 600 may include a bottom sheet roll frame 606 that may hold a roll 608. The roll 608 may hold a bottom sheet. The bottom sheet dispenser 600 may include a bottom sheet cutter 610. The bottom sheet cutter 610 may cut the bottom sheet from the roll 608 when a sufficient amount of bottom sheet has been dispensed on the pallet 650. The bottom sheet dispenser 600 may include a sheet gripper 612. The sheet gripper 612 may hold the bottom sheet.

Figure 15A:
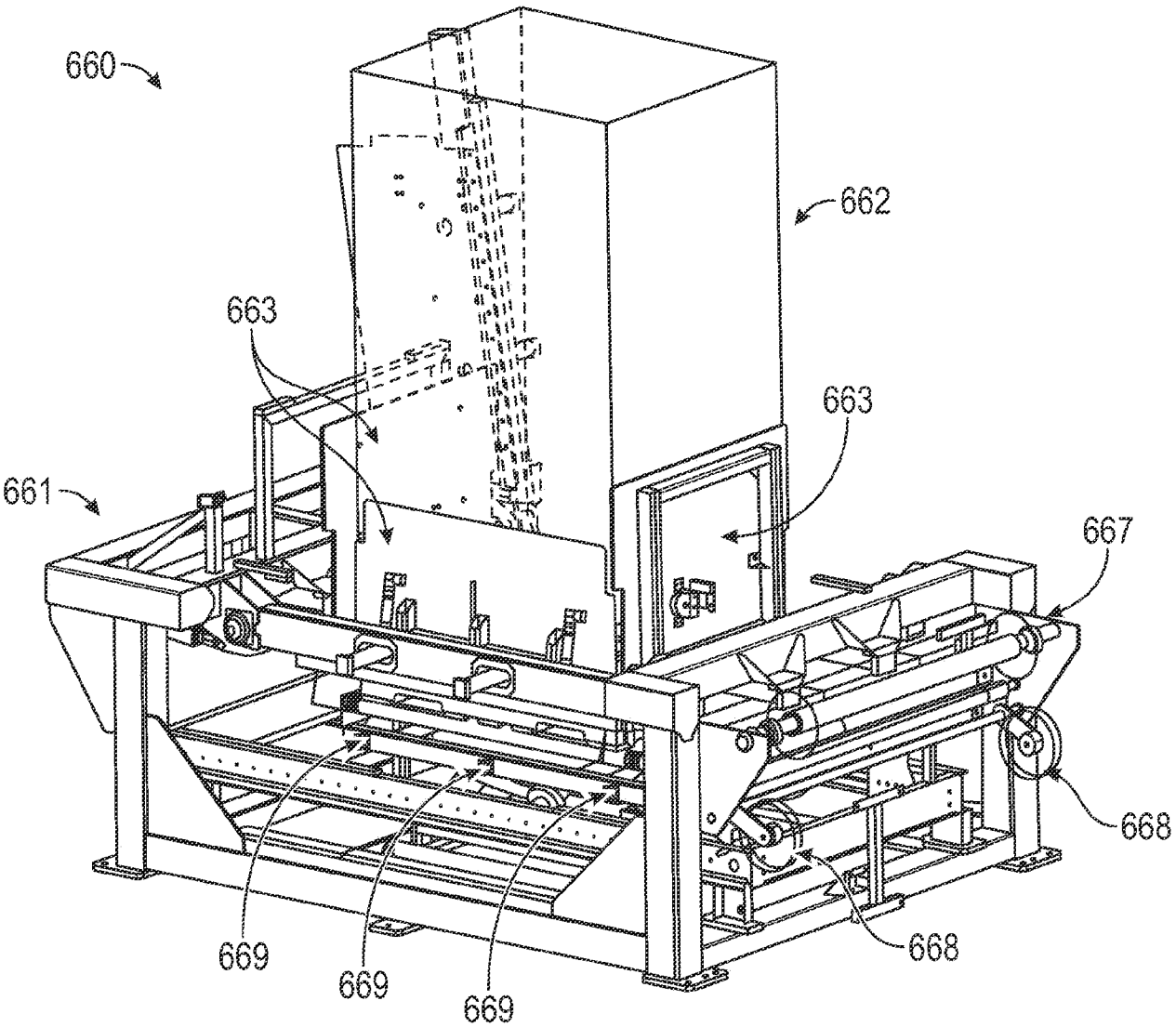
FIGS. 15A-15C are views of an automated bottom sheet dispenser, according to an embodiment.
Figure 15B:
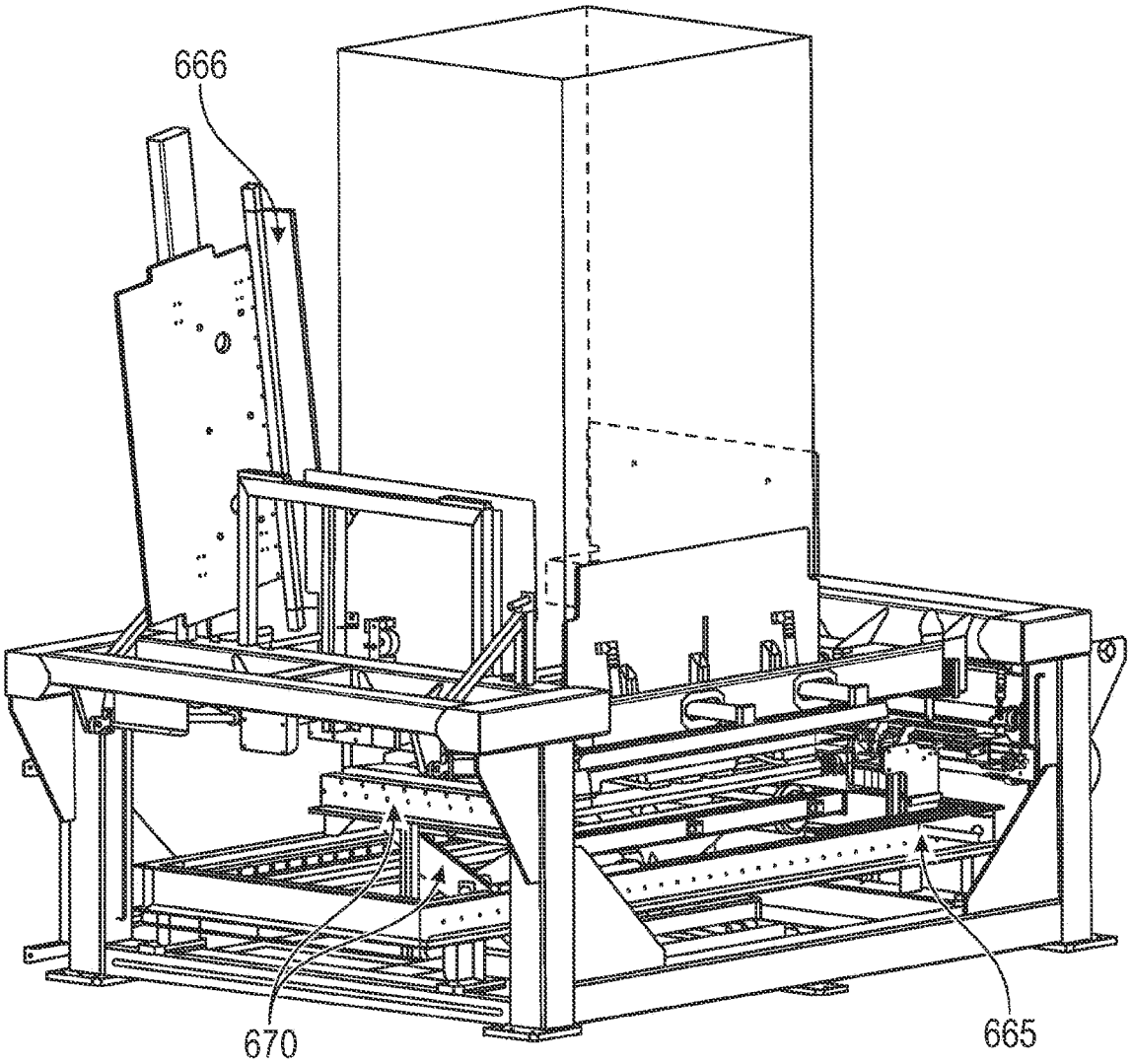
Figure 15C:
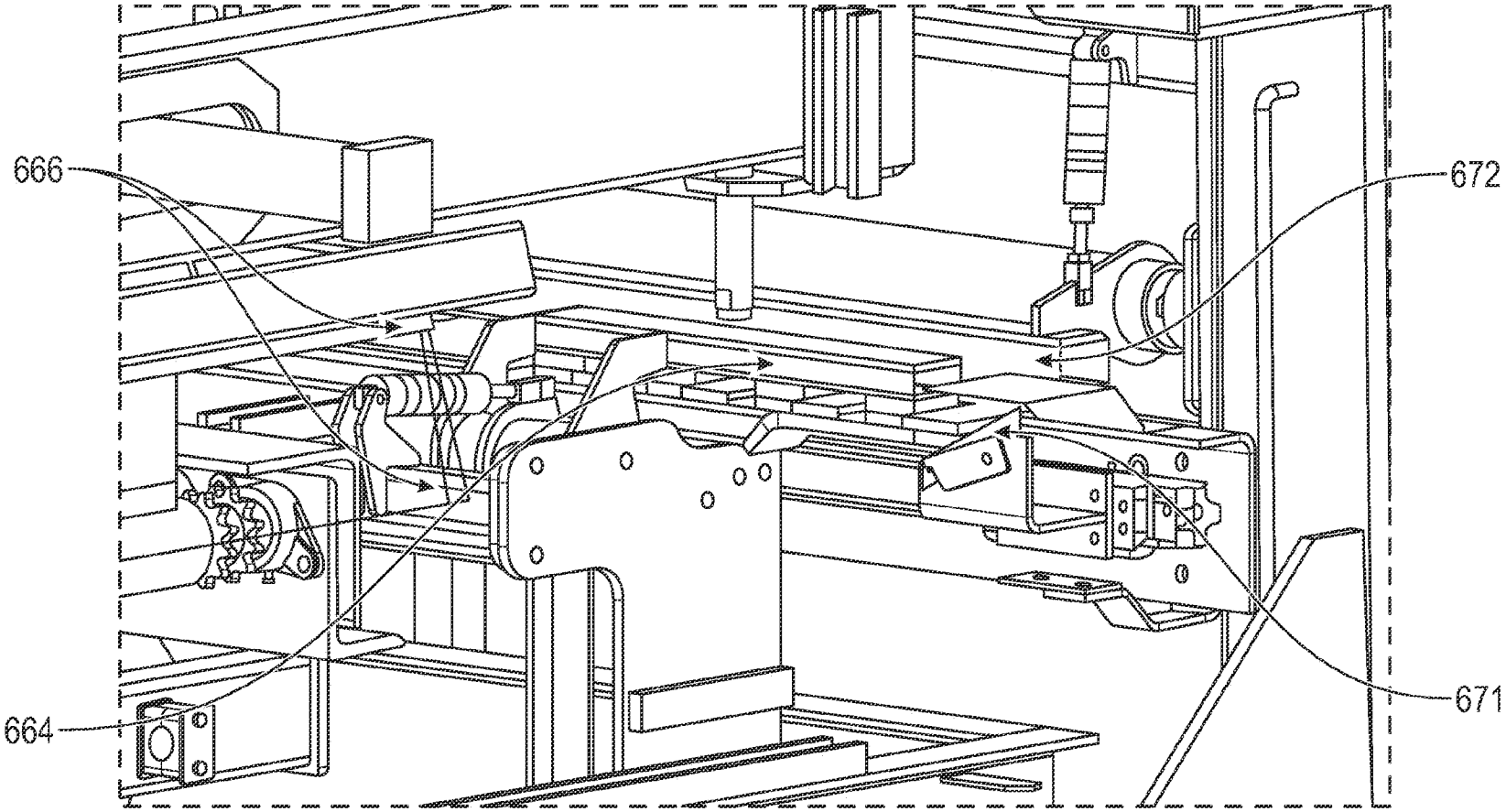

Referring to FIGS. 15A-15C, an automated bottom sheet dispenser 660 is shown. The bottom sheet dispenser 660 may comprise a frame 661. The bottom sheet dispenser 660 may include one or more sensors to detect a position of the pallet of stacked goods (e.g., pallet of stacked goods 662). The bottom sheet dispenser 660 may include one or more squeeze plates 663. As shown, the bottom sheet dispenser 660 may include four squeeze plates 663 (one is obscured by the pallet of stacked goods 662). More or fewer squeeze plates may be provided. The bottom sheet dispenser 660 may include one or more grippers 664, a carriage 665, and one or more brushes 666. The bottom sheet dispenser 660 may include one or more sheet rolls 667, one or more tape rolls 668, one or more air curtains with nozzles 669, one or more scissor lift conveyors 670, one or more cutters 671, and/or one or more plastic sheet holders 672. More or fewer of the features may be provided and/or omitted.

Figure 15D:
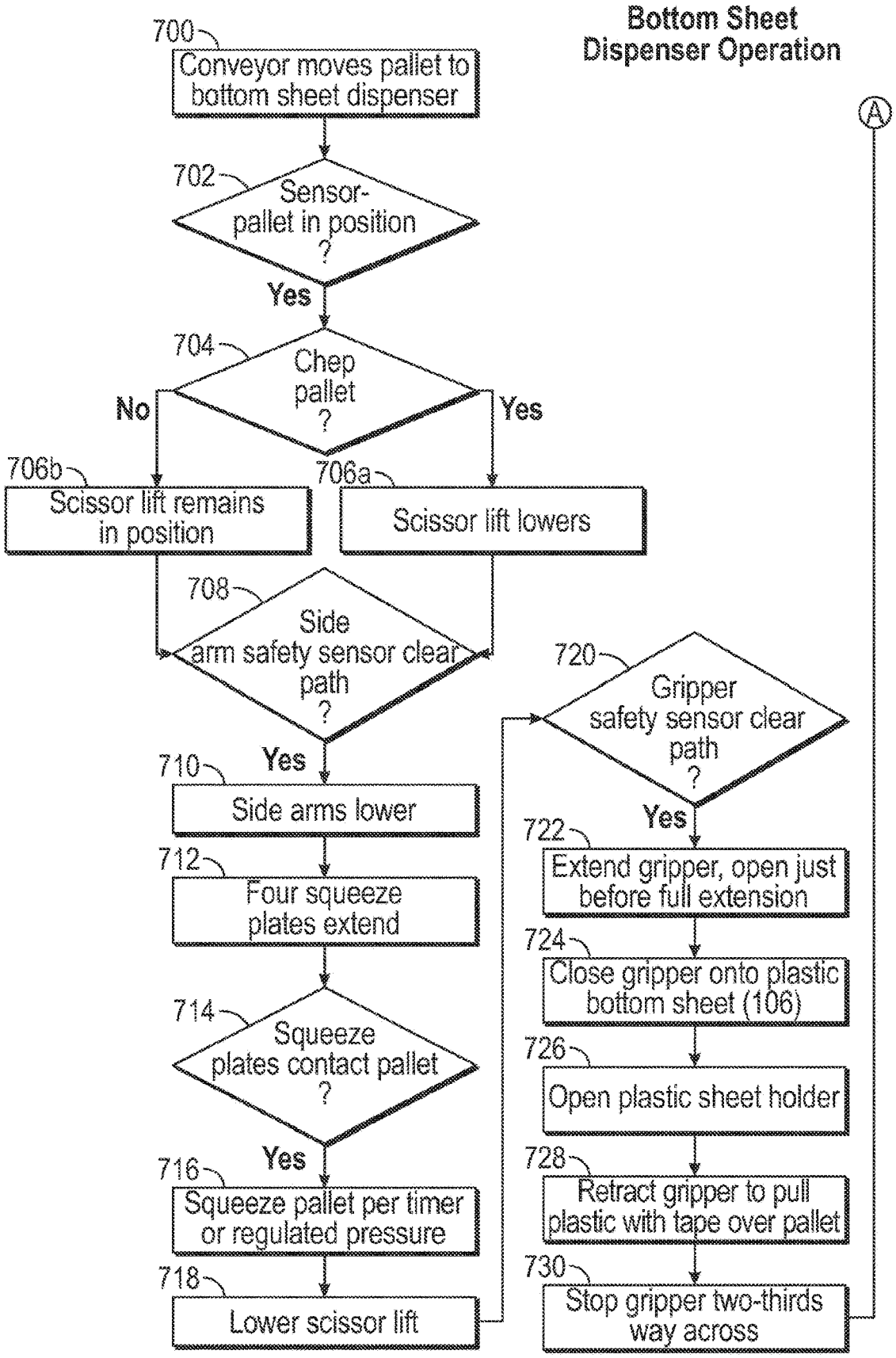
FIG. 15D is a method of operating an automated bottom sheet dispenser, according to an embodiment.
Figure 15D:
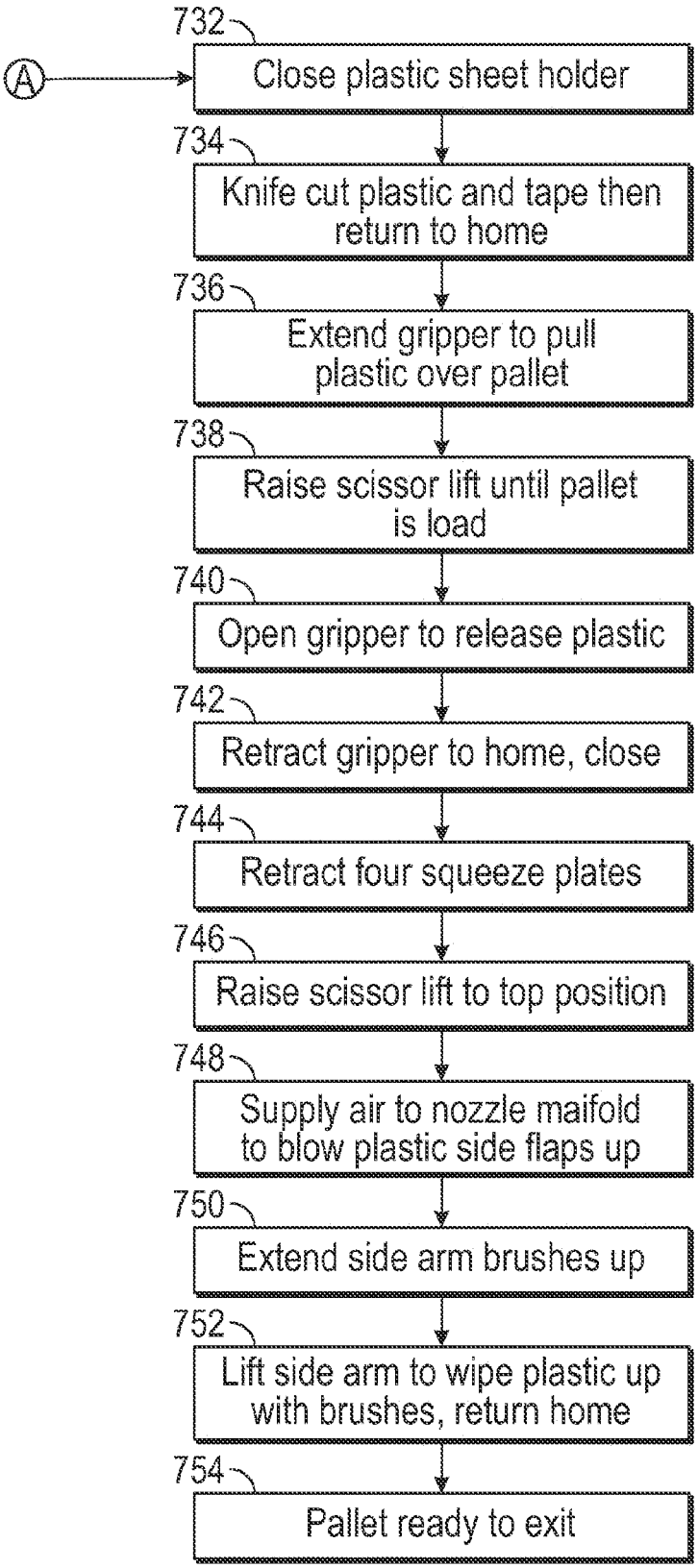

FIG. 15D illustrates the operation of an automated bottom sheet dispenser, such as, for example, the bottom sheet dispenser 660. FIG. 15D shows an embodiment related to application of the bottom sheet. After verifying the pallet is in position, side arms lower and four squeeze plates hold the pallet of stacked goods, and the scissor lift conveyor lowers the pallet/base. Then a gripper extends to the bottom sheet roll, and the gripper removes the bottom sheet material where it is cut to size. The gripper then extends the bottom sheet to properly position it over the pallet. The scissor lift conveyor raises the pallet/base up to the stacked goods onto the bottom sheet. Brushes and air blow the sides of the bottom sheet up to then be sealed to the palletized packages as four squeeze plates retract, releasing the pallet of stacked goods, and then the side arm raises to home for the next cycle.

In steps 700 through 754, a pallet located in the bottom sheet dispenser receives a bottom sheet between the pallet/base and the stacked goods. In step 700, a conveyor may move a pallet to the bottom sheet dispenser. A sensor, in step 702, may detect whether the pallet is in the proper position with respect to the bottom sheet dispenser. If the sensor detects the pallet is in the proper position, the bottom sheet dispenser may commence with placing a bottom sheet on the pallet. In step 704, a determination is made as to the type of pallet/base provided. If the pallet is a Chep pallet (e.g., a known, conventional wood pallet), a scissor lift may lower in step 706*a*. If, however, the pallet is not a Chep pallet, the scissor lift remains in the original position in step 706*b*. In step 708, a side arm safety sensor determines if there is a clear path between the stacked goods and a pallet squeezer. When the safety sensor determines a clear path is present, a side arm lowers at step 710 and four squeeze plates extend at step 712. The squeeze plates extend until contact with the stacked goods on the pallet (step 714) at which time, the plates squeeze the stacked goods on the pallet per a timer or regulated pressure (step 716). At step 718, the scissor lift lowers the pallet/base and at step 720, the gripper safety sensor ensures a clear path. At step 722, the grippers may extend and open just before full extension. At step 724, the gripper may close onto the plastic bottom sheet and at step 726, the sheet holder may open. In step 728, the gripper may retract to pull the sheet with tape edges over the pallet and at step 730, the gripper may stop about two-thirds of the way across the pallet. In step 732, the sheet holder closes. In step 734, a cutter or knife may cut the sheet and tape and then return to a home location. In step 736, a gripper may extend to pull the sheet over the pallet. At step 738, a scissor lift may be raised until pallet/base is to the stacked goods. At step 740, the gripper may release the plastic and retract to a home location (step 742). At step 744, the four squeeze plates may retract, no longer squeezing the stacked goods on top of the bottom sheet on the pallet. At step 746, the scissor lift may raise to the top position. At step 748, air may be supplied to a nozzle manifold or air curtains with nozzles to blow the sheet side flaps up along the sides of the stacked goods on the pallet. At step 750, a side arm brush(es) may extend upward and a side arm may be lifted to wipe up and adhere the sheet to the sides of the stacked goods with the brushes and then return home (step 752). At step 754, the pallet may be ready to exit the bottom sheet dispenser.

Figure 16A:
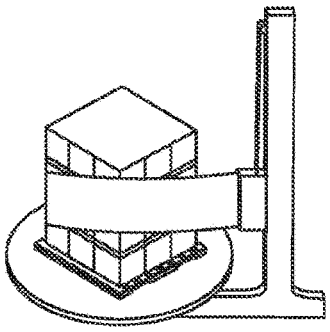
FIGS. 16A-16G are views of various pallet wrappers, according to an embodiment.
Figure 16B:
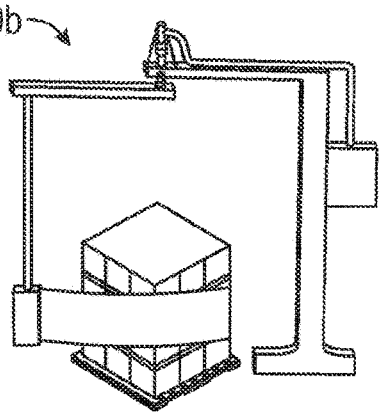
Figure 16C:
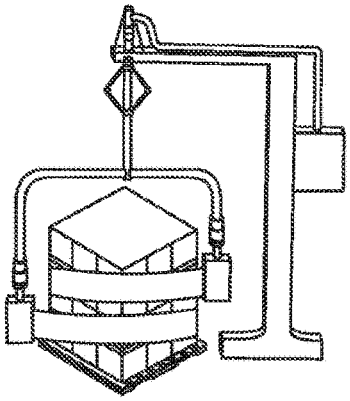
Figure 16D:
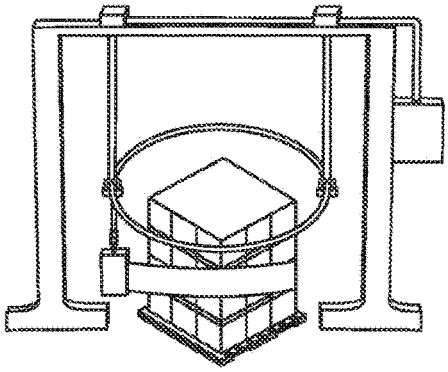
Figure 16E:
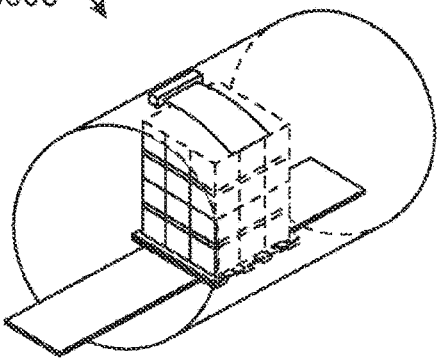
Figure 16F:
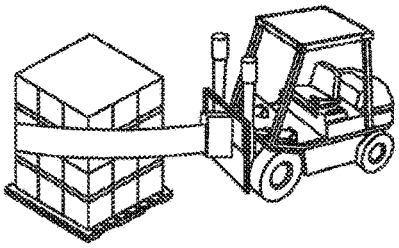
Figure 16G:
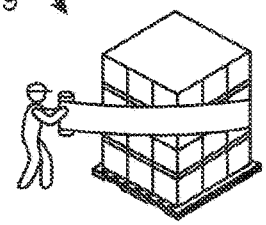

Referring to FIG. 16A-16G, various examples of pallet wrappers 800 are shown. The pallet wrappers 800 may be provided in any of the aforementioned systems for wrapping a pallet of stacked goods. In FIG. 16A, the pallet wrapper 800*a* may be a turn table wrapper. In FIG. 16B, the pallet wrapper 800*b* may be a single arm wrapper. In FIG. 16C, the pallet wrapper 800*c* may be a two-arm wrapper. In FIG. 16D, the pallet wrapper 800*d* may be a ring wrapper. In FIG. 16E, the pallet wrapper 800*e* may be an orbital wrapper. In FIG. 16F, the pallet wrapper 800*f* may be a machine/cart wrapper. In FIG. 16G, the pallet wrapper 800*e* may be a manual/hand wrapper. Any of the wrappers described in FIGS. 16A-16G may be provided in any of the systems and/or methods described herein.

Figure 16H:
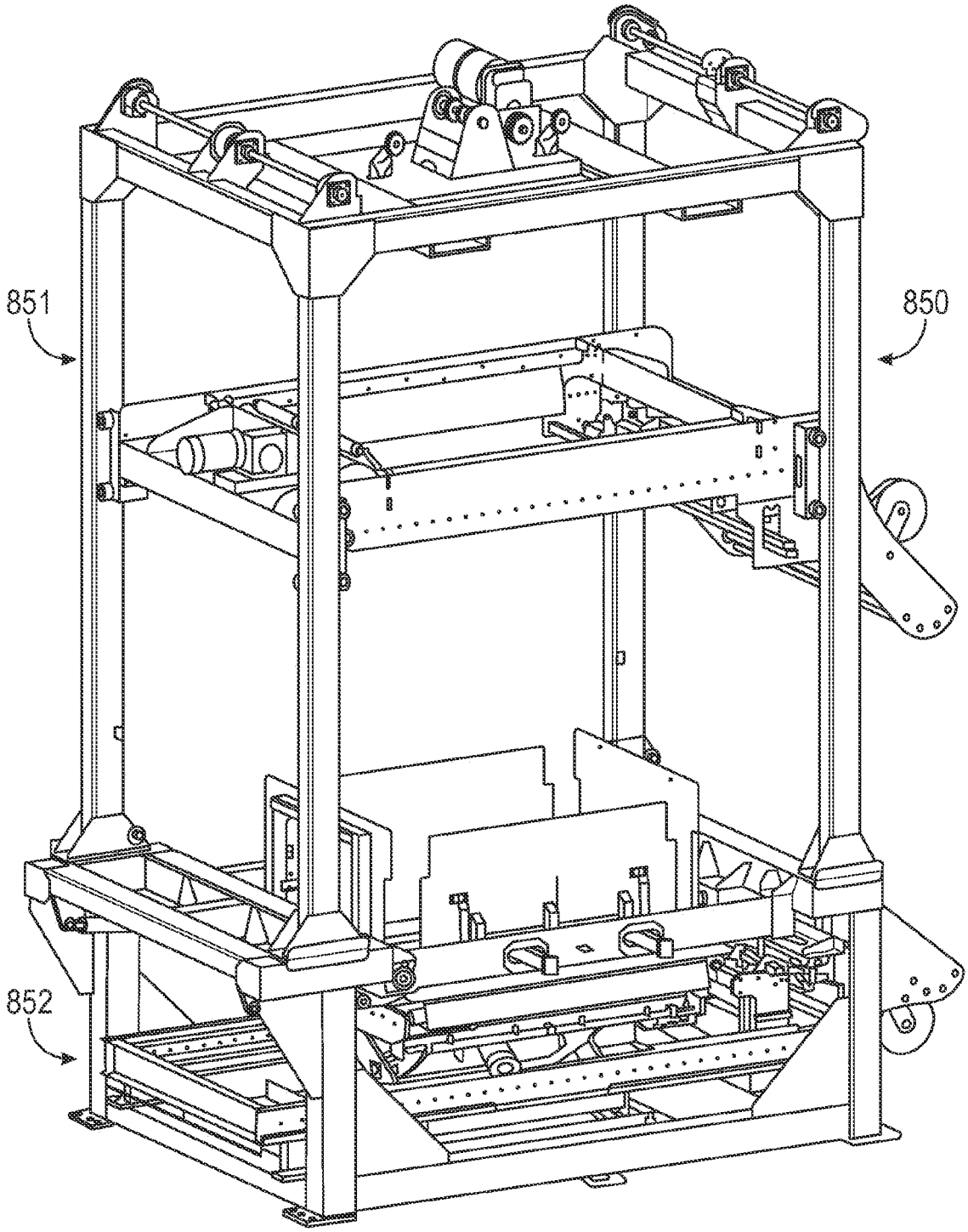
FIGS. 16H and 16I are perspective views of a combined top sheet dispenser and bottom sheet dispenser
Figure 16I:
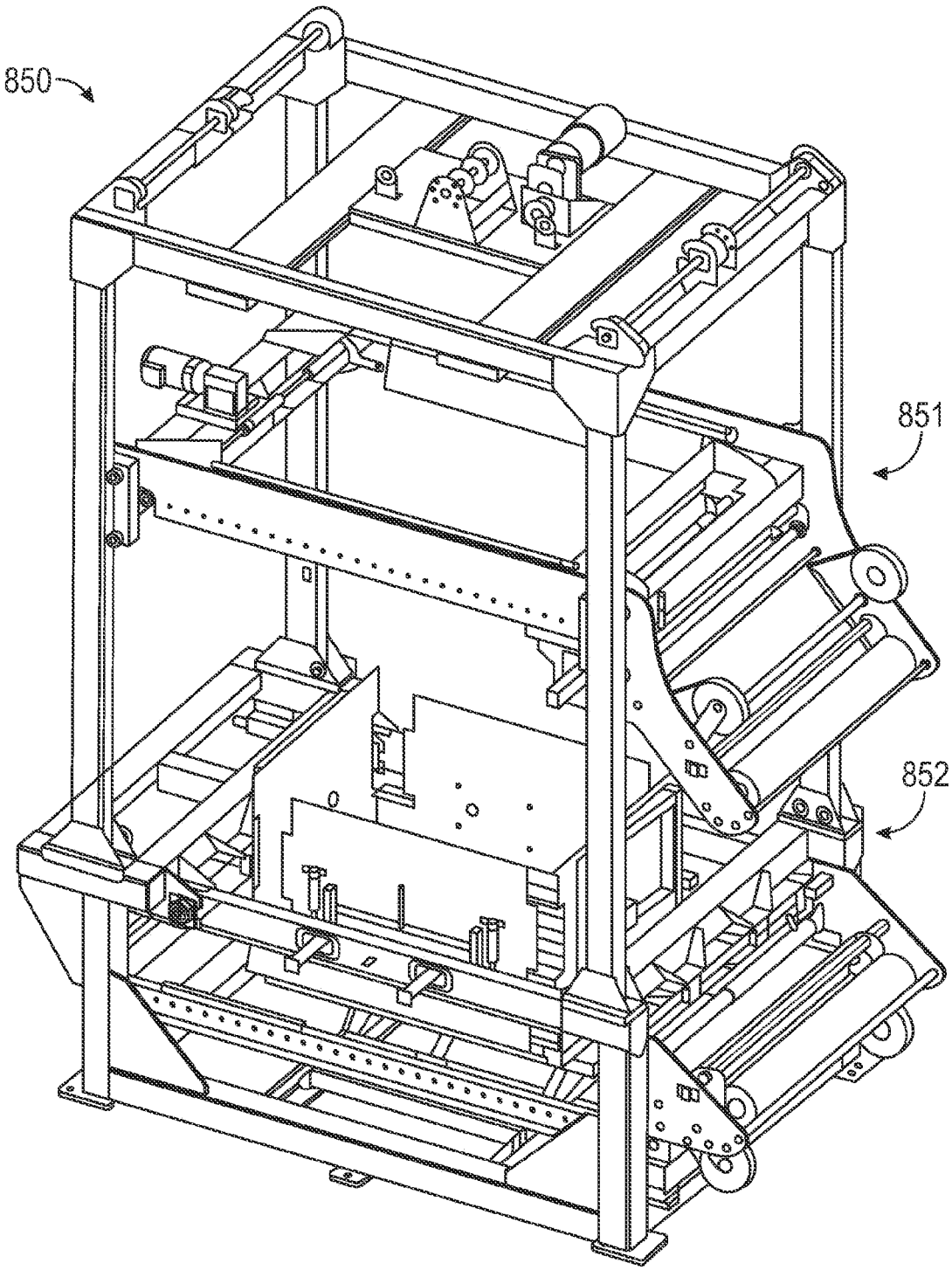

FIGS. 16H and 16I show an exemplary combined top sheet dispenser and bottom sheet dispenser 850. The combined dispenser 850 may allow for individual, simultaneously or sequentially providing a pallet with the top sheet (via 851) and/or a bottom sheet (via 852) as described herein. The top sheet dispenser may be separated from the bottom sheet dispenser during transport.

Figure 17:
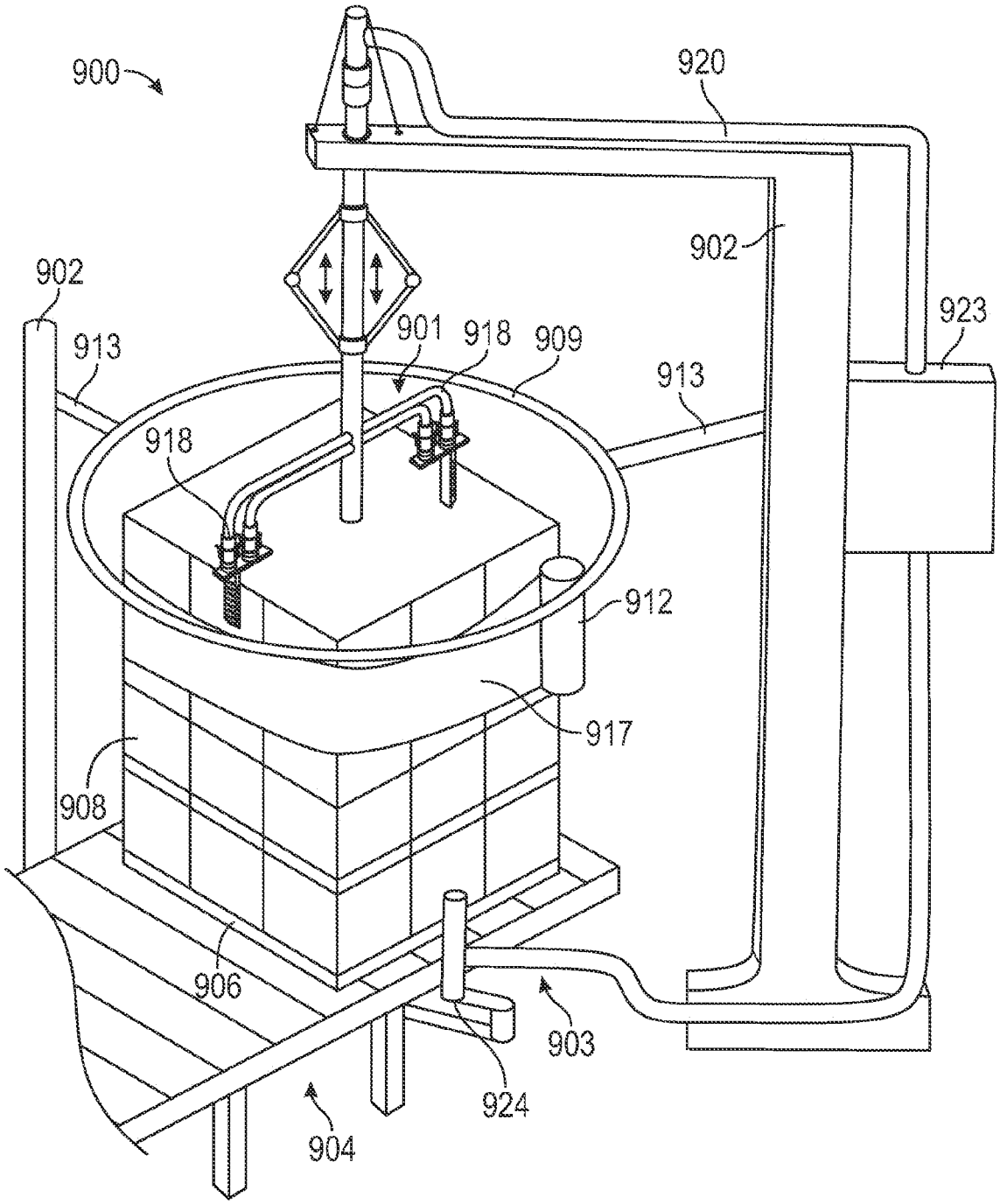
FIG. 17 is a perspective view of a pallet ring wrapping system, according to an embodiment.

With reference to FIG. 17, a pallet wrapper 900 is shown having a top mounted vacuum and/or gas injection manifold 901 and a bottom mounted vacuum and/or gas injection manifold 903 as well as a robotic pad to cover the injection nozzle to prevent leaks during gas and treatment injection. The pallet wrapper 900 is also referred to as a ring wrapper 900 is shown. The ring wrapper 900 may include a frame 902. The frame 902 may extend around a conveyor 904. On the conveyor 904, there may be a pallet 906 with stacked goods 908. The ring wrapper 900 may include a ring 909 on which a film carriage head or a wrap dispenser 912 is attached. The ring 909 may be coupled with connections 913 to the frame 902. When the pallet 906 is within the boundaries of the ring 909, the wrapped dispenser 912 may dispense a film, sheet, or wrap material 917.

With continued reference to FIG. 17, the ring wrapper 900 may include injection and vacuuming nozzles 918. The nozzles 918 may be coupled to a hose 920 that is connected to a gas source (not illustrated) and substance treatment as well as gas controls 923. The ring wrapper 900 may include robotic high-speed nozzles and pressure pads 924 to prevent leaks during gas and substance treatment injection.

Figure 18:
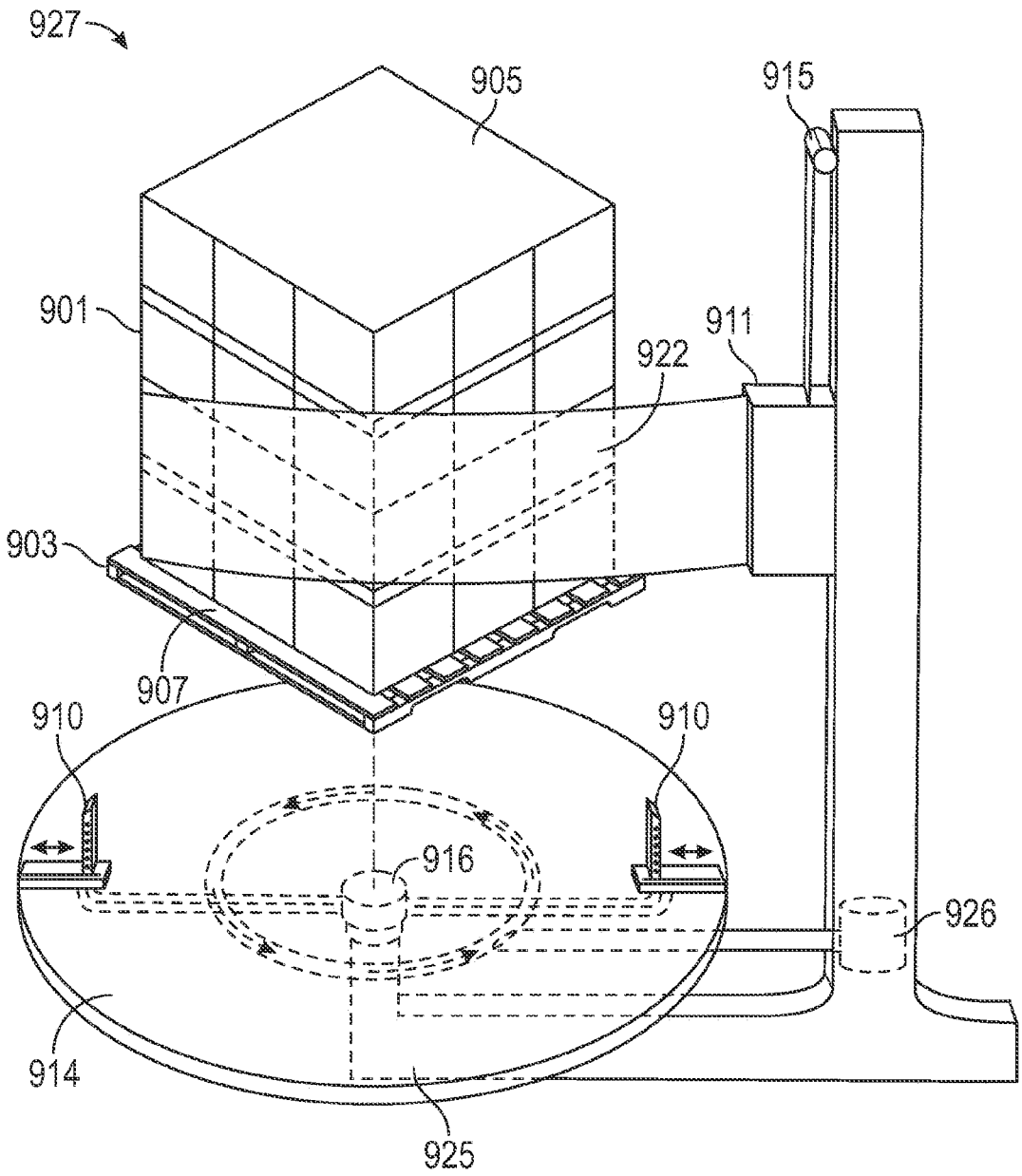
FIG. 18 is a view of a semi-automated pallet wrapper with an automated bottom gas injection manifold, according to an embodiment.
Figure 19:
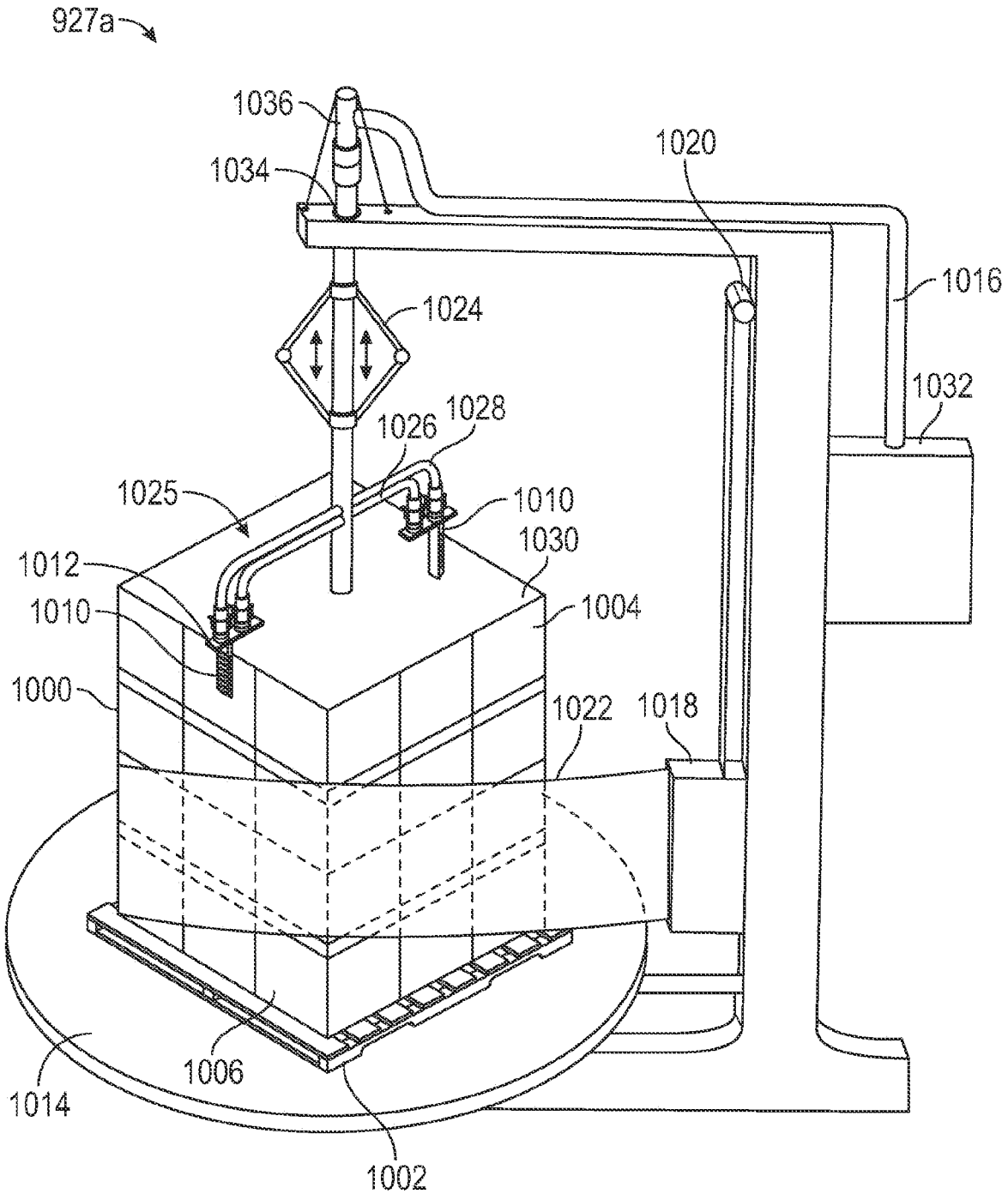
FIG. 19 is a view of a semi-automated pallet wrapper with an automated top gas injection manifold, according to an embodiment.

Referring to FIGS. 18 and 19 exemplary embodiments of a turntable wrapper 927 and 927*a*, respectively, are shown. The turntable wrapper may include a method for injection and vacuum systems for pallets and associated methods for sealing and gassing pallets in accordance with the principles of the disclosure.

FIG. 18 shows an exemplary turntable wrap system 927. In the exemplary turntable wrap system of FIG. 18, air may be removed and/or a modified atmosphere as well as substance treatments may be injected into the sealed enclosure from the bottom of stacked goods 901. The turntable wrap system 927 may be, for example, a portable automatic stretch wrapping system. The automatic stretch wrapping system may automatically attach, wrap, and cut the stretch film without an operator.

After the pallet/base 903 and stacked goods 901 receive a top sheet 905 and bottom sheet 907, the pallet 903 is then either manually or automatically loaded onto turntable 914. Nozzle fingers 910 are initially positioned towards the edge of turntable 914. Nozzle fingers 910 are on a slider which allows them to slide towards and away from the edge of turntable 914. When stacked goods 901 are placed on the turntable, nozzle fingers 910 may be moved inwardly and/or outwardly to abut the sides of stacked goods 901. Nozzle fingers 910 may be placed against the edge of bottom sheet 907. Air may be blasted or blown upward from turntable 914 to keep the bottom sheet 907 in place while nozzle fingers 910 are slid against the edges of bottom sheet 907 such that bottom sheet 907 is tucked between the sides of stacked goods 901 and nozzle fingers 910. Wrap 922 may be, for example, a roll of film that is dispensed from film carriage or wrap dispenser 911 at the bottom of stacked goods 901. The turntable 914 may spin via a motor 926 such that stacked goods 901 are wrapped in a circular fashion with wrap 922. Wrap 922 may be placed on top of nozzle fingers 910 such that nozzle fingers 910 are held between wrap 922 and bottom sheet 907. Wrap dispenser 911 may be moved upward by pulley 915 while wrapping such that stacked goods 901 are wrapped from bottom to top. In this manner, top sheet 905, wrap 922, and bottom sheet 907 may form an airtight enclosure around stacked goods 901. Alternatively, stacked goods 901 may be wrapped from the top down or via wrap material sufficient in size to cover the stacked goods without the need for the roll of wrap material to move up and down.

According to embodiments, gas lines and/or vacuum lines may be plumbed inside spindle 925 to junction 916. Piping continues from junction 916 to nozzle fingers 910. Junction 916 is a rotating union that may spin with turntable 914. In this manner, nozzle fingers 910 may vacuum air from inside of the sealed enclosure and/or inject a modified atmosphere into the sealed enclosure formed by bottom sheet 907, wrap 922 and top sheet 905. The vacuum and/or modified atmosphere may be performed simultaneously with wrapping while the turntable is rotating, or after wrapping. According to embodiments, nozzle fingers 910 may be released from between wrap 922 and bottom sheet 907 by a mechanism to push them into the turntable in a recessed position. Nozzle fingers 910 may be moved in an outward direction towards the edge of the turntable to accommodate the next pallet 903 of stacked goods 901.

FIG. 19 shows exemplary turntable wrap system 927*a*. In the exemplary turntable wrap system of FIG. 19, air may be removed and/or a modified atmosphere and/or treatment is injected into the sealed enclosure at the top of stacked goods 1000. Stacked goods 1000 with top sheet 1004 and bottom sheet 1006 may be placed on pallet 1002 and either manually or automatically loaded onto turntable 1014. Platen 1030 is lowered on top of top sheet 1004, keeping top sheet 1004 in place. Platen 1030 may be raised and lowered using mechanism 1024. The system may include a manifold 1025. The manifold 1025 may include hoses or piping 1026, 1028, nozzle fingers 1010, and stabilizing support bars 1012. The manifold 1025 may include one or more hoses, one or more nozzles, one or more blending chambers, one or more stabilizing support bars, or combinations thereof. Dual nozzle fingers 1010 are attached on opposing sides of piping 1026 and 1028 via stabilizing support bars 1012. The dual nozzle fingers 1010 may be adjusted closer together or farther apart to accommodate different sizes of stacked goods. When stacked goods 1000 are placed on the turntable 1014, nozzle fingers 1010 may be adjusted inwardly to abut the sides of stacked goods 1000. The nozzle fingers 1010 may be adjustable in a radial fashion with respect to a center of the turntable 1014 and/or in a vertical fashion with respect to the pallet 1002 and/or stacked goods 1000. Stabilizing support bar 1012 may rest on top of platen 1030. Nozzle fingers 1010 may be placed against the overhanging edge of top sheet 1004. According to embodiments, air may be blasted or blown upward from turntable 1014 to keep the bottom sheet 1006 in place until the edges of bottom sheet 1006 are tucked into place underneath wrap 1022. Wrap 1022 may be, for example, a roll of film that is dispensed from film carriage or wrap dispenser 1018. Wrap dispenser 1018 may be tall enough to cover the stacked goods (not illustrated) or moved up and down, allowing stacked goods 1000 to be wrapped either from the top down or the bottom up. Turntable 1014 may spin such that stacked goods 1000 are wrapped in a circular fashion with wrap 1022. Wrap 1022 may be placed over nozzle fingers 1010 such that nozzle fingers 1010 are held between wrap 1022 and top sheet 1004. Wrap dispenser 1018 may be moved downward by pulley 1020 while wrapping such that stacked goods 1000 are wrapped, for example, from the top down. In this manner, top sheet 1004, wrap 1022, and bottom sheet 1006 form an airtight enclosure around stacked goods 1000. Alternatively, stacked goods 1000 may be wrapped from the bottom up.

According to embodiments, vacuum/gas piping 1016 connects vacuum/gas/treatment substance source modules and controls 1032 to arm 1036. Vacuum/gas/substance treatments may be piped through arm 1036 to nozzle fingers 1010. Junction 1034 may be a rotating union such that platen 1030 and nozzle fingers 1010 rotate with turntable 1014. Junction 1034 may be a rotating union that spins with turntable 1014. In this manner, nozzle fingers 1010 may vacuum air from inside of the sealed enclosure and/or inject a modified atmosphere and/or substance treatments into the sealed enclosure formed by bottom sheet 1006, wrap 1022 and top sheet 1004. The vacuum and/or modified atmosphere and/or treatments may be performed simultaneously with wrapping while the turntable is rotating, or after wrapping. According to embodiments, platen 1030 may be raised using mechanism 1024 to release nozzle fingers 1010 from between wrap 1022 and top sheet 1004. Nozzle fingers 1010 may also be moved further away from each other to accommodate the next pallet 1002 of stacked goods 1000.

After goods have been loaded onto the pallet and the pallet is sealed by some method such as, for example, heat shrink wrapping, adhesive film wrapping, or bagging as described above, the goods may be further protected and preserved by providing a modified atmosphere inside the enclosure surrounding the goods (e.g. the space between the wrapping and the goods). Accordingly, the pallet of goods may be sealed and treated or treated as it is being sealed. The stacked products on the pallet may be packaged in a manner to benefit from the treatment or atmosphere established within the enclosure surrounding the goods. For example, nitrogen or carbon dioxide may be injected within the enclosure in order to deter deterioration of the goods, for example, by the growth of organisms that may contribute to the natural deterioration of produce. Other mixtures of gases may help maintain the goods if held at an appropriate temperature and humidity. Filtered, dry, or humidified air and/or compressed air may also be used as a carrier for substances that may provide beneficial results. To improve the effect of the modified atmosphere, air may first be vacuumed from the enclosure.

As mentioned, once wrapped, with a wrapping system, such as wrapping and sealing system 14, a modified environment may be provided to the sealed and enclosed space between the wrap sheet and the stacked goods. The modified environment may be provided with a modified environment system that may include a nozzle. In exemplary embodiments, the modified environment system may be located, part of, or placed in the same location as the pallet wrapper. In this manner, the modified environment may be provided simultaneously or directly after wrapping of the pallet with the wrap sheet and/or in conjunction with the sealing process.

With reference to FIGS. 20A-20E, schematic views of a semi-automated bag gas injection system 1040 are shown. The system of FIGS. 20A-20E may be employed to inject a modified atmosphere and substance treatments within a bag surrounding stacked goods on a pallet 1042. That is, where the prior figures are directed to wrapping a pallet of goods with a wrapping material (e.g., a film) and injecting a treatment and modified atmosphere therein, FIGS. 20A-20E are directed to an embodiment where a bag is placed around the pallet of goods and the modified atmosphere is injected therein. As in prior examples, the pallet 1042 may be placed on a conveyor 1044 that may be part of a larger system, such as, for example, a system similar to that depicted in FIGS. 1-3. The pallet 1042 may move along the conveyor 1044 from station to another until it reaches the semi-automated bag gas injection system 1040 shown in FIGS. 20A-20E.

FIG. 20 may be a manually operated system for creating a MAP pallet enclosure, including a gas injection manifold with the flat stabilizer bar placed above the top sheet and the nozzle portion angling down enclosed and extended between the side sheet wrapping and the top sheet. FIGS. 20A and 20B illustrate the mechanical, chain, belt, or track driven pallet sealing and taping system 1040 that works in conjunction with the injection manifold and nozzles placed between the bottom sheet and the bag, as discussed elsewhere herein. After the bottom sheet or bottom cap is in place and the bag is fitted over the stacked goods on the pallet 1042, the pallet 1042 is moved on the conveyor 1044 to the gas injection and sealing position. The nozzle(s) are inserted between the bottom sheet/cap and the bag, the bag is secured in place by the nozzle and/or clamp, cover pad or other bag securing device; the sealing or taping device is moved into positioned next to the inserted nozzle and begins its track path 1054 around the pallet of goods sealing the bottom sheet to the covering bag.

The one or more tape sealing devices with one or more leading and/or following pressure rollers encircle the pallet of goods until the pallet reaches the point over the injection nozzle and the injection process is completed, the taping and roller sealing device then advances as the nozzles are withdrawn to complete the pallet sealing process of FIG. 20 A and B, according to an embodiment.

Figure 20B:
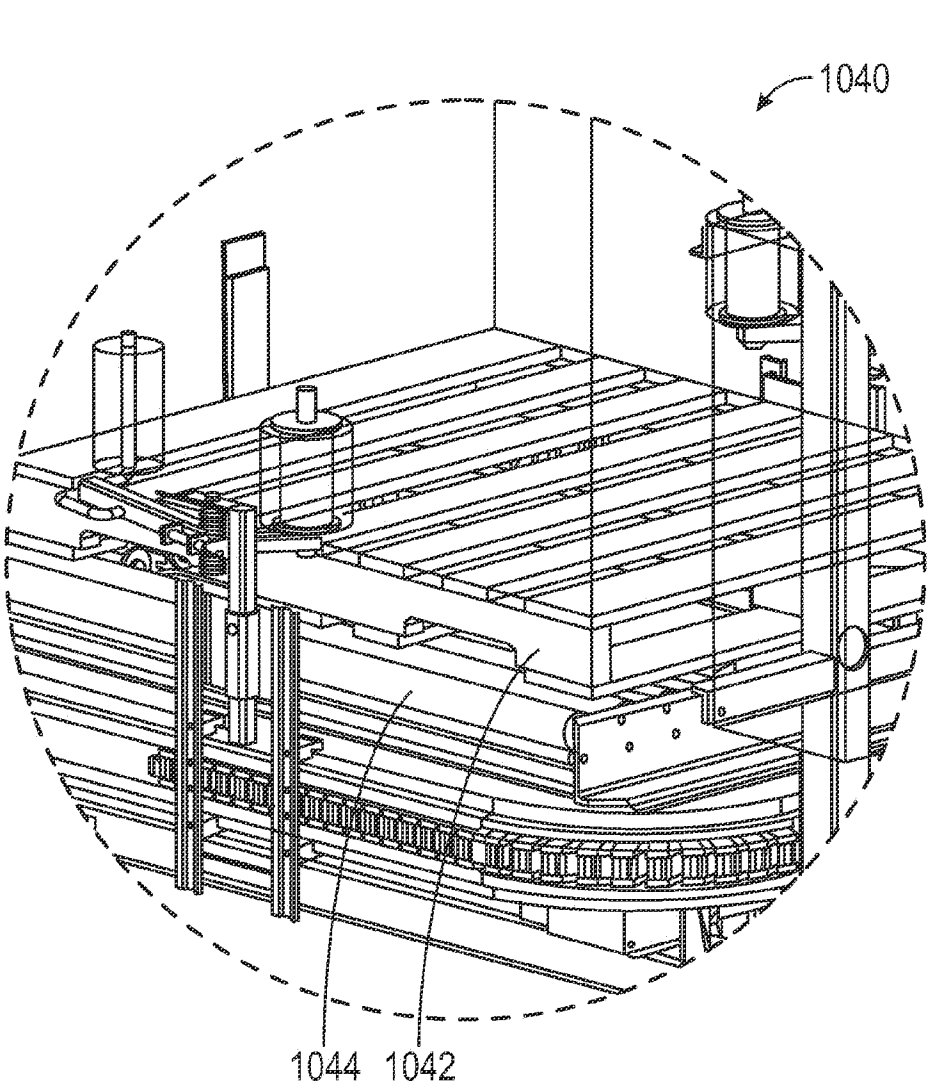
FIG. 20B is a close-up, perspective view of the track sealing wrap and taping system of FIG. 20A, with following foam pressure roller sealer, according to an embodiment.
Figure 20A:
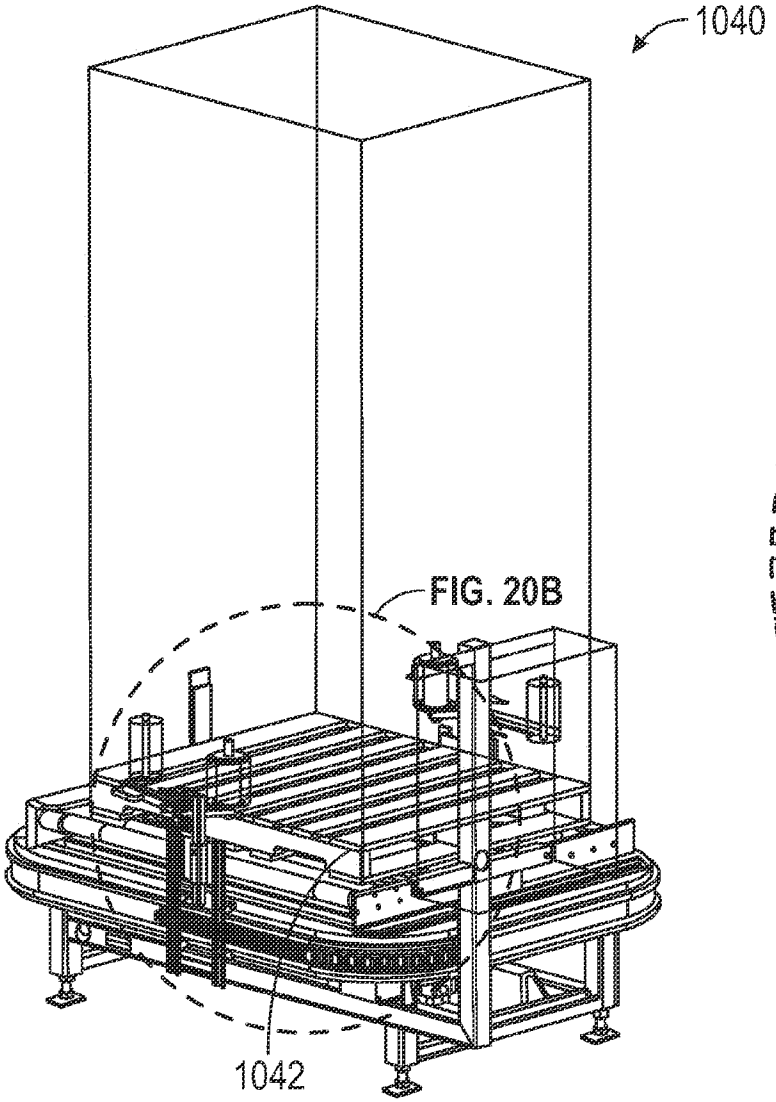
FIG. 20A is a perspective view of a semi-automated gas injection and track sealing wrap and taping system, according to an embodiment.
Figure 20C:
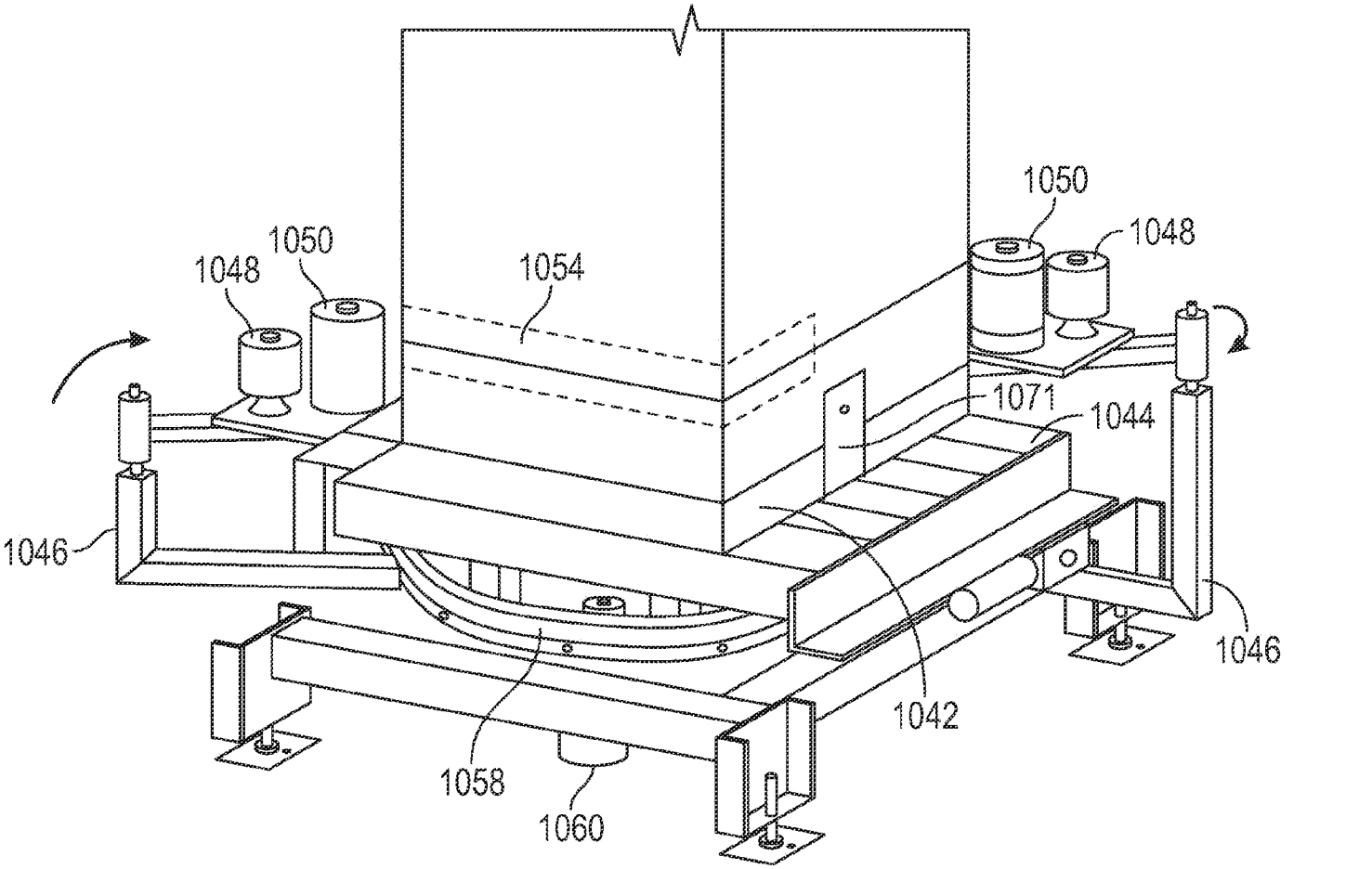
FIG. 20C is close-up perspective view of the system of FIG. 20A, according to an embodiment.
Figure 20E:
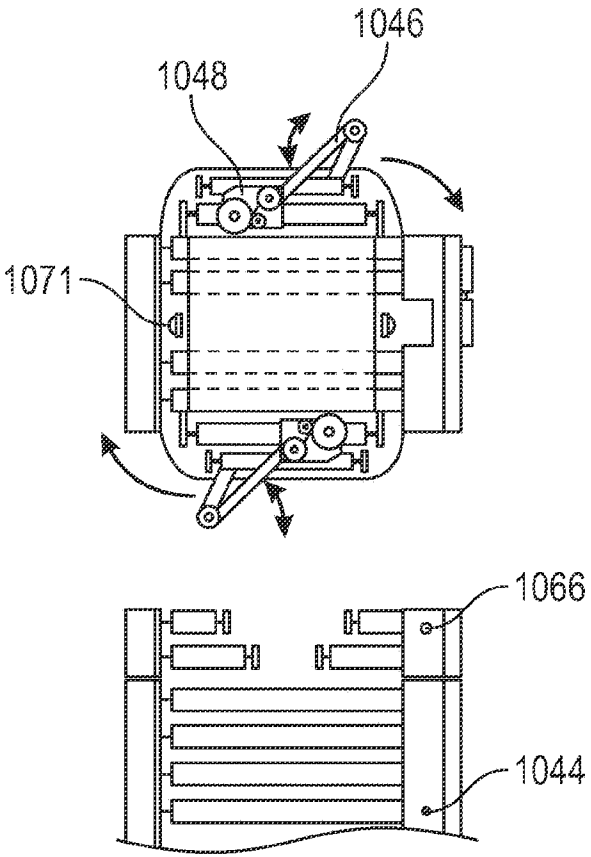
FIG. 20E is a top view of the system of FIGS. 20A & B, according to an embodiment.
Figure 20D:
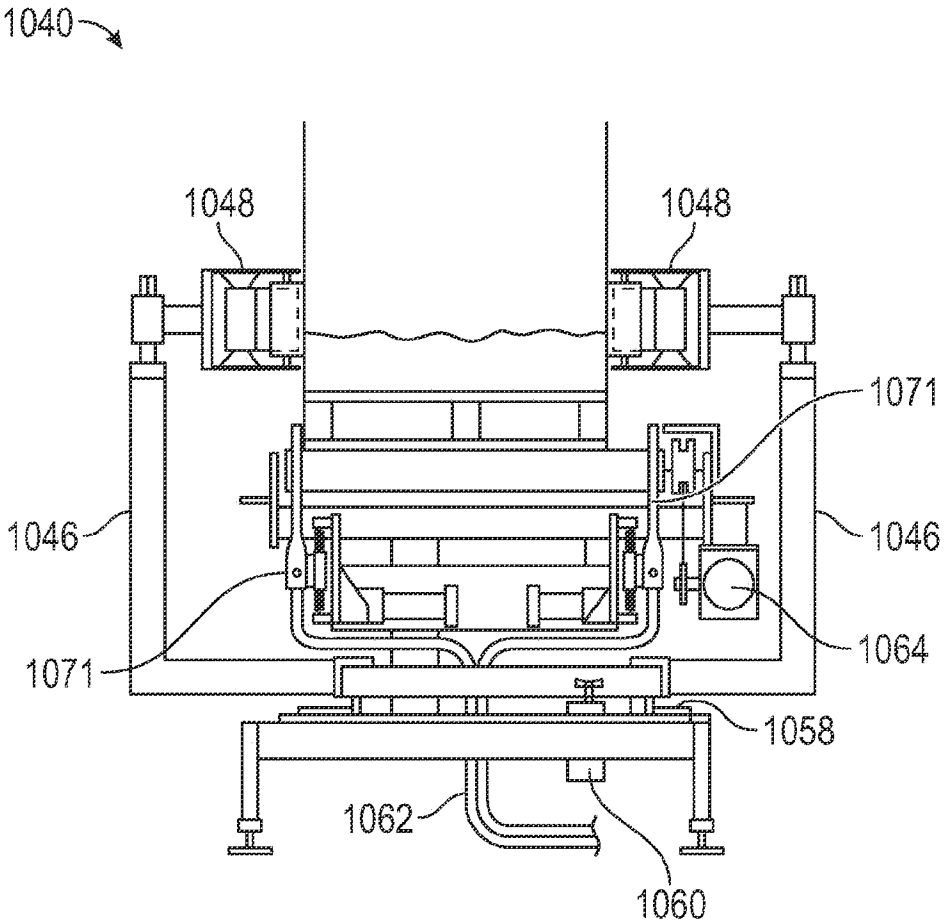
FIG. 20D is a partial front view of the system of FIG. 20A, according to an embodiment.

FIGS. 20C-20E illustrate another embodiment of the 1040 system integrated into a pallet transit conveyor 1044, which uses a dual taper with articulating arms apparatus 1046 connected to a rotating turntable drive 1058 driven by the turntable motor 1060 and gear box 1064. Attached to the taper arm is a wrapping and/or a taping device 1048 for adhering and sealing the bottom sheet to a bag or side sheet, and a foam pressure roller 1050 to prevent gas leaking during injection and to enhance the enclosure sealing process as with FIG. 20C, according to an embodiment.

FIG. 20C shows a gas injection nozzle 1071 inserted between the bottom sheet and a bag or side wrap for enclosing the pallet of stacked goods. Hoses 1062 are coupled to the nozzles 1071. FIG. 20C shows an alternative to the track drive shown in FIG. 20A and FIG. 20B and may be a rotating dual arm apparatus for wrapping or taping the bottom sheet to a bag or side sheet and a foam pressure roller to prevent gas leaking during injection and to enhance the enclosure sealing process as with FIG. 20A and FIG. 20B.

FIG. 20D is a partial front view of the system with an example of how components of the gassing, wrapping/taping, and sealing apparatus are integrated under the pallet transfer conveyor equipment, according to an embodiment. FIG. 20E is a top view of the system options of FIGS. 20A-20D which includes a slot opening in the pallet transfer conveyor with bolt on conveyor extensions 1066 to allow the rotating or track or arm taping & sealing devices to pass through the slot openings when operating according to an embodiment. FIG. 20E shows a system that includes a slot opening in the pallet transfer conveyor to allow the rotating or track taping & scaling devices to pass through when operating.

Figure 21:
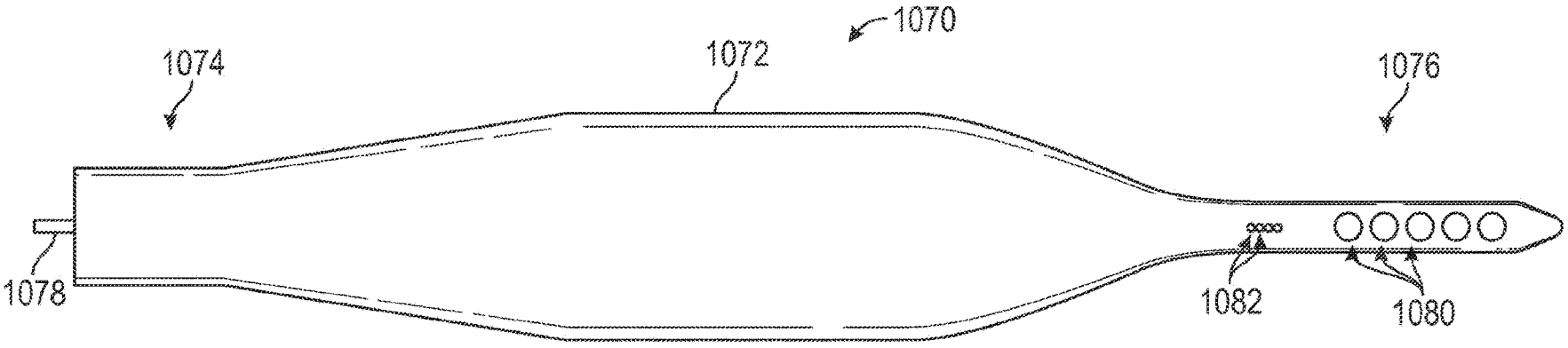
FIG. 21 is a schematic, top view of a nozzle, according to an embodiment.

Referring to FIG. 21, a top schematic view of an exemplary nozzle 1070 is shown. The nozzle 1070 may be used with any of the embodiments to create a modified atmosphere described herein. The nozzle 1070 may be a blower nozzle configured to deliver a functional treatment/functional substance to the interior of the sealed enclosure. The nozzle 1070 may have a body 1072 with an inlet end 1074 and an outlet end 1076. At the inlet end 1074 there may be a connection 1078 for connecting to a hose, the hose being able to deliver the functional substance/functional treatment to create the modified atmosphere. The outlet end 1076 may include one or more ports 1080. The one or more ports or holes 1080 may allow for delivering a gas, and a functional substance to the interior of the wrapped enclosure or the bagged enclosure. Although five ports 1080 are shown, more or fewer may be provided. The ports or holes in a nozzle are positioned to help facilitate, direct the flow, and improve the effectiveness of a vacuum and/or distribution of a gas injection, and/or a treatment process. Holes, ports, openings, or vents on the nozzle are usually on the top or at the tip of the nozzle, on the packaging facing side and/or on the sides of the nozzle to improve effectiveness. The outlet end 1076 may include one or more ports 1082. The nozzle 1070 may be formed of metal.

The holes in the nozzle may be positioned to help facilitate, direct the flow, and improve the effectiveness of a vacuum and/or distribution of a gas injection, and/or a treatment process. Holes, openings, or vents on the nozzle are usually on the top or at the tip of the nozzle, on the packaging facing side and/or on the sides of the nozzle to improve effectiveness. (These comments may apply to all nozzles).

Figure 22:
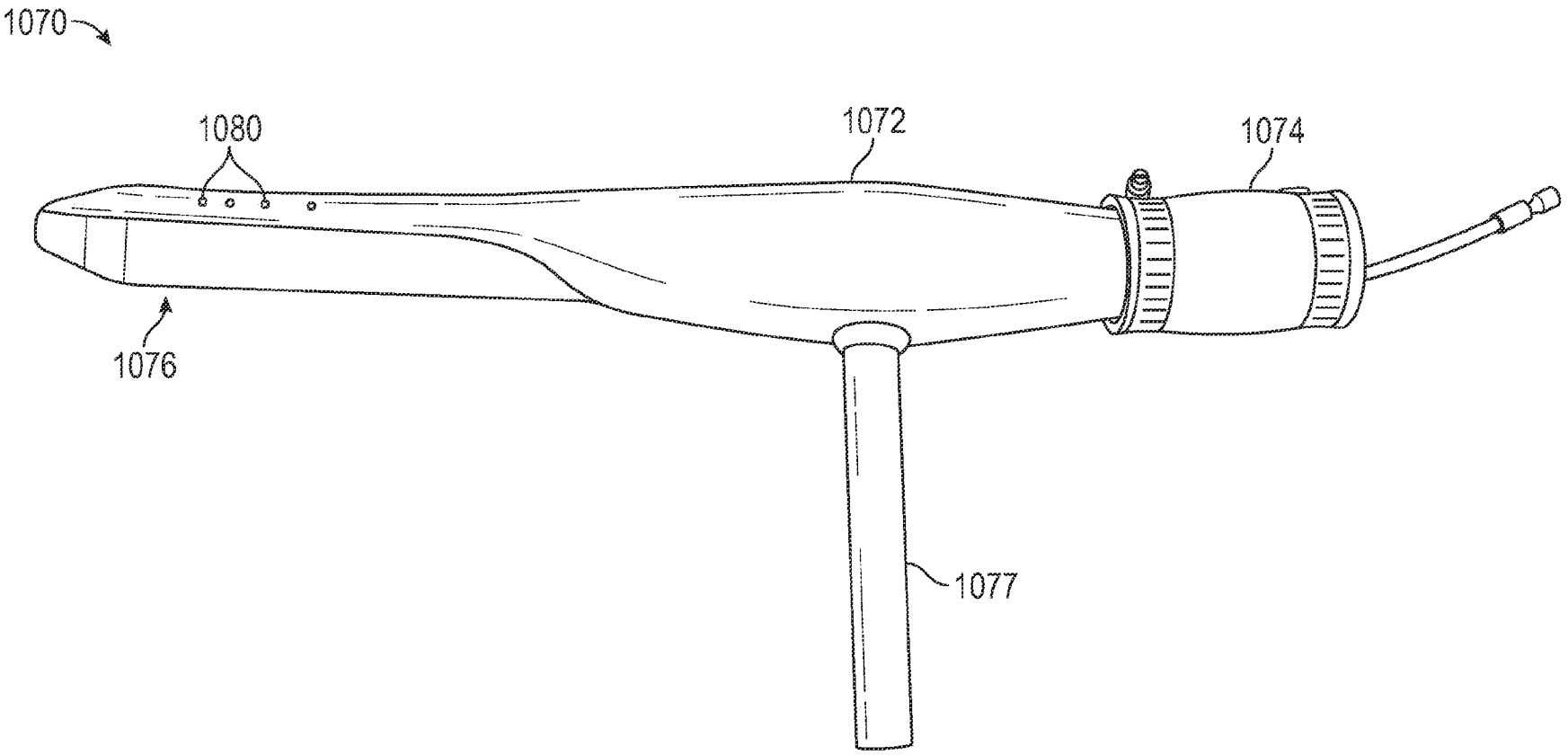
FIG. 22 is a schematic, perspective view of a nozzle, according to an embodiment.

FIG. 22 shows the nozzle 1070 in perspective view. As mentioned, the nozzle 1070 may include a body 1072, an inlet end 1074 and an outlet end 1076. The outlet end 1076 may include one or more ports 1080. The nozzle may include a connection 1077 for coupling to a support stabilizer or for holding by an operator.

With respect to FIGS. 23A-23D, a perspective view of an exemplary nozzle 1090 is shown. The nozzle 1090 may be a vacuum nozzle configured to remove air from the interior of the sealed enclosure. The nozzle 1090 may include one or more sensor tubes 1092. The nozzle 1090 may include a connection 1094 for coupling to a hose (not shown) and an opening 1096. The environment within the sealed enclosure (e.g., oxygen, air, etc.) may be removed from the sealed enclosure through the opening 1096, may then flow through the nozzle body 1098 and through the connection 1094 to the hose.

Figure 23A:
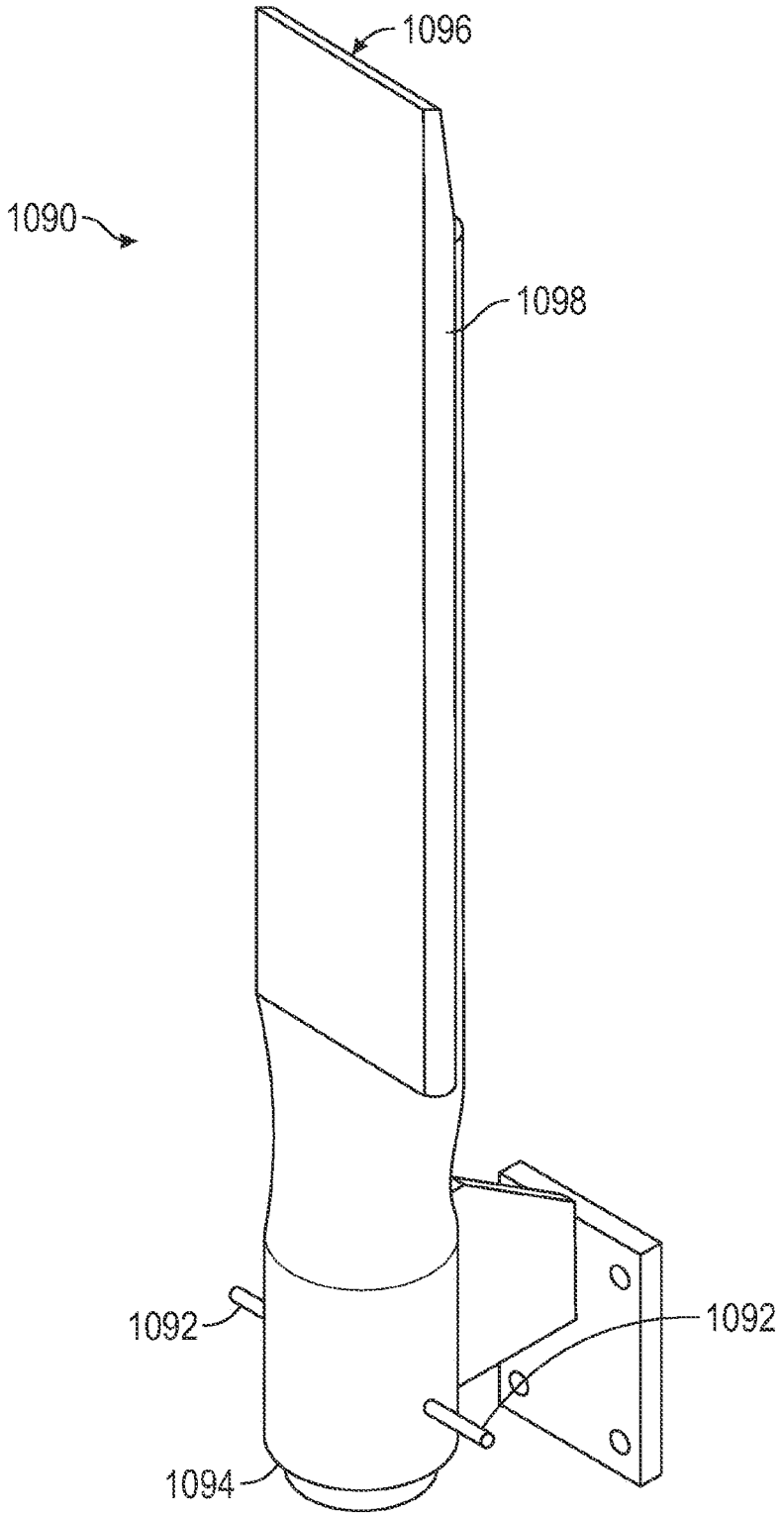
FIG. 23A is a perspective view of a nozzle, according to an embodiment.
Figure 23B:
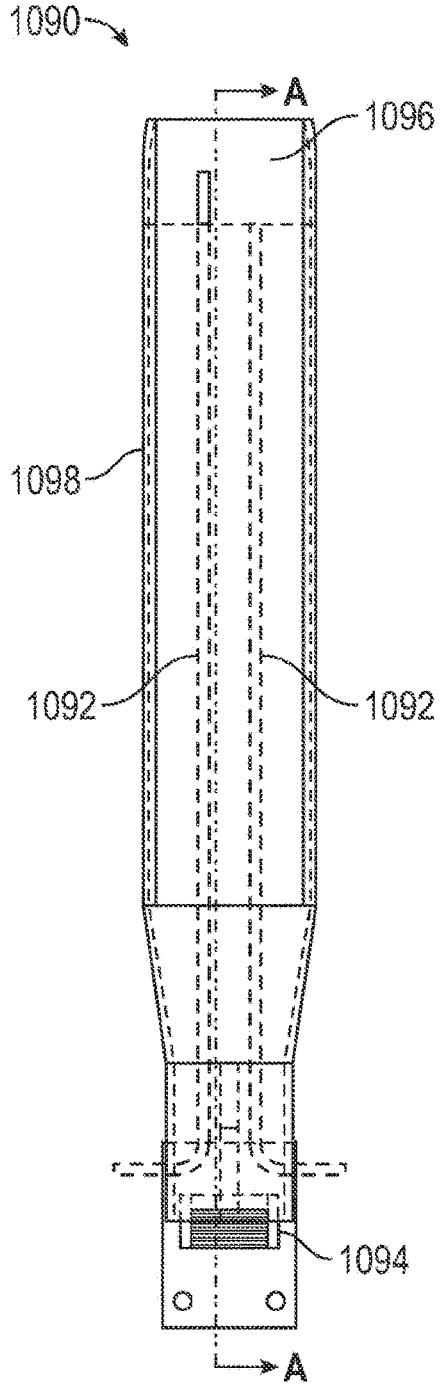
FIG. 23B is a front view of the nozzle of FIG. 23A, according to an embodiment.
Figure 23C:
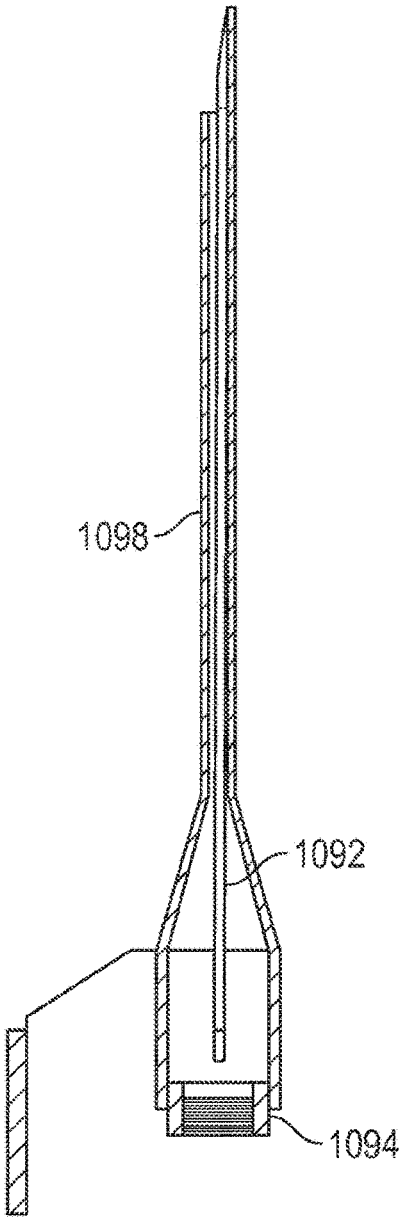
FIG. 23C is a side cross-sectional view of the nozzle of FIG. 23A, according to an embodiment.
Figure 23D:
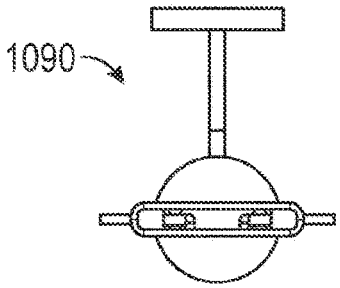
FIG. 23D is a top view of the nozzle of FIG. 23A, according to an embodiment.

Referring to FIGS. 23B and 23C, the sensor tubes 1092 may be left to extend into the opening 1096 and then may be tack welded inside the nozzle body 1098. After securing, the sensor tubes 1092 may be cut flush with the opening 1096.

The sensor tubes 1092 may be used to collect samples within an enclosure, this may include but is not limited to: pressure (negative or positive), atmospheric levels of gas O2, CO2, etc., product specific conditions or traits, the levels of microorganisms, specific treatment and substance levels, as well as humidity or other environmental parameters. the sample tubes feed sensors and collection devices with monitoring measurement capabilities within a module on the controller. The information is collected, analyzed, recorded and/or utilized immediately to control the system, process and apparatus. The information may also be stored for later use by the system. this may involve manual analysis, learning, and decision making to improve the system, methods, and apparatus or machine learning or AI to provide continuous improvement and outcomes. (These comments apply to all systems, nozzles and FIGS which include a vacuum and/or sensor lines/tubes and that provide feedback to the controller.)

The nozzle 1090 may be on an operator side of the wrap station. For each wrap station, at least one blower nozzle 1070 and one vacuum nozzle 1090 may be needed. The nozzle 1080 may be a wrapper gas injection snorkel without sensing lines. The nozzle 1090 may be a vacuum snorkel with sensing lines. The sensor lines or tubes 1092 within the nozzle (snorkel) are used to collect samples within the enclosure, this may include but is not limited to: pressure (negative or positive), atmospheric levels of gas O2, CO2, etc., product specific conditions or traits, the levels of spoilage, decay, pathogens, or microorganisms, specific treatment and substance levels, as well as humidity or other environmental parameters. The sample lines or tubes feed sensors and collection devices with monitoring measurement capabilities within a module on the controller. The information is collected, analyzed, recorded and/or utilized immediately to control the process and/or stored for later use by the system. This may entail manual analysis, learning, and decision making to improve the system, methods, and apparatus or machine learning or artificial intelligence (AI) to provide continuous improvement and outcomes. The nozzles 1070 and 1090 may be attached to pneumatic cylinders that travel up, down, inward, and outward with respect to the wrapped pallet to achieve the desired alignment with the package to create the modified atmosphere.

Figure 24:
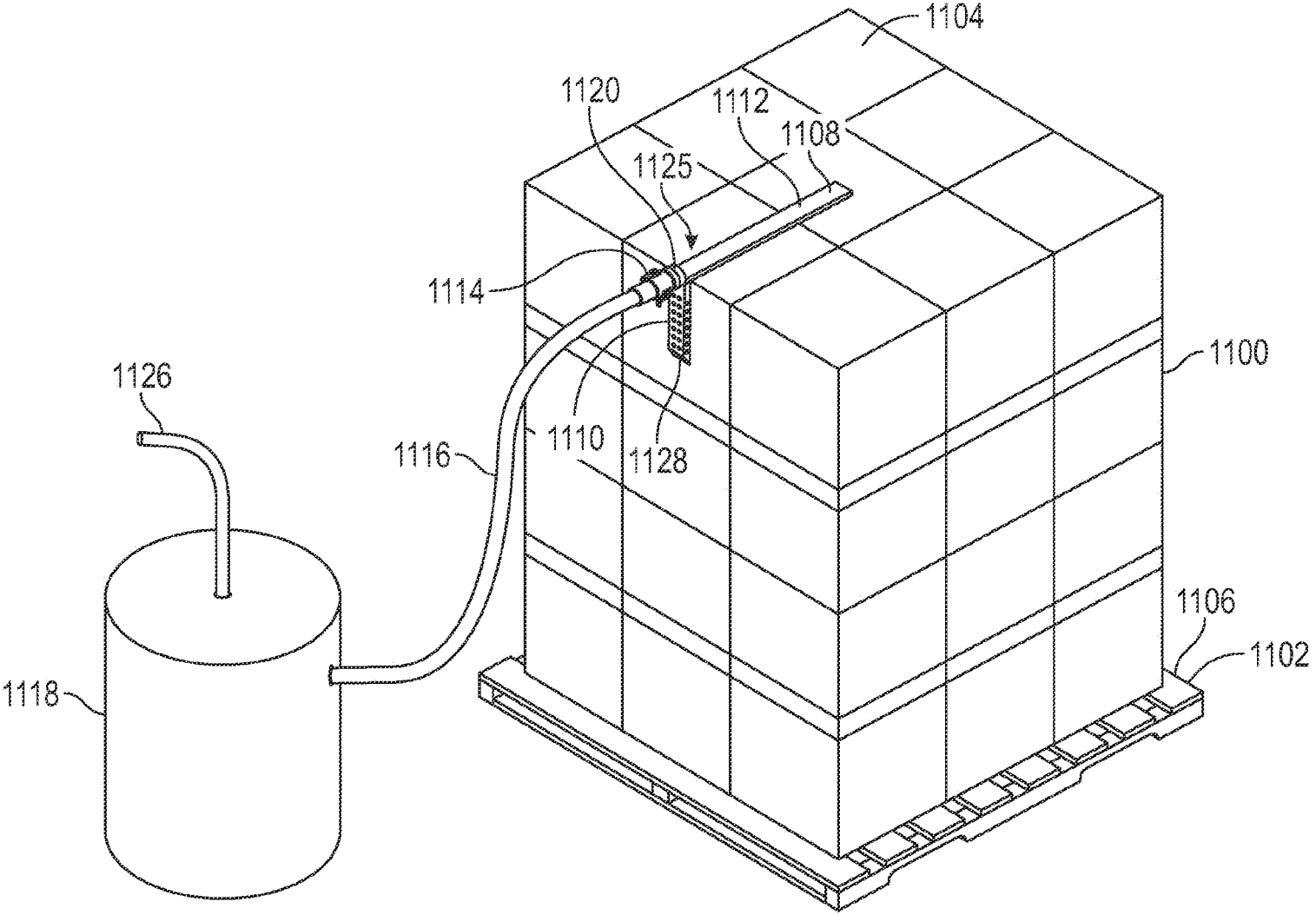
FIG. 24 is a view of a modified atmosphere system, according to an embodiment.
Figure 25:
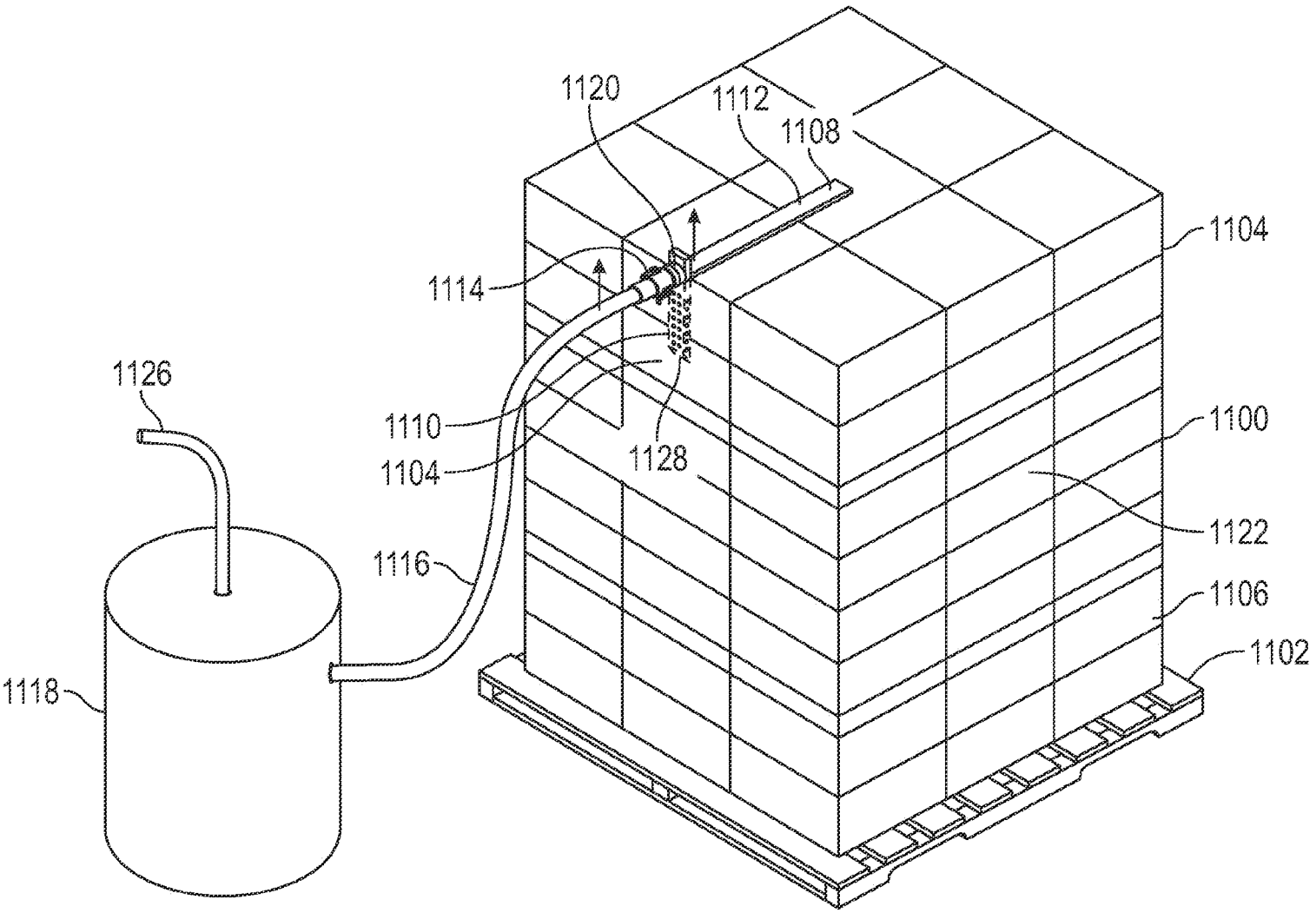
FIG. 25 is a view of a modified atmosphere system, according to an embodiment.
Figure 26A:
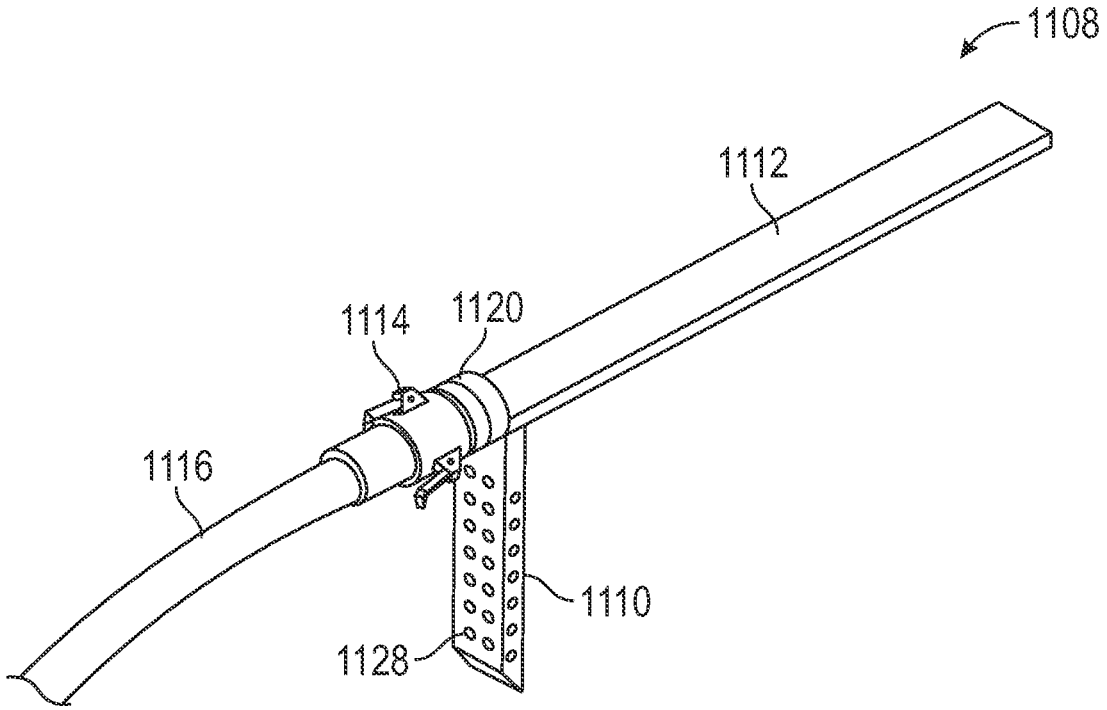
FIGS. 26A and 26B are views of a nozzle for a modified atmosphere system, according to an embodiment.
Figure 26B:
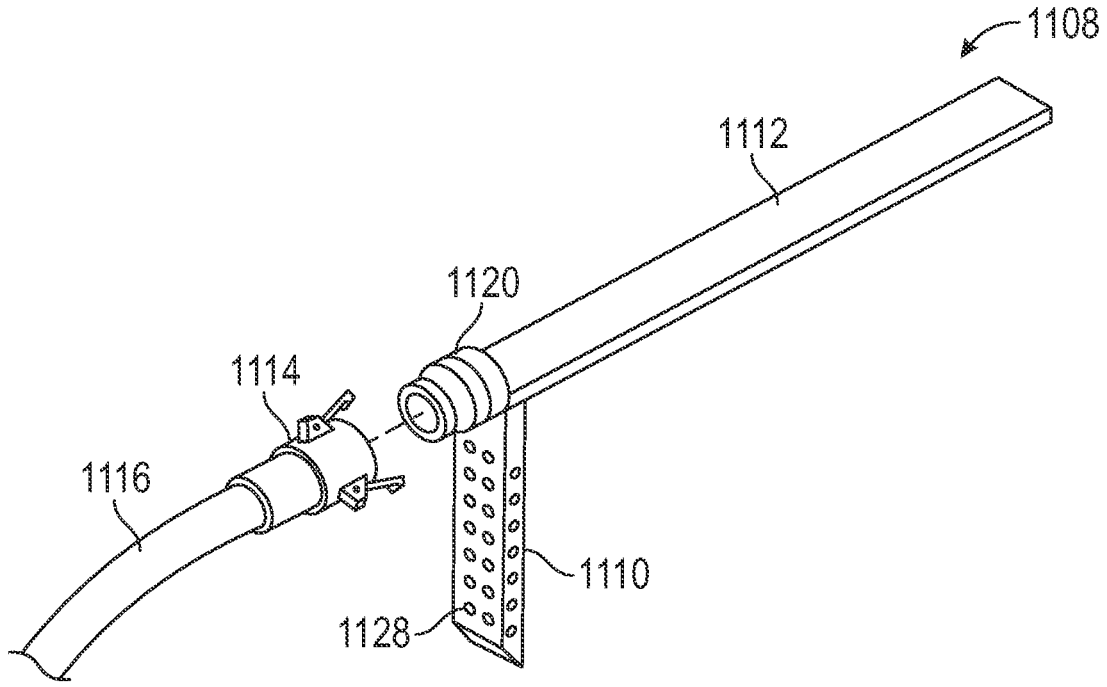
Figure 27:
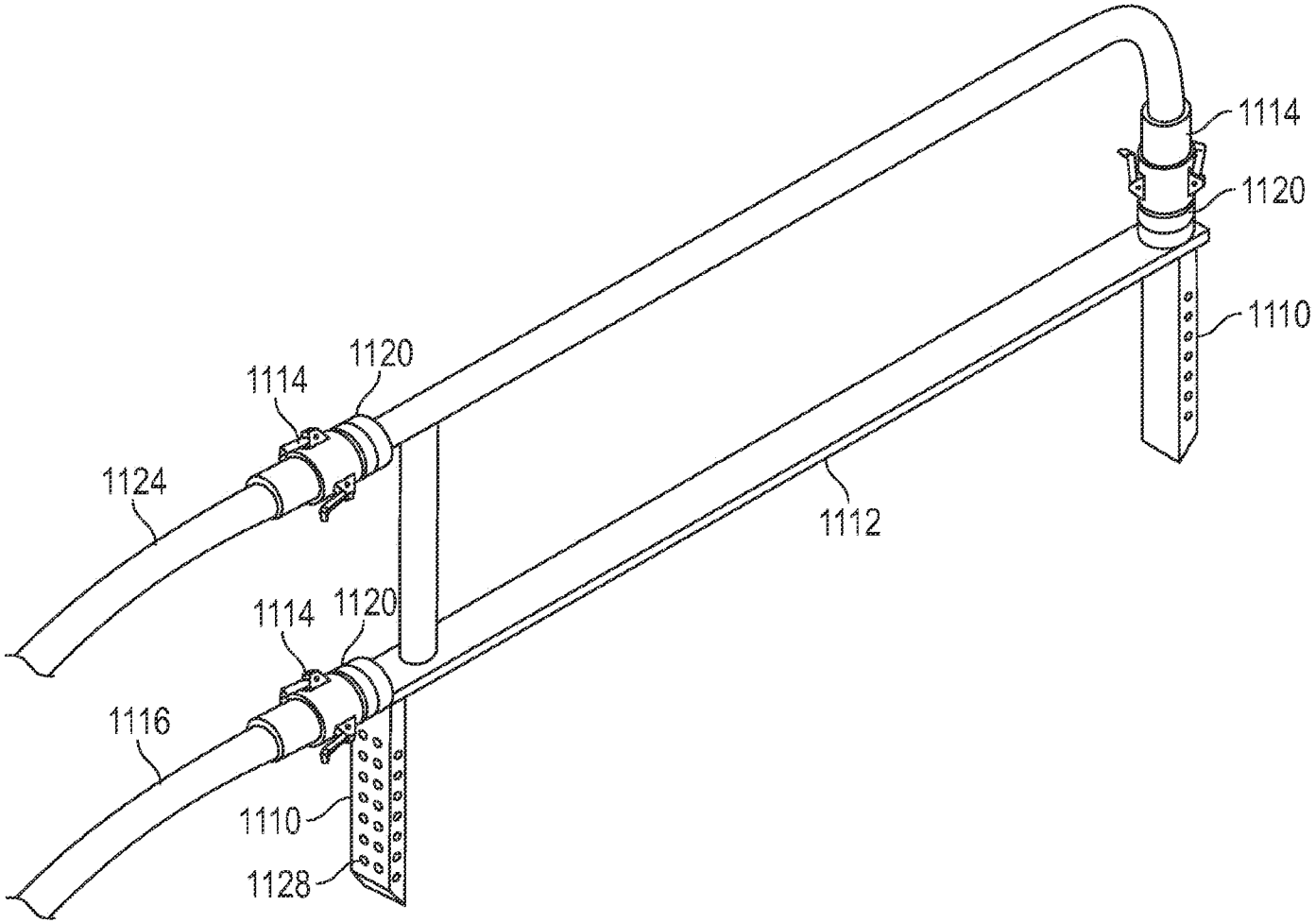
FIG. 27 is a view of a nozzle for a modified atmosphere system, according to an embodiment.
Figure 28:
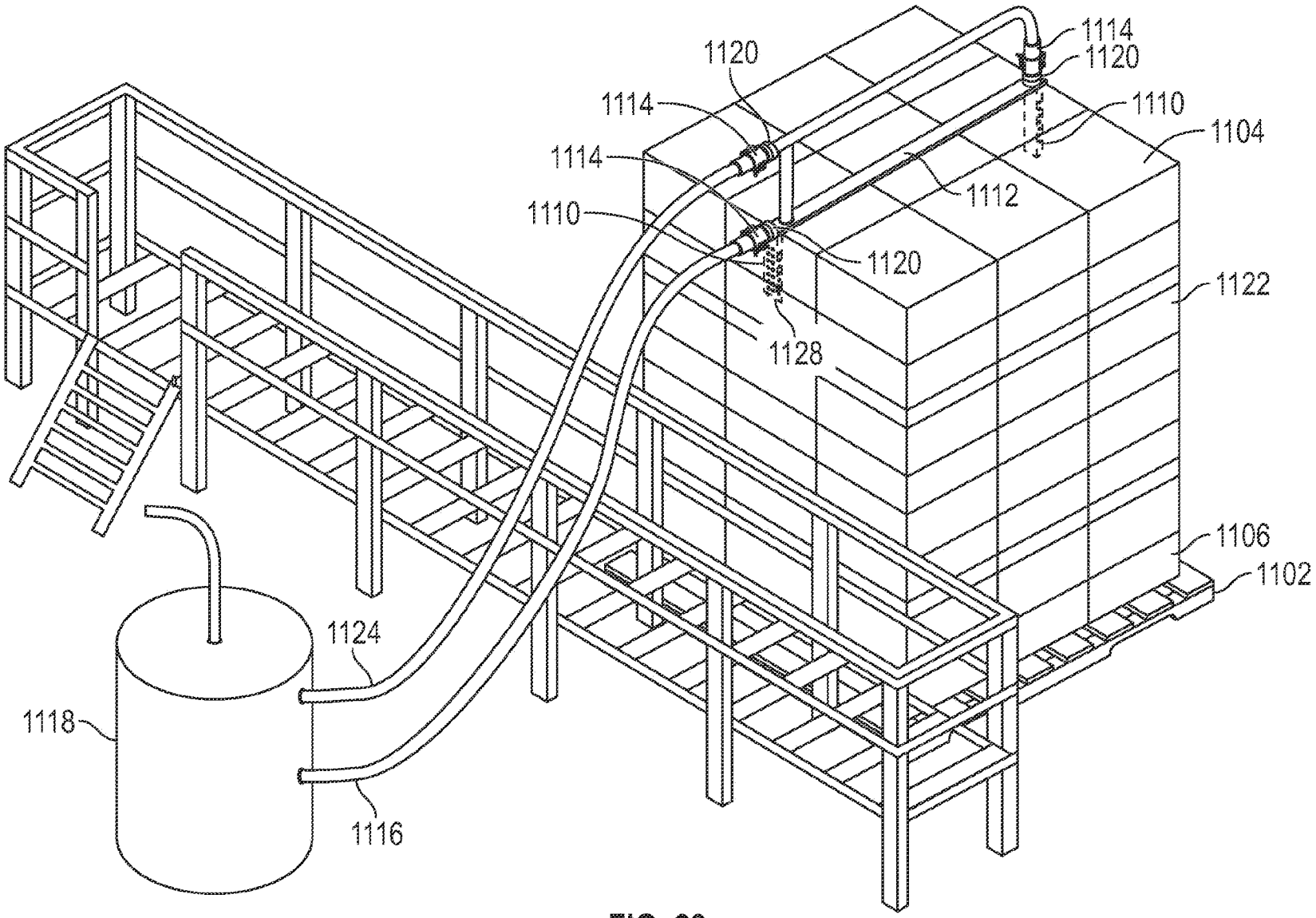
FIG. 28 is a view of a modified atmosphere system, according to an embodiment.

Referring to FIGS. 24-28, exemplary modified environment systems are illustrated. FIGS. 24-26 show embodiments of a manifold for a single injection nozzle that may be used for creating a modified atmosphere. FIGS. 27 and 28 embodiments of a manifold for a dual injection nozzle that may be used for creating a modified atmosphere. The exemplary embodiments may be used with manual or semi-manual pallet wrapping. Stacked goods 1100 may be placed on top of pallet 1102. Top sheet 1104 and bottom sheet 1106 may be placed on the top and bottom of stacked goods 1100, respectively, in any of the aforementioned manners. Top sheet 1104 and bottom sheet 1106 may be placed at the top and bottom ends of stacked goods 1100 either manually or by automated means. Top sheet 1104 may be a flat piece of material that completely covers the top of the stacked goods 1100, and the ends of top sheet 1104 may overhang the sides of the stacked goods 1100. Bottom sheet 1106 may be a flat piece of material that completely covers the bottom of stacked goods 1100 and/or the pallet 1102 and the ends of bottom sheet 1106 may slightly cover the sides of the stacked goods 1100. The shape of top sheet 1104 and bottom sheet 1106 is not limited. Top sheet 1104 and bottom sheet 1106 may be shaped and/or folded to contour the shape of stacked goods 1100 to minimize gaps. Top sheet 1104 and bottom sheet 1106 may be taped or adhered to stacked goods. Alternatively, top sheet 1104 and bottom sheet 1106 may be self-adhered to the stacked goods and/or adhered to the pallet wrap.

The system may include a manifold 1125. The manifold 1125 may include piping or hose(s) 1116, coupler(s) 1114, nozzle finger(s) 1110, and stabilizing support bar(s) 1112. As shown in FIGS. 20 and 21, the nozzle 1108 may be placed on the top end of stacked goods 1100 over the top sheet 1104. Nozzle 1108 may include a stabilizing support bar 1112 that is placed on top of top sheet 1104. Nozzle 1108 may include a nozzle finger 1110 formed at an angle to the stabilizing support bar 1112. As shown, the nozzle finger 1110 may be formed at a right angle to the stabilizing support bar 1112. Other angles are contemplated in accordance with the principles of the disclosure. Nozzle finger 1110 may be formed at an angle in order to contour to an irregularly shaped stacked goods 1100. Nozzle finger 1110 may be formed at a predetermined angle to create a space between the top sheet 1104 and wrap 1122 or to otherwise facilitate vacuuming and/or gas injection within the internal volume of the sealed enclosure. The nozzle may be attached at a right angle with the stabilizing support bar, or other support structure (e.g., any mechanical, hydraulic, or robotic apparatus for holding the nozzle or manifold components). A right angle may facilitate efficient low friction insertion and removal from within the sealed enclosure. The nozzle may be attached at any angle that matches or closely matches the shape of the product, the packaging, or both the product and the packaging. By matching or closely matching the shape, the system may achieve an efficient operation.

Top sheet 1104 may overhang the sides of stacked goods 1100 such that nozzle finger 1110 may be placed against top sheet 1104. As shown in FIGS. 26A and 26B, nozzle finger 1110 may include a plurality of holes 1128 that may be used to vacuum air or inject a modified atmosphere under the wrapping. Nozzle finger 1110 may include one or more internal channels or pathways leading to the holes 1128 for passage of gas for vacuuming and/or injecting gas or substance treatments. Holes 1128 may be located on one or more faces of nozzle finger 1110 and may be configured to optimize the vacuum, injection, and treatment processes. Nozzle finger 1110 may be relatively flat or may have a three-dimensional shape to facilitate air flow. Stabilizing support bar 1112 and nozzle finger 1110 may include a relatively flat undersurface to approximately conform to the shape of stacked goods 1100.

According to embodiments, stabilizing support bar 1112 may be shaped to conform to an irregularly shaped stacked goods 1100. Stabilizing support bar may be dimensioned and weighted to hold nozzle 1108 in place while stacked goods 1100 are wrapped. Nozzle 1108 may connect to hose 1116 through coupler 1114 and fitting 1120 to create an airtight quick connect seal. Coupler 1114 may be, for example, a camlock fitting with a gasket. Conventional cam lock fittings may be used, or other quick connections known in the art. Fitting 1120 allows for quick disconnect (FIG. 26B) and connect (FIG. 26A) of nozzle 1108 with tube or hose 1116. Hose 1116 may be attached to gas/vacuum controller 1118, which may be connected to a vacuum/gas source to allow for air to be removed from the inside the sealed enclosure and/or a modified atmosphere may be injected into the sealed enclosure. Alternatively, separate vacuum and gas lines may connect and disconnected to nozzle 1108 at fitting 1120.

As shown in FIG. 21, wrap 1122 may be wrapped around the sides of stacked goods 1100 to create a sealed enclosure. According to embodiments, wrap 1122 may be wrapped manually or by an automated wrapping system. Wrap 1122 may be wrapped around the sides of stacked goods 1100 in a continuous manner, such that each successive wrap around stacked goods 1100 slightly overlaps with the previous wrap. Wrap 1122 may be further secured to the outside of stacked goods 1100 using tape or adhesive or may be self-adhering, or combinations thereof. Wrap 1122 may be either taped or adhered or self-adhered to top sheet 1104 and/or bottom sheet 1106. In this manner, top sheet 1104, bottom sheet 1106, and wrap 1122 may form an airtight sealed enclosure around stacked goods 1100.

Wrap 1122 may cover nozzle finger 1110 such that nozzle finger 1110 may be placed between wrap 1122 and the overhanging section of top sheet 1104. Air may be vacuumed from inside the sealed enclosure (e.g., the space between the wrap 1122 and the stacked goods 1100) through the holes on nozzle finger 1110 and/or gas as well as substance treatments may be injected inside the sealed enclosure (e.g., the space between the wrap 1122 and the stacked goods 1100). The removal of air and/or the injection of gas may create a modified atmosphere within the sealed enclosure. Stabilizing support bar 1112 may not be covered by wrap 1122. The stabilizing support bar 1112 may facilitate the placement of the nozzle 1108 during wrapping and subsequent removal of the nozzle 1108 after creation of the modified atmosphere. According to embodiments, when a modified atmosphere has been created inside of the sealed enclosure, nozzle finger 1110 may be removed from underneath wrap 1122. For example, nozzle finger 1110 may be removed by pulling and withdrawing the nozzle 1108 from in between the wrap 1122 and top sheet 1104. As the nozzle finger 1110 is withdrawn, the wrap 1122 and top sheet 1104 may come into contact and may seal against each other closing the nozzle opening left behind as the nozzle 1108 is withdrawn. Wrap 1122 may be taped or self-adhered to top sheet 1104 to maintain the modified atmosphere inside of the sealed enclosure.

FIGS. 27 and 28 illustrate an exemplary embodiment of a dual nozzle system. The dual nozzle system may include two injection nozzles 1108. Embodiments having more than two nozzles are contemplated. The nozzle fingers 1110 of each nozzle 1108 may be placed on opposite sides of the stacked goods and are connected by stabilizing support bar 1112. Stabilizing support bar 1112 may be placed on top of top sheet 1104. According to embodiments, stabilizing support bar 1112 may be adjustable to accommodate for different sizes of stacked goods. The dual nozzle system may allow for faster vacuum of air and/or injection of a modified atmosphere. Additional nozzles may be used and positioned in accordance with the dimensions of the stacked goods. According to embodiments, hose 1116 may be a vacuum line and hose 1124 may be a gas line such that one nozzle finger 1110 removes air, while the second nozzle finger 1110 may inject a modified atmosphere and/or a substance treatment. According to embodiments, hose 1116 and hose 1124 may both be vacuum lines or both gas injection lines. Hoses 1116 and 1124 may connect to a gas and/or vacuum and/or substance treatment controller, which may be connected to a gas and/or vacuum and/or substance source. According to embodiments, coupler 1114 may be detached from fitting 1120 in order to switch gas lines, for example, to blend various gases to create a modified atmosphere. Coupler 1114 may be a quick connect coupler or camlock to provide for an airtight quick connect seal.

Figure 29:
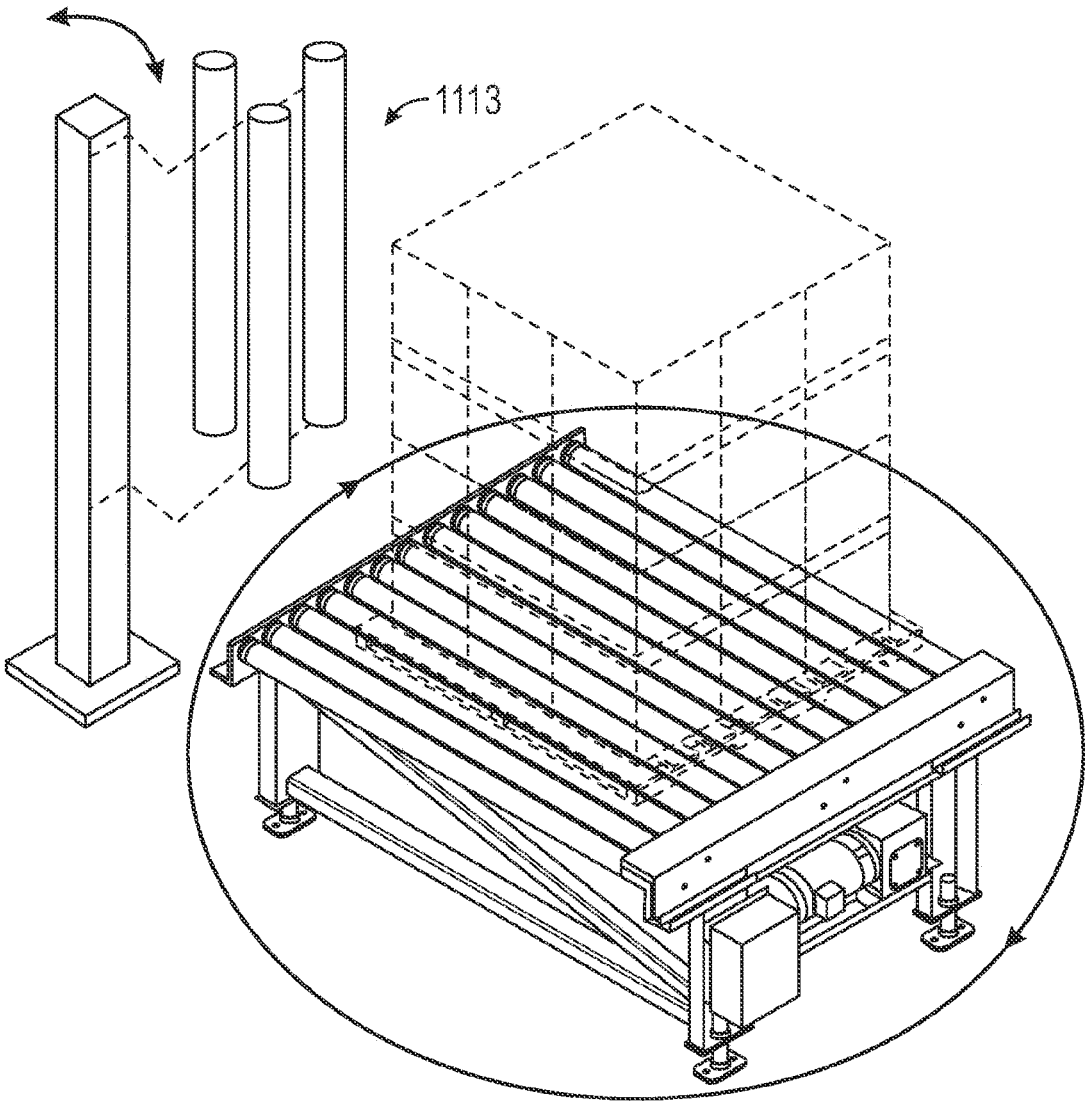
FIG. 29 is a perspective view of a dispenser with rollers, according to an embodiment.
Figure 30A:
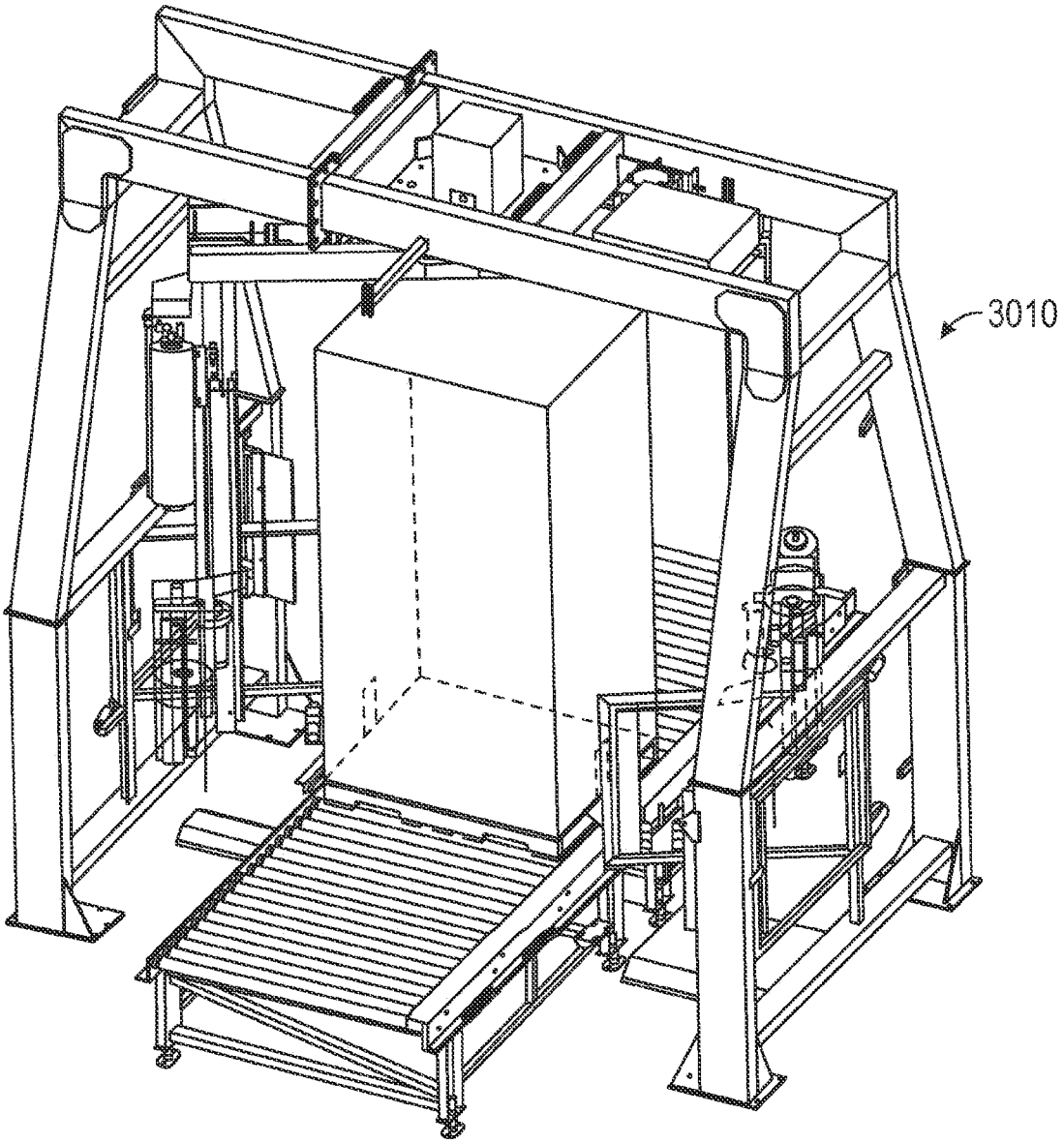
FIGS. 30A-30F are views of a pallet wrapper with a snorkel, according to an embodiment.
Figure 30B:
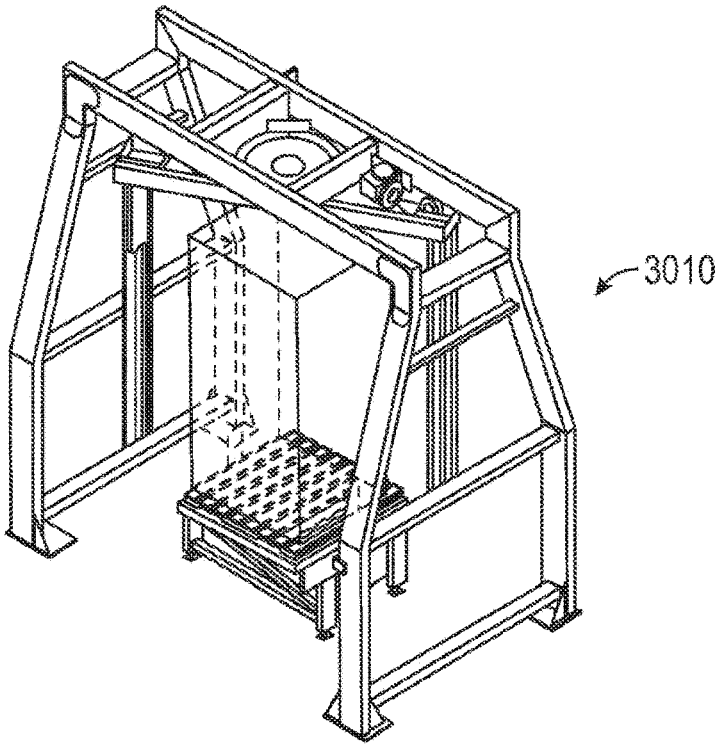
Figure 30C:
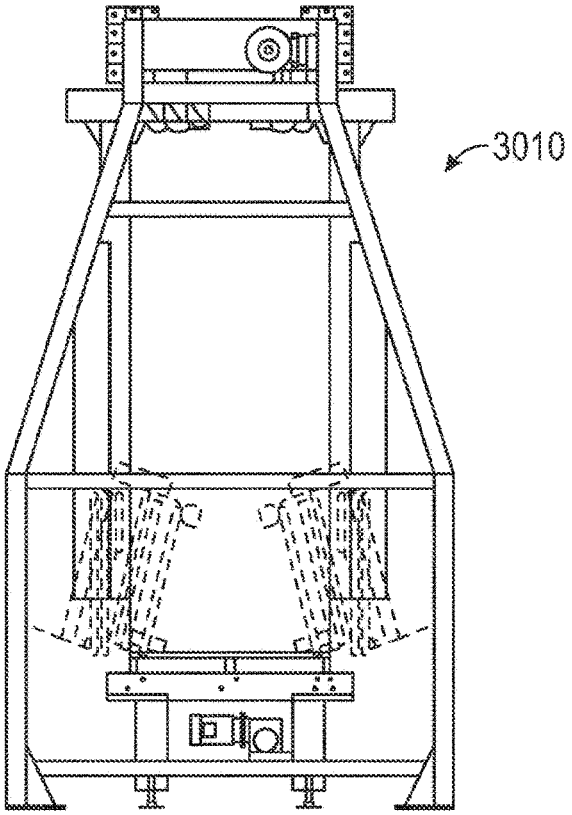
Figure 30D:
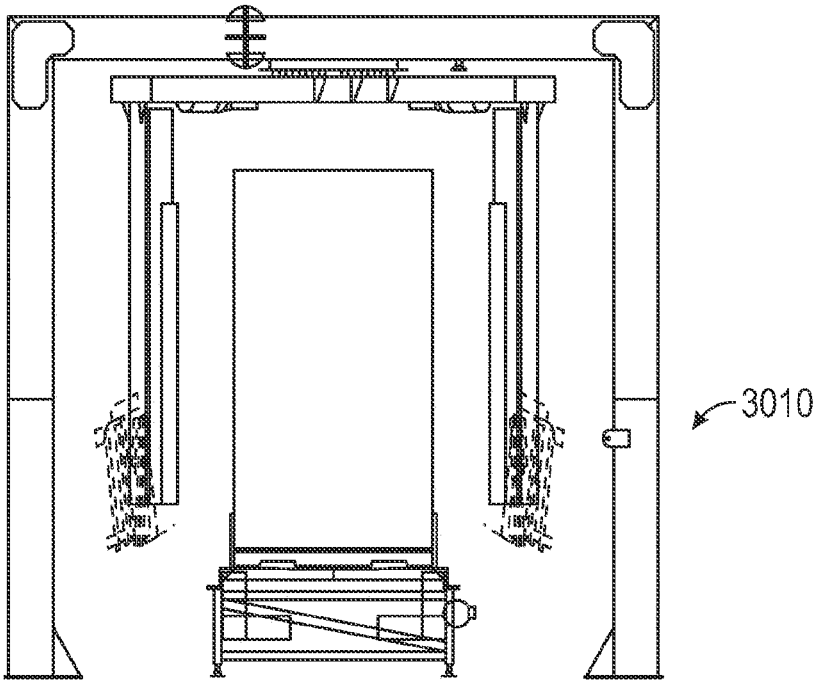
Figure 30E:
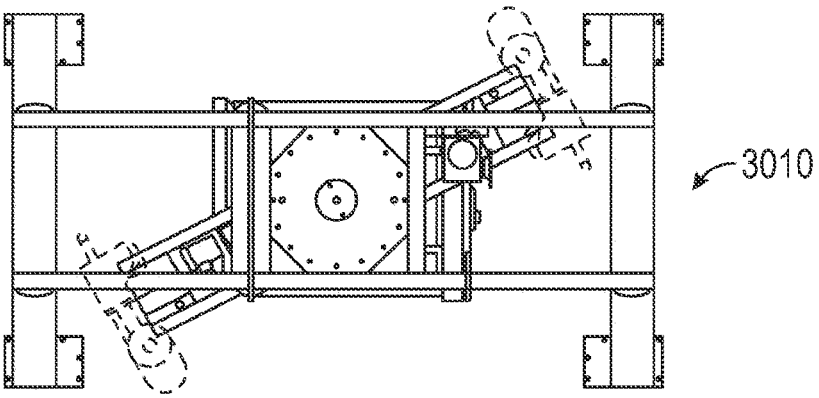
Figure 30F:
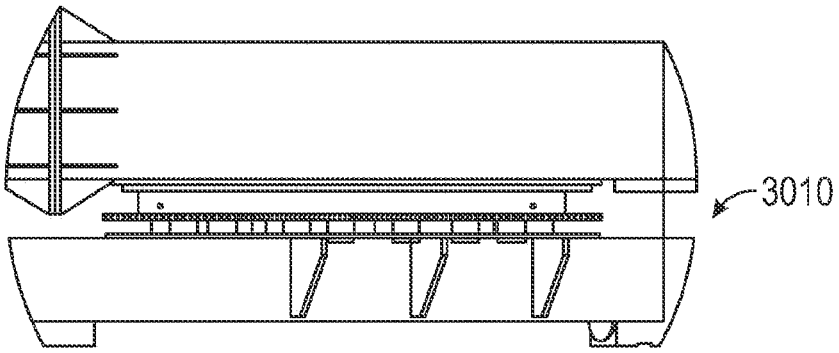

As shown in FIG. 29, one or more rollers 1113, such as pressure or foam rollers may be provided in conjunction with the top sheet dispenser, bottom sheet dispenser, or pallet wrapper to secure the respective sheets together on the pallet of stacked goods. The one or more rollers may be a pressure roller around the pallet of stacked goods for one or more sides. For example, the rollers may be around the pallet for two sides, four sides, or more. The roller may be a pneumatic or air pressure roller, a spring-loaded pressure roller, or robotic servo motor controlled or a combinations thereof. The roller may include one or more rollers (preferably three rollers for transitioning around the sides and corners of the wrapped pallet of stacked goods) pushing on the sheets against the sides and/or at the corners of the pallet of stacked goods (e.g., creating a pressure triangle) to enhance the seal of the sheets as the turntable conveyor rotates at least one revolution.

FIGS. 30A-30F show an automated pallet wrapper 3010 that may include one or more snorkels or nozzles. The one or more nozzles or snorkels may inject and/or vacuum gases. The snorkel may include one or more sensing lines that may sample gases or pressure or substances or a combination thereof. The information obtained may be analyzed to obtain the optimal treatment per pallet. The snorkel may include a manifold. The manifold may include one or more hoses, one or more snorkels and/or nozzles, one or more blending chambers or combinations thereof. Pneumatic cylinders, robotic arms, motorized devices, and/or combinations thereof may move the nozzles or snorkels (e.g., in, out, up down) during automated wrap cycles. The nozzles or snorkels may be controlled manually.

The manifolds, nozzles, stabilizing support bars or mountings, and hoses described herein may be adjustable. That is, they may be moved laterally (e.g., horizontally) and/or vertically and/or angularly, to adjust the position of the manifold. In this manner, the stabilizing support bar and nozzle may be placed in the desired position on the stacked goods to achieve a secure position and optimal position for injecting and/or vacuuming gases. The nozzles may include quick connect and disconnect arrangements to allow for customization to a stacked product on a pallet. The nozzle and/or manifold may be moved, placed, or removed manually or automatically (e.g., mechanically). Although described herein as a stabilizing support bar, any support structure, such as, for example, but not limited to, mechanical, hydraulic, or robotic apparatus for holding the nozzle or manifold components, is contemplated.

The system described herein for wrapping a pallet of stacked goods and providing a modified environment as well as product specific treatments within the wrapped pallet may include any number of combinations of the components described herein, in any order, in a manual, semi-automatic, or automatic manner, and in any of the described embodiments, or combinations thereof. The desired combination of manual, semi-automatic, or automatic system may be based on need, cost, speed, resource requirements, throughput of the system, or combinations thereof.

The modified atmosphere of the present disclosure may include controlling functional substances or ingredients, such as, for example, oxygen, carbon dioxide, sanitization, aroma, ethylene, or combinations thereof within the sealed enclosure (e.g., within the space enclosed by the wrap). The modified atmosphere may be delivered by a gas or industrial gas. Thus, the modified atmosphere of the present disclosure allows for the stacked products enclosed by the wrap to be treated for a particular issue or objective (e.g., sanitizing the goods, providing aroma for the goods, etc.). By providing the modified atmosphere to the entire pallet of stacked goods, the pallet may be treated as a whole without the need for a sachet or other smaller package to be provided for each individual clamshell, consumer package, or box of product. That is, the modified atmosphere prevents, for example, the need to include an individual functional substance (e.g., sanitizing substance) to each individual container of product on the pallet, rather applies the functional substance to the entire pallet of stacked goods. This may reduce cost and increase efficiency in the packaging, stacking, storing, and shipping of goods. Automating the process as described herein, may further enhance the efficiency and lower the cost by rendering the process easier to treat pallets of packages instead of each individual package. There are other advantages to separating the functional substances from the contents within the individual packages or clamshells of perishable products. Those advantages include but are not limited to controlled application following harvest, safety or handling by consumers, timing of addition of functional substance, disposal by warehouse or retail personnel instead of consumers.

The modified atmosphere of the present disclosure may include at least one gas blended with another gas and/or with a functional substance. The blending may occur prior to the sealed enclosure or within the sealed enclosure. The blending may occur in a hose, a nozzle, a blending box or chamber, or any combination thereof. The hose may include tubes or channels to blend. The system may combine multiple streams of gas and/or functional substances within the hose to blend.

In the disclosure herein, stacked goods may include, for example, boxed or prepacked produce. The top sheet, bottom sheet, side or wrap sheet, or any combination thereof may be a flexible or rigid plastic film, such as high-density polyethylene, low-density polyethylene, or polypropylene, for example. The top sheet, bottom sheet, side or wrap sheet, or any combination thereof may be natural, compostable materials. The top sheet, bottom sheet, side or wrap sheet, or any combination thereof may be a plastic sheet. The top sheet, bottom sheet, side or wrap sheet, or any combination thereof may be made of high-density polyethylene, low-density polyethylene, or polypropylene, for example. The wrap sheet may be a stretch film as described in U.S. patent application Ser. No. 15/815,208 Method and Systems for Applying Stretch Films/Plastic Films at a Controlled Temperature, hereby incorporated by reference in its entirety. The top sheet, bottom sheet, or wrap sheet, or any combination thereof may be perforated in a way to enable some controlled intrusion of outside air and release of the gasses within the pallet to achieve target levels of oxygen, nitrogen, carbon dioxide, and moisture. The top sheet, bottom sheet, side or wrap sheet, or any combination thereof may be formed of a material having a resistance or barrier to oxygen or carbon dioxide transmission. The top sheet, bottom sheet, side or wrap sheet, or any combination thereof may be formed of a material having a predetermined oxygen transmission rate and/or carbon dioxide transmission rate. In the described system and method, more than one layer of the top sheet, bottom sheet, side or wrap sheet, or any combination thereof may be provided. Each layer may have the same properties or may have different properties. One or more layers may have the same properties and one or more layers may have different properties. One or more layers may be treated with a functional substance (e.g., incorporated or impregnated therein). The number of layers of each of the top sheet, bottom sheet, side or wrap sheet, the materials selected, the material properties, the functional substances selected, or any combination thereof may be selected based on the particular product contained in the pallet. For example, where the stacked product is asparagus, the sheets may be light inhibiting coated moisture barrier paper sheets.

The functional sheet may include ingredients that have been impregnated, laminated, coated, or printed on; these ingredients may be able to neutralize, absorb, or block ethylene; absorb or neutralize malodors; absorb or neutralize carbon dioxide; absorb moisture or oxygen; sanitize; or add aroma. The functional substances or ingredients may be incorporated into the top sheet, bottom sheet, or the wrapper sheet. The functional substances or ingredients may be a sanitizer, a preservative, an antifungal, an essential oil, a reducing agent, an aroma, cyclodextrins, ethylene reducing compound, ethylene blocking compound, ethylene scavenging compound, a ripening agent.

The modified atmosphere substances may include compressed filtered, dry, or humidified air, an industrial gas including but not limited to nitrogen, carbon dioxide, and oxygen, & carbon monoxide. The targeted functional substances (including any sanitizers and allowable substances for treatment of the product) are mixed into the injected gas and may include: chlorine dioxide, hydrogen peroxide, peracetic acid, ozone, ionized air or industrial gas, ionized sanitizer or water, pH adjusted water or sanitizer, limonene, lemon oil, orange oil, grapefruit oil, rosemary oil, thyme oil, sunflower oil, other fruit-derived oils, tea tree oil, cinnamon oil, eucalyptus oil, potassium oleate, sodium dodecyl sulfate (SDS), ascorbic acid, citric acid, sodium bicarbonate, potassium carbonate, calcium phosphate, linear terpenes, cyclic terpenes, alcohols, aldehydes, esters, ketones, lactones, thiols, lipase, rose oil, rose essence, and fruit essence, vitamins, minerals, flavonoids, flavor compounds, color compounds, essence, essential oil, sugar, THC or THC compounds, CBD or CBD compounds, probiotics, phages, enzymes, pharmaceutical compounds, biological compounds, or ripening agents such as ethylene. The modified environment may include powders, nano-particles, fluidized and/or gaseous state materials. The modified environment may include substances injected in the form of a vapor, mist, or gaseous (invisible or cloud like) state. Any combination of the aforementioned functional substances may be provided.

Although described with respect to pallets, the systems and methods of the present disclosure may be employed to provide an enclosure and/or a modified atmosphere and/or substance treatments in other containers or platforms, such as, for example, slip-sheets, bins, crates, and other open top containers (including containers with an opening or openings that can be enclosed using the system and methods described). The containers may be formed of any material. In some cases, the bins may include a liner, such as a plastic liner. The liner may be omitted depending on the material of the bin and/or the modified atmosphere provided. The containers, goods, products, or packages may or may not be provided on a pallet. The containers, goods, products, or packages may be provided on a slip-sheet. The slip-sheet may be provided in lieu of or in addition to a pallet or other container.

In an exemplary embodiment where the container is an open-topped bin, the bin may be filled with a product (e.g., a perishable product or produce). Using a top sheet dispenser, as described herein, the open top of the bin may be sealed. The top sheet may be sealed to the bin with tape or other adhesive and/or may cling to the sides of the bin (in a similar manner as the sheets may cling to the sides of the pallet of stacked goods). The top sheet may be sealed to the bin by providing a wrap sheet (e.g., such as provided with a pallet wrapper) around the circumference of the bin. The wrap sheet may hold the edges of the top sheet to the bin. Once the interior of the bin is sealed or in conjunction with the sealing process, a modified atmosphere may be provided in any of the manners described here (e.g., with the use of nozzles). Functional substances may be applied to the bin, the top sheet, and/or may be introduced into the modified atmosphere.

According to the disclosure, a system for creating a modified atmosphere in a sealed enclosure is disclosed comprising: a top sheet applicator, a bottom sheet applicator, a wrapper, and a nozzle.

According to the disclosure, the system and methods may be accomplished via a manual or hand method, a semi-automated method, or a fully automated method.

According to the disclosure, there are several critical components of the system, methods, and apparatuses. These include placing a sealable top and bottom sheet or cap on the pallet, wrapping the pallet to create the sealed enclosure, and then injecting the modified atmosphere and/or functional substances into the sealed pallet with or without the use of industrial gasses.

According to the disclosure, creating the sealed enclosure around the pallet has several alternative wrapper options, including turn table, single arm wrapper, two arm wrapper, ring wrapper, orbital wrapper, machine/cart wrapper, and manual/hand wrapper.

According to the disclosure, an injector for creating a modified atmosphere in a sealed enclosure is disclosed comprising: a stabilizing support bar; and at least one nozzle formed at a right angle to the stabilizing support bar, the nozzle connected to a gas source; wherein the stabilizing support bar is placed on top of a package to be enclosed in the sealed enclosure, and the gas is injected into the sealed enclosure through the nozzle.

According to the disclosure, the nozzle for injecting the modified atmosphere and other functional substances into the sealed enclosure provides improved flow disbursements down and/or up and into the pallet.

According to the disclosure, the injection system and nozzle(s) may enable and facilitate mixing gasses and substances from multiple sources. These sources and substances may be channeled individually through the nozzle to a point near the tip or to specific points on the nozzle to improve distribution or the desired pattern of distribution. The nozzle(s) may have a blending, a turbo boost and/or turbo charger capability or effect added, or other such devices built into the one or more nozzles for injecting powders, nano-particles, fluidized and/or gaseous state materials.

According to the disclosure, methods and apparatus are used to inject substances in the form of a vapor, mist, or gaseous (invisible or cloud like) state via the system and nozzle(s) into the pallet enclosure. The apparatus used to convert or accelerate a liquid or solid substance into a gaseous state may include but not be limited to a nebulizer, ultrasonic device, a vaporizer and/or other such devices.

According to the disclosure, an injector for creating a modified atmosphere in a sealed enclosure is disclosed comprising: a base, wherein a package to be enclosed in the sealed enclosure is placed on the base; and a nozzle formed at a right angle to the base, the nozzle connected to a gas source; wherein the gas is injected into the sealed enclosure through the nozzle.

According to the disclosure, a method for creating a modified atmosphere in a sealed enclosure is disclosed comprising: placing a bottom sheet on a bottom surface of a package to be enclosed inside the sealed enclosure; placing a top sheet on a top surface of the package; placing a manifold on the top sheet, the manifold having a portion extending along a side surface of the package; applying a side sheet by rotating the package along a longitudinal axis of the package, the side sheet covering the portion of the manifold extending along the side surface of the package, the bottom sheet, top sheet, and side sheet forming the sealed enclosure; injecting at least one gas into the sealed enclosure through the manifold; and removing the manifold.

According to the disclosure, a system for applying a functional sheet along a side surface of the package inside the sealing side sheet; whereby the functional sheet contains ingredients that have been impregnated, laminated, coated, or printed on; these ingredients are able to neutralize, absorb, or block ethylene; absorb or neutralize malodors; absorb or neutralize carbon dioxide; absorb moisture or oxygen; sanitize; or add aroma.

According to the disclosure, the functional ingredients may be incorporated into the top sheet, bottom sheet, or the wrapper sheet.

According to the disclosure, the top sheet, bottom sheet, or wrapper sheet may be perforated in a way to enable some controlled intrusion of outside air and release of the gasses within the pallet to achieve target levels of oxygen, nitrogen, carbon dioxide, and moisture.

According to the disclosure, the top sheet may be constructed in a manner to easily permit connection of a nozzle that may be used to add or exchange gas mixture within the sealed enclosure.

According to the disclosure, the modified atmosphere substances include compressed air, filtered, dry, or humidified air, and industrial gasses (including one or more of nitrogen, carbon dioxide, carbon monoxide, oxygen, & nitrous oxide). The targeted functional substances mixed into the injected gas include: chlorine dioxide, hydrogen peroxide, peracetic acid, ozone, ionized air or industrial gas, ionized sanitizer or water, pH adjusted water or sanitizer, limonene, lemon oil, orange oil, grapefruit oil, rosemary oil, thyme oil, sunflower oil, other fruit-derived oils, tea tree oil, cinnamon oil, eucalyptus oil, potassium oleate, sodium dodecyl sulfate (SDS), ascorbic acid, citric acid, sodium bicarbonate, potassium carbonate, calcium phosphate, linear terpenes, cyclic terpenes, alcohols, aldehydes, esters, ketones, lactones, thiols, lipase, rose oil, rose essence, and fruit essence, vitamins, minerals, flavonoids, flavor compounds, color compounds, essence, essential oil, sugar, THC or THC compounds, CBD or CBD compounds, probiotics, phages, enzymes, pharmaceutical compounds, biological compounds, or ripening agents such as ethylene.

According to the disclosure, functional substances incorporated into or on the functional sheet, top sheet, bottom sheet, or wrapper sheet include: a sanitizer, a preservative, an antifungal, an essential oil, a reducing agent, an aroma, cyclodextrins, ethylene reducing compound, ethylene blocking compound, ethylene scavenging compound, a ripening agent.

According to the disclosure, the top sheet, bottom sheet, functional sheet, or wrapper sheet may be made using natural, compostable, biodegradable, and/or recyclable materials. Good sealed enclosures are especially important in these modified air systems. If the sealed enclosure leaks, the beneficial gases may escape leaving the perishable product exposed to increased respiration and accelerated senescence. Furthermore, a change in the composition of gases in the enclosure may damage the goods. For example, an excessive amount of $CO_2$, in the enclosure may cause food to discolor or change taste.

According to the disclosure, a nozzle with a stabilizing support mounting feature may be provided to reliably position the nozzle relative to the pallet of stacked goods. The nozzle may be positioned as part of the wrapping process to be "sandwiched" between the wrap and the top or bottom sheets to be accessible to the interior volume for vacuum and gassing. The nozzle may be configured and positioned for insertion, use and removal from a pallet of stacked goods without puncturing and/or compromising the integrity of the wrapper of the sealed pallet of stacked goods. One or more nozzles may be used, and the nozzles combined to be interoperable. The nozzles may be part of an automated pallet of stacked goods wrapping system for sealing. The nozzle may be temporary and may be removable. Where two or more nozzles are provided, the nozzles may include one or more injection nozzles and one or more vacuum nozzles. The system may vacuum and inject simultaneously or sequentially. The system may allow for an exchange of gases by removing a gas from the sealed enclosure with the vacuum nozzle and injecting a gas into the sealed enclosure with the injection nozzle. This may allow for faster more uniform exchange of gas. The injection nozzles may be placed at the top of the sealed enclosure and the vacuum nozzles may be placed at the bottom of the sealed enclosure, or vice versa. In an exemplary embodiment, the vacuum nozzle may remove oxygen from the sealed enclosure before or simultaneously with the injection nozzle injecting nitrogen.

The system and method of the present disclosure may alleviate many of the disadvantages of known apparatus and methods for wrapping and preserving perishable goods by providing an apparatus and method for creating a sealed enclosure around perishable goods stacked on a pallet. The system and method of the present disclosure may provide significantly improved, commercially viable, lower cost treatments of functional substances by applying them to a pallet quantity of perishable goods instead of within individual consumer packages or trays or cases of those packages. A turntable wrap machine may cost approximately 10% to 20% of the cost of the above described high speed wrapping machines. Furthermore, wrapping pallets to create an enclosure is cheaper than using the prior art pallet bags, bottom sheets, and tape. Additionally, wrapping of pallets accommodates different size pallets, whereas different size pallets would necessitate different size bags, adding to cost. However, if using a wrapper with a turntable design and the top and bottom sheets or top and bottom caps are pre-applied and/or the pallet needs to be wrapped by hand, it has not been practical or easy to create a consistent sealed enclosure and inject gasses efficiently and effectively. The disclosure further provides a method and system that does not require puncturing and taping of a sealed enclosure.

According to the disclosure and embodiments, there are unique elements of the preferred system, methods and apparatus that can be applied even to significantly improve on the less preferred prior art which uses a bag, bottom sheet, and tape for creating and sealing an encloser over stacked products on a pallet and then requires puncturing the bag inserting a nozzle to inject an industrial gas of CO2 or N2 and then taping over the puncture in the sealed enclosure to create a modified atmosphere package (MAP). The unique elements of the new system include, but are not limited to, use of the improved bottom sheet dispenser, improved method and apparatus (as shown in the figures) for tape sealing the bottom sheet to the pallet bag and injection of a prescribed atmospheric gas, injecting a functional substance treatment(s), adding a functional bottom sheet, or adding a substance treatment to the bottom sheet or within the sealed enclosure, improved manifold and nozzle designs for gas injection, the use of pressure pads & rollers during the gas injection and sealing process, and the use of one or more input devices such as scanners, cameras, and sensors to provide the required data to semi-automate, or automate the process, and too accurately deliver prescribed product treatments. Remote sensing devices may also be provided. With a remote sensing device, the O2 level within an enclosure may be determined without the need to physically sample the atmosphere within the enclosure using a sample line or tube inside of the nozzle.

While various embodiments of the present invention have been described above, it should be understood that they have been presented by way of example only, and not limitation. Features, in whole or in part, in one embodiment may be utilized in other embodiments. Thus, the breadth and scope of the present invention should not be limited by any of the above-described embodiments but should instead be defined only in accordance with the following claims and their equivalents.

The invention claimed is:

1. A method for creating a modified atmosphere in a sealed enclosure, the method comprising:

placing a bottom sheet on a bottom surface of a package to be placed on a pallet and to be enclosed inside the sealed enclosure;

placing a top sheet on a top surface of the package;

placing a manifold on the top sheet, on the bottom sheet, or both on the top sheet and on the bottom sheet, the manifold having a nozzle portion extending along a surface of the package;

applying a side sheet, the side sheet covering the nozzle portion of the manifold extending along the surface of the package, the bottom sheet, the top sheet, and the side sheet forming the sealed enclosure;

injecting at least one treatment, gas, or substance into the sealed enclosure through the nozzle portion of the manifold;

removing the nozzle portion of the manifold; and forming a seal between the side sheet and at least one of the top sheet or the bottom sheet at one or more interfaces from which the nozzle portion of the manifold is removed.

2. The method according to claim 1, wherein a functional sheet is applied to the surface of the package before the side sheet, the top sheet, or the bottom sheet are applied.

3. The method according to claim 2, wherein the functional sheet comprises ingredients that i) neutralize, absorb, or block ethylene, ii) neutralize or absorb malodors, iii) neutralize or absorb a specific gas component such as carbon dioxide or oxygen, iv) absorb moisture, v) sanitize, vi) add aroma, or vii) any combination thereof.

4. The method according to claim 2, wherein the top sheet, the bottom sheet, the functional sheet, or the side sheet are formed of natural, compostable, biodegradable, recyclable, or reusable materials.

5. The method according to claim 1, wherein the top sheet, the bottom sheet, the side sheet, a functional sheet, or other materials contained within the sealed enclosure are made of pulp-based materials, paper materials, woven materials, non-woven materials, foils, substrates, or combinations thereof, and wherein, the top sheet, the bottom sheet, the side sheet, the functional sheet, or other materials contained within the sealed enclosure are then sprayed, coated, impregnated, laminated, embossed, printed with, generally contain, or combinations thereof, with functional substances.

6. The method according to claim 1, wherein functional substances are incorporated into any of the top sheet, the bottom sheet, or the side sheet.

7. The method according to claim 1, further comprising placing, spraying, or otherwise applying one or more functional substances on top of the pallet and below the top sheet in a sachet, pad, as a liquid mixture, as a material substrate, or combinations thereof.

8. The method of claim 1, further comprising placing, spraying, or otherwise applying one or more functional substances on top of the bottom sheet in a sachet, pad, sheet, fiberboard, or as a liquid mixture.

9. The method according to claim 1, wherein any of the top sheet, the bottom sheet, or the side sheet is perforated or treated such that some controlled intrusion of outside air and release of gasses within the pallet is permitted to achieve target levels of oxygen, nitrogen, carbon dioxide and moisture.

10. The method according to claim 1, wherein the top sheet is constructed to permit connection of a nozzle configured to add or exchange gas mixture around the package during or after the sealed enclosure is sealed.

11. The method according to claim 1, wherein injecting the at least one treatment, gas, or substance into the sealed enclosure includes injecting gas into the sealed enclosure, the gas including compressed, filtered, dry, or humidified air, industrial gas, ozone, air, or any combination thereof.

12. The method according to claim 11, wherein the gas includes industrial gas, the industrial gas including nitrogen, carbon dioxide, carbon monoxide, an industrial gas that has been ionized or treated by plasma or corona discharge, or any combination thereof.

13. The method according to claim 1, wherein injecting the at least one treatment, gas, or substance into the sealed enclosure includes injecting gas into the sealed enclosure, the gas comprising functional substances mixed into the gas, the functional substances including one or more forms of: chlorine dioxide, nitrous oxide, hydrogen peroxide, peracetic acid, ozone, or any sanitizer, ionized air, ionized industrial gas, ionized sanitizer, ionized water and/or pH adjusted water or pH adjusted sanitizer, limonene, lemon oil, orange oil, grapefruit oil, rosemary oil, thyme oil, sunflower oil, other fruit-derived oils, tea tree oil, cinnamon oil, eucalyptus oil, potassium oleate, sodium dodecyl sulfate (SDS), ascorbic acid, citric acid, sodium bicarbonate, potassium carbonate, calcium phosphate, linear terpenes, cyclic terpenes, alcohols, aldehydes, esters, ketones, lactones, thiols, lipase, rose oil, rose essence, and fruit essence, vitamins, minerals, flavonoids, flavor compounds, color compounds, essence, essential oil, sugar, THC or THC compounds, CBD or CBD compounds, probiotics, phages, enzymes, pharmaceutical compounds, biological compounds, or ripening agents such as ethylene.

14. The method according to claim 1, further comprising incorporating functional substances into or on a functional sheet, the top sheet, the bottom sheet, and/or the side sheet, wherein the functional substances include one or more of: a sanitizer, a preservative, an antifungal, an essential oil, a reducing agent, an aroma, cyclodextrins, ethylene reducing compound, ethylene blocking compound, ethylene scavenging compound, and a ripening agent.

15. The method according to claim 1, wherein the step of injecting at least one treatment, gas, or substance into the sealed enclosure through the manifold comprises injecting the treatment, gas, or substance after the package has been sealed or during final stages of forming the sealed enclosure.

16. The method according to claim 1, wherein the side sheet and the at least one of the top sheet or the bottom sheet at the one or more interfaces adhere to one another forming the seal.

17. The method according to claim 16, wherein the seal is formed by one or more devices to wipe, press, roll, or any combination thereof, over an area of the one or more interfaces between the sheets.

18. The method according to claim 1, further comprising:

applying a vacuum to the sealed enclosure through the manifold before injecting the at least one treatment, gas, or substance into the sealed enclosure.

19. The method according to claim 1, wherein the pallet is placed on a rotatable turntable during the step of applying the side sheet.

20. The method according to claim 1, wherein the package is rotated during the steps of applying the side sheet and injecting the at least one treatment, gas, or substance into the sealed enclosure.

21. The method according to claim 1, wherein the manifold comprises a nozzle of the nozzle portion, a hose, and a mounting framework.

22. The method according to claim 21, wherein the mounting framework is a stabilizing support bar or a mechanical-robotic mounting.

23. The method according to claim 1, wherein the nozzle portion of the manifold extends inside the sealed enclosure between the package and the top sheet, side sheet, and bottom sheet, and wherein the at least one treatment, gas, or substance is injected through the nozzle portion of the manifold.

24. The method according to claim 1, wherein injecting the at least one treatment, gas, or substance into the sealed enclosure includes injecting gas into the sealed enclosure, and wherein the gas is blended with a substance in a hose, in a nozzle, in a blending chamber, or any combination thereof.

25. The method according to claim 24, wherein the substance is another gas, pressurized gas, pressurized air, a functional substance, or combinations thereof.

26. The method according to claim 1, wherein injecting the at least one treatment, gas, or substance into the sealed enclosure includes injecting gas into the sealed enclosure, and wherein the gas is blended with a substance prior to the sealed enclosure or within the sealed enclosure.

27. The method of claim 1, wherein the top sheet, the bottom sheet, side sheet, or any combination thereof comprises a predetermined oxygen transmission rate or a predetermined carbon dioxide transmission rate.

28. The method of claim 1, wherein the injecting of the at least one treatment, gas, or substance creates the modified atmosphere.

29. The method of claim 1, wherein the modified atmosphere controls a moisture level within the sealed enclosure.

30. The method of claim 1, wherein the nozzle portion of the manifold extends inside the sealed enclosure between the package and the top sheet, the side sheet, and the bottom sheet, and wherein a vacuum is applied through the nozzle portion of the manifold.

31. The method according to claim 1, wherein at least one of the top sheet, the bottom sheet, or the side sheet is adhered to or cling to the package with one or more brushes or a wiping device such that ends of the at least one of the top sheet, the bottom sheet, or the side sheet are secured to the package.

* * * * *